US011013264B2

(12) United States Patent
Sanchez et al.

(10) Patent No.: US 11,013,264 B2
(45) **Date of Patent: *May 25, 2021**

(54) METHOD, COMPOSITION AND APPARATUS FOR FUNCTIONALIZATION OF AEROSOLS FROM NON COMBUSTIBLE SMOKING ARTICLES

(71) Applicant: Fontem Holdings 4 B.V., Amsterdam (NL)

(72) Inventors: Luis A. Sanchez, Greensboro, NC (US); Steven E. Brown, Oak Ridge, NC (US); Kai Tang, Chapel Hill, NC (US)

(73) Assignee: Fontem Holdings 4 B.V., Amsterdam (NL)

( * ) Notice: Subject to any disclaimer, the term of this patent is extended or adjusted under 35 U.S.C. 154(b) by 61 days.

This patent is subject to a terminal disclaimer.

(21) Appl. No.: 14/946,662

(22) Filed: Nov. 19, 2015

(65) Prior Publication Data

US 2016/0143360 A1 May 26, 2016

Related U.S. Application Data

(60) Provisional application No. 62/081,870, filed on Nov. 19, 2014, provisional application No. 62/119,655, filed on Feb. 23, 2015.

(51) Int. Cl.
*A24F 47/00* (2020.01)

(52) U.S. Cl.
CPC ..... *A24F 47/008* (2013.01); *A24F 47/002* (2013.01)

(58) Field of Classification Search
CPC ..... A24F 47/008; A24F 47/002
(Continued)

(56) References Cited

U.S. PATENT DOCUMENTS 4,411,280 A * 10/1983 Floyd ..... A24D 3/0237 131/332
5,012,829 A * 5/1991 Thesing ..... A24B 15/281 131/335

(Continued)

FOREIGN PATENT DOCUMENTS

EP 3042577 A1 7/2016
WO 2015013108 A2 1/2015

(Continued)

*Primary Examiner* — Qingzhang Zhou
(74) *Attorney, Agent, or Firm* — Dykema Gossett PLLC

(57) ABSTRACT

An apparatus and method for delivering an aerosol-forming composition and a separate functional composition for generating a functionalized aerosol vapor which emulates the organoleptic characteristics and properties of mainstream smoke experienced by smoking traditional tobacco-based smoking articles. The apparatus can comprise a battery section comprising a first housing, a battery disposed within the first housing, and a first connector coupled to the housing, an aerosol section comprising a second housing, an aerosol forming chamber disposed within the second housing, and a pod bay, and an insert section comprising a third housing, a connector, an annular separator, and a mouth end. The battery section can be configured to couple to the aerosol section, the aerosol section can be configured to couple to the insert section, and the connector can be configured to fit within the pod bay.

20 Claims, 51 Drawing Sheets

(58) Field of Classification Search
USPC ..... 131/280, 274
See application file for complete search history.

(56) References Cited

U.S. PATENT DOCUMENTS

| | | | | |
|---|---|---|---|---|
| 8,499,766 | B1 | 8/2013 | Newton | |
| 2008/0092912 | A1* | 4/2008 | Robinson | A24F 40/40 131/200 |
| 2011/0265806 | A1 | 11/2011 | Alarcon et al. | |
| 2013/0192615 | A1 | 8/2013 | Tucker | |
| 2013/0192620 | A1 | 8/2013 | Tucker et al. | |
| 2013/0192621 | A1* | 8/2013 | Li | H01C 17/00 131/329 |
| 2013/0213418 | A1* | 8/2013 | Tucker | A24F 47/008 131/328 |
| 2014/0166029 | A1 | 6/2014 | Weigensberg et al. | |
| 2014/0261486 | A1 | 9/2014 | Potter et al. | |
| 2014/0261493 | A1* | 9/2014 | Smith | A24F 47/008 131/328 |
| 2015/0027468 | A1 | 1/2015 | Li et al. | |
| 2015/0027469 | A1 | 1/2015 | Tucker et al. | |
| 2015/0374035 | A1 | 12/2015 | Sanchez | |
| 2016/0073695 | A1 | 3/2016 | Sears et al. | |
| 2016/0206003 | A1 | 6/2016 | Yamada et al. | |

FOREIGN PATENT DOCUMENTS

| | | | |
|---|---|---|---|
| WO | 2015179388 | A1 | 11/2015 |
| WO | 2016012774 | A1 | 1/2016 |
| WO | 2016062777 | A1 | 4/2016 |
| WO | 2016121143 | A1 | 4/2016 |
| WO | 2016069903 | A1 | 5/2016 |
| WO | 2016075748 | A1 | 5/2016 |
| WO | 2016076178 | A1 | 5/2016 |

* cited by examiner

METHOD, COMPOSITION AND APPARATUS FOR FUNCTIONALIZATION OF AEROSOLS FROM NON COMBUSTIBLE SMOKING ARTICLES

CROSS-REFERENCE TO RELATED APPLICATIONS

This application claims the benefit of priority to U.S. provisional application No. 62/081,870, filed 19 Nov. 2014 (the '870 application), and claims the benefit of priority to U.S. provisional application No. 62/119,655, filed 23 Feb. 2015 (the '655 application). The '870 application and the '655 application are both hereby incorporated by reference as though fully set forth herein.

FIELD OF THE INVENTION

The present invention relates to methods, compositions and apparatus for generating a functionalized aerosol which emulates the organoleptic characteristics and properties of mainstream smoke generated by traditional tobacco-based smoking articles.

BACKGROUND

Electronic cigarettes are a popular alternative to traditional smoking articles that burn tobacco products to generate mainstream smoke for inhalation. Unlike traditional tobacco-based smoking articles, electronic cigarettes generate an aerosol-based vapor for inhalation which generally emulates mainstream smoke of traditional tobacco based smoking articles. However, it is generally recognized that aerosol-based vapor generated by electronic cigarettes does not deliver the same "quality" of experience as traditional smoking articles. Applicants have found that this deficiency in the "quality" of experience results, at least in part, from the use of a composite aerosol forming liquid solution to generate the aerosol-based vapor. More specifically, the composite aerosol forming liquid solution includes an aerosol forming liquid and one or more taste, fragrance or nicotine delivery compositions. Among other things, it is believed that the use of such a composite aerosol forming liquid solution may result in the formation of chemically or pharmacological incompatible components. Furthermore, it is believed that interactions among the various components of the composite aerosol forming liquid solution may cause chemical, pharmacological, and/or thermal instability, which, in turn, may result in particulate precipitation, fouling of the aerosol heating element or chemical degradation of the solution, as well as other constraints to aerosol vapor delivery. Each of these deficiencies compromises the organoleptic performance and quality of the aerosol based vapor generated by the electronic cigarettes. Accordingly, it is desirable to provide improved methods, compositions and apparatus for generating functionalized aerosols having enhanced organoleptic characteristics and properties which more closely emulate the smoking experience provided by the mainstream smoke from traditional tobacco-based smoking articles.

SUMMARY OF THE INVENTION

An objective of the invention is to provide a method, composition and apparatus for generating a functionalized flavor aerosol vapor which emulates the organoleptic characteristics and properties of mainstream smoke experienced by users smoking traditional tobacco-based smoking articles.

In one embodiment, an apparatus for generating a functionalized aerosol can comprise a battery section comprising a first housing, a battery disposed within the first housing, and a first connector coupled to the housing, an aerosol section comprising a second housing, an aerosol forming chamber disposed within the second housing, and a pod bay, and an insert section comprising a third housing, a connector, an annular separator, and a mouth end. The battery section can be configured to couple to the aerosol section, the aerosol section can be configured to couple to the insert section, and the connector can be configured to fit within the pod bay.

In another embodiment, an apparatus for generating a functionalized aerosol can comprise a battery section comprising a first housing, a battery disposed within the first housing, and a first connector coupled to the housing, an aerosol section comprising a second housing, an aerosol forming chamber disposed within the second housing, and a pod bay, and an insert section comprising a third housing, a connector, a chamber, and a coaxial mouth end. The battery section can be configured to couple to the aerosol section, the aerosol section can be configured to couple to the insert section, and the connector can be configured to fit within the pod bay.

Furthermore, with respect to electronic cigarettes based on tank configurations, if the users want to change flavors they either have to use multiple tanks or subject the tank to inconvenient cleaning procedures. This limits the flexibility of simple tank electronic cigarettes.

It is a further objective of the invention to provide a method comprising a two-step process for the formation of a functionalized aerosol vapor. The first step of the process involves generating an aerosol from an aerosol forming liquid. The second step of the process involves functionalizing the aerosol by subjecting the aerosol to a matrix for the purpose of transferring, delivering or imparting one or more organoleptic properties such as taste, fragrance and/or nicotine delivery to the aerosol.

It is yet a further objective of the present invention to provide a method wherein the first step of generating an aerosol comprises providing an optimal aerosol density for the desired fragrance, taste, and/or nicotine delivery properties subsequently imparted on the aerosol in the second step of the process.

It is yet a further objective of the present invention to provide a method wherein the first step of the process comprises generating an aerosol having properties for optimizing the taste, fragrance and/or nicotine delivery characteristics to the aerosol during the second step of the inventive method. For example, the aerosol forming liquid may comprise an excipient such as water which forms an aerosol having properties for activating exothermic or endothermic reactions during the second step of the process.

It is yet another objective of the present invention to provide a method wherein the aerosol vapor pressure is used as a mechanism for transferring, delivering or imparting taste, fragrance and/or nicotine characteristics during the second step of the process.

It is yet a further objective of this invention to provide an aerosol-forming composition and a separate functional composition for generating a functionalized aerosol vapor with emulates the organoleptic characteristics and properties of mainstream smoke experienced by smoking traditional tobacco-based smoking articles. For example, the aerosol-forming composition may comprise ethanol, glycerol, propylene glycol, polyethylene glycol, water, nicotine, or mixtures thereof. The functional composition may comprise one or more organoleptic components such as taste, fragrance, and/or nicotine delivery components. For example, the functional composition may comprise a solution or dispersion having taste and/or nicotine delivery components. Alternatively, the functional composition may comprise encapsulated taste and/or fragrance delivery components. Moreover, the functional composition may comprise a gel having taste, fragrance and/or nicotine delivery components.

According to another aspect of the present invention, the taste, fragrance and/or nicotine composition may comprise a vapor pressure modifier such as ethanol.

It is yet a further objective of the present invention to provide an apparatus for generating a functionalized aerosol vapor which emulates the organoleptic characteristics and properties of mainstream smoke experienced by smoking traditional tobacco-based smoking articles. In one embodiment, the apparatus comprises a first chamber or zone containing an aerosol-forming liquid which is adapted to deliver aerosol-forming liquid to a heating device. The apparatus further comprises a downstream chamber or zone containing an functional composition comprising one or more organoleptic components such as a taste, fragrance and/or nicotine delivery components.

It is yet a further objective of this invention to provide a flavor insert for imparting flavor to an aerosol.

DETAILED DESCRIPTION OF THE INVENTION

Figure 1:
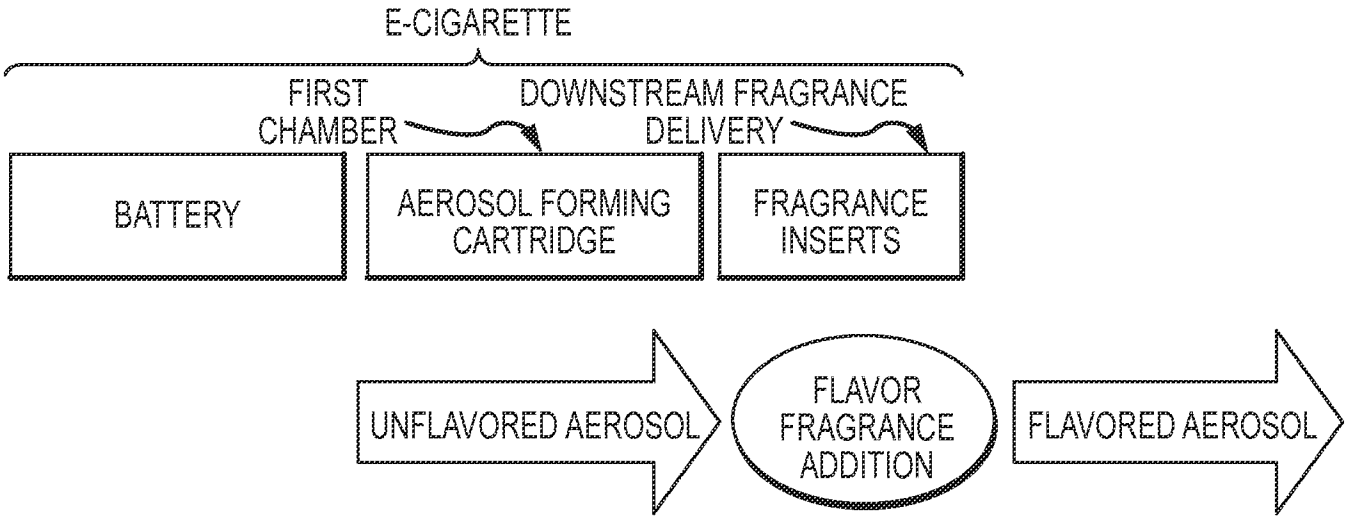
FIG. 1 is a block diagram of a fragrance insert being used in an e-cigarette.

According to one aspect of the present invention, a two-step process is used to form an aerosol with organoleptic properties suitable to be delivered with e-cigarettes. In the first step of the process, an aerosol is formed from a non-flavored formulation located in a first chamber or zone of the e-cigarette. Any aerosol formation mechanism (e.g., thermal, mechanical, piezoelectric) may be used in the present invention. The aerosol is then subjected to a taste, fragrance and/or nicotine carrying matrix adapted to transfer the desired organoleptic properties to the aerosol. During this step, taste, fragrance and/or nicotine delivery components in a high vapor pressure solvent are released into the aerosol prior to exiting the e-cigarette mouth piece. FIG. 1 shows this two-step process wherein a fragrance insert is employed to deliver fragrance to the e-cigarette aerosol. Yet a further objective is to manufacture electronic cigarettes with removable and replaceable taste functional mouth pieces where it can self-contained a functional segment.

The formation of an unflavored aerosol in an e-cigarette may involve any known nebulizer mechanism. For example, ultrasonic wave nebulization (with a piezoelectric element vibrating and creating high-frequency ultrasound waves to cause vibrations and atomization of liquid formulations), electric nebulization (with a heating element built on a high surface component in direct contact with an aerosol forming material), or spraying jet atomization by passing an aerosol solution through small venturi injection channels. In general, the aerosol characteristics depend on the rheological and thermodynamics properties of the aerosol forming liquid as well as the nebulization mechanism. Because of physical chemical stresses (i.e. thermal degradation, shear induced phase separation, etc.) of the aerosol forming material during nebulization, the aerosol characteristics and delivery consistency can be affected when the liquid is nebulized. This is very relevant to aerosol quality if the affected aerosol material component is organoleptic. For example, nicotine might degrade under thermal nebulization; menthol and other hydrophobic taste material might precipitate due to incompatibility with hydrophilic forming aerosol formulations. In other cases, desirable organoleptic materials, i.e. menthol, tobacco flavors, etc., can be insoluble in the aerosol forming liquid at the appropriate viscosity and/or surface tension to deliver an acceptable aerosol, therefore, limiting the amount of delivered organoleptic. Furthermore, improvements to the consistency of aerosol delivery might be possible with this strategy because the organoleptic material—which are absent during aerosol formation—would not affect the viscosity and the surface tension. These material variables affect aerosol particle size distribution. Having an aerosol formation process prior to flavoring insures aerosol consistency, in particular, when it is desirable to deliver a consistent nicotine amount by the aerosol exiting the mouth piece of the e-cigarette.

Therein, that an unflavored aerosol formulation, located in the first chamber or zone, suitable to form aerosols with particle size distribution and/or density and deliver desired user experience, and that can be later further tailored for organoleptic delivery is attractive to e-cigarette manufacturers. Base aerosol formulations suitable for the present invention comprise aerosol forming materials, vapor pressure modifiers, buffers, salts, nucleation site structures, surfactants, preservatives, and an excipient. Furthermore, any of the components that form the unflavored aerosol formulation can be used to trigger chemically another component located downstream the nebulizer. For example, water can be used to activate exothermic or endothermic reactions of salts located in a downstream insert to induce heat changes that either heat a sublimable material insert or change deliverable aerosol particle size distribution. Non-limiting examples of unflavored aerosol forming formulations are included in Table I below.

TABLE 1

Aerosol Formulations

| Function | Component Example | Range (%) | Formulation Examples (%) 1 | 2 | 3 | 4 | 5 |
|---|---|---|---|---|---|---|---|
| Aerosol Former | Glycols | 0-90 | 60 | 60 | 60 | | |
| Aerosol Former | Glycerin | 0-90 | 10 | | 20 | 60 | 60 |
| Vapor Pressure Modifier | Ethanol | 0-30 | | 20 | | | 10 |
| Nucleation Site | Salts: NaCl, Particle Dispersion, etc. | 0-10 | | 1 | | 1 | |
| Surfactant, Particle Size Control | Pharmaceutical Surfactants: Lecithin, Tweens, etc. | 0-5 | | 1 | 1 | 1 | |
| Buffer | Citrates, Phosphates Salt-Acid Pair | 0-10 | | 3 | 2 | 3 | |
| Preservatives | Alkyl Hydroxyanisole or Hydroxytoluene, etc. | 0-3 | 1 | 1 | 1 | 1 | 1 |
| Others | Nicotine, nicotine derivatives, etc | 0-6 | 1 | 1 | 2 | 1 | 3 |
| Excipient | Water | q.s. ad | 28 | 13 | 14 | 13 | 26 |

Organoleptic Functionalized Formulations

Taste, fragrance and/or nicotine carrying matrix formulations, applicable to this invention to change the organoleptic properties of the delivered aerosol are presented in the embodiments below. These formulations can be liquids, dispersions, gels, encapsulate fragrances, fibers or any other forms and shapes that allow intimate contact with the unflavored aerosol stream. These formulations may have a high vapor pressure to allow maximizing their fragrance contribution to the aerosol stream. Illustrative examples of functionalized formulations which may be incorporated in the e-cigarette are presented below.

Fragrance Delivery

The major formulation components in this embodiment, when the formulation is in a liquid state, consist of a fragrance, a vapor pressure modifier, a preservative and an excipient. These formulations might also contain other components to further modify the delivered aerosol stream such as surfactants, nucleation sites, buffers, etc. Table II shows non-limiting examples for solutions, dispersions, encapsulates and gel formulation physical forms. These formulations might contain nicotine as required by a final aerosol delivery specification.

TABLE II

Functionalized Formulations

| Function | Component Example | Form | Range (%) | Formulation Examples (%) 1 | 2 | 3 | 4 |
|---|---|---|---|---|---|---|---|
| Organoleptic | Piña Colada, Cherry, Coffee, etc. | Solution, Dispersion | 0-100 | | 10 | | |
| | Tobacco flavor | Solution, Dispersion | 0-100 | 50 | | | |

TABLE II-continued

| Functionalized Formulations | | | | | | | |
|---|---|---|---|---|---|---|---|
| | | | Range | Formulation Examples (%) | | | |
| Function | Component Example | Form | (%) | 1 | 2 | 3 | 4 |
| | Fragrance/Menthol | Encapsulate Fibers | 0-100 | | | 98 | |
| | Fragrance/Taste/Tobacco Flavor | Gel | 0-100 | | | | 99 |
| Others | Nicotine, nicotine derivatives, etc | Liquid | 0-6 | 1 | 1 | 2 | 1 |
| Vapor Pressure Modifier | Ethanol | | 0-30 | | | | |
| Nucleation Site Structures | Salts: NaCl, Dispersion | | 0-10 | 5 | 5 | | |
| Surfactant, Aerosol Particle Size Control | Lecithin, Tweens, etc. | | 0-5 | 3 | 3 | | |
| Buffer | Citrates, Phosphates Salt-Acid Pair, etc. | | 0-10 | 5 | 5 | | |
| Preservatives | Alkyl Hydroxyanisole or Hydroxytoluene, etc. | | 0-30 | 1 | 2 | | |
| Liquid Excipient | Water, Glycol, Glycerin, etc. | | q.s. ad | 29 | 74 | | |

Low Solubility/Hydrophobic Organoleptic Fragrance Delivery

When the solubility of the organoleptic material is low, there is a limit to the amount of organoleptic in an aerosol compatible formulation. By placing the organoleptic downstream from the aerosol forming part of the e-cigarette, it is possible to have formulations with high concentration of delivered organoleptics since they are not constrained by their low solubility in aerosol forming formulations. The formulation components in this embodiment can consist of a fragrance, a vapor pressure modifier, a preservative and an excipient. These formulations might also contain other components to further modify the delivered aerosol stream such as surfactants, nucleation sites, buffers, etc. The table below shows non-limiting examples for liquids, solutions and dispersions.

TABLE III

| Functionalized Formulations | | | | | | |
|---|---|---|---|---|---|---|
| | | | Range | Formulation Examples (%) | | |
| Function | Component Example | Form | (%) | 1 | 2 | 3 |
| Organoleptic | Menthol Solution | Liquid | 0-100 | 20 | 10 | 10 |
| | Tobacco Flavor | Solution, Dispersion | 0-100 | | 40 | |
| | Fragrance, Taste Components | Solution | 0-100 | 20 | | 20 |
| Others | Nicotine, nicotine derivatives, etc | Liquid | 0-6 | 1 | 1 | 2 |
| Vapor Pressure Modifier | Ethanol | | 0-30 | 30 | 20 | 30 |
| Nucleation Site Structures | Salts: NaCl, Dispersion | | 0-10 | 5 | 5 | 5 |
| Surfactant, Aerosol Particle Size Control | Lecithin, Tweens, etc. | | 0-5 | 3 | 3 | 3 |
| Buffer | Citrates, Phosphates Salt-Acid Pair, etc. | | 0-10 | 5 | 5 | 5 |
| Preservatives | Alkyl Hydroxyanisole or Hydroxytoluene, etc. | | 0-3 | 1 | 2 | 2 |
| Liquid Excipient | Water, Glycol, Glycerin, etc. | | q.s. ad | 15 | 14 | 23 |

Low Solubility/Hydrophobic Organoleptic Fragrance Delivery

A. Chemical/Thermal Aerosol Delivery Activation

Because in the practice of this invention two or more chambers, compartments or zones are used having different formulations, the invention also enables benefits resulting from their different nature to obtain further improvements in aerosol delivery. These improvements are inclusive for the embodiments disclosed in Table I, II and III above. Two specific cases are noted below:

1. Chemical Equilibrium or Chemical Reactivity Activation

According to this embodiment, the unflavored formulation may comprise a chemical component that can either react or affect another chemical component included in the downstream functionalized formulation. For example, it is known that nicotine in solution is in a chemical equilibrium as per the Brønsted-Lowry acid/base theory. Therefore, acidic or basic component—such as acetic, citric, etc., buffers—carried by the unflavored aerosol can be useful to control the ionization of nicotine in the final delivered aerosol. Therein, according to this embodiment, improvement in nicotine delivery consistency is possible. In addition, the formation in situ of fragile flavors and taste component is possible if reactants are kept separated until mixing in the aerosol vapor prior to delivery.

2. Thermal Activation

The inclusion of a chemical component in the unflavored formulation that can react with another chemical component included in the downstream formulation to exothermically or endothermic ally change the temperature of the aerosol. For example, water in the unflavored aerosol can react with a salt pod in the downstream portion of the e-cigarette to release heat of hydration, i.e., food grade Fe and Mn salts, CaO, etc. This heat can be used to assist in the sublimation of organoleptic in the downstream portion of the e-cigarette. Another example is the use of an endothermic reaction, i.e., food grade NH4Cl, etc. This would allow cooling of the aerosol vapor after its formation and therefore improve delivery consistency of the aerosol particle size distribution.

Figure 2:
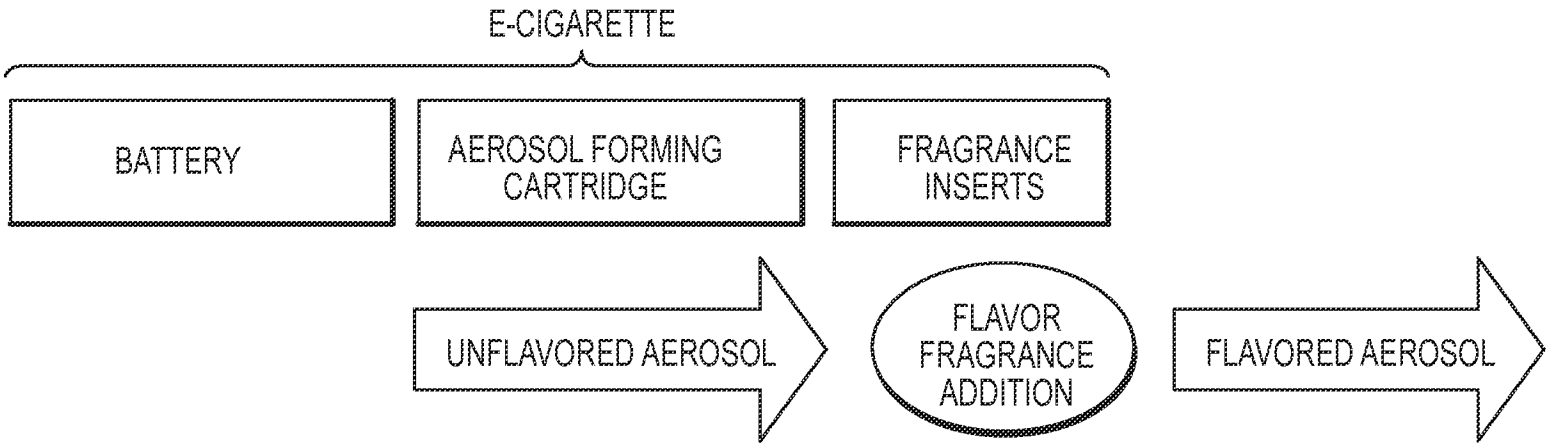
FIG. 2 is a block diagram showing an unflavored aerosol being formed and subsequently flavored.

FIG. 2 further illustrates this concept, whereby the unflavored aerosol is formed in the aerosol forming cartridge where an aerosol forming liquid is in contact with the heating element. As the aerosol moves downstream and interacts with the flavored insert, the aerosol becomes flavored. Though the sketch in FIG. 2 shows separate e-cigarette major components, it will be understood that any combination of the battery, aerosol cartridge and/or fragrance insert may be physically integrated with each other as long as the fragrance insert is disposed downstream the aerosol cartridge as indicated by the arrows.

This concept separates aerosol formation from taste, fragrance and/or nicotine delivery. Therefore, the aerosol is improved by removing any degradation of quality, nicotine delivery and taste caused by either the interaction of the aerosol forming liquid formulation with the formulation contained in the fragrance insert or its thermal degradation/inactivation when in contact with the heating element of the e-cigarette.

In addition, the fragrance formulations in the inserts can be made with a broad range of materials such as normal solutions, dispersions, emulsions, gels, creams, powders, pastes, waxes, etc. The fragrance release can occur thermally, chemically, dissolution, vapor pressure driven, moisture, electric, etc. The insert can use fabricated using one or combination of different fragrance matrixes such as surface coating, dissolvable and non-dissolvable matrix, encapsulated fragrance, fibers, porous materials, wicking web, coated web, etc.

Although, this concept is based on aerosol flow dynamics, it can be further enhanced by placing a heating element in the insert to control the release of fragrance.

Figure 3:
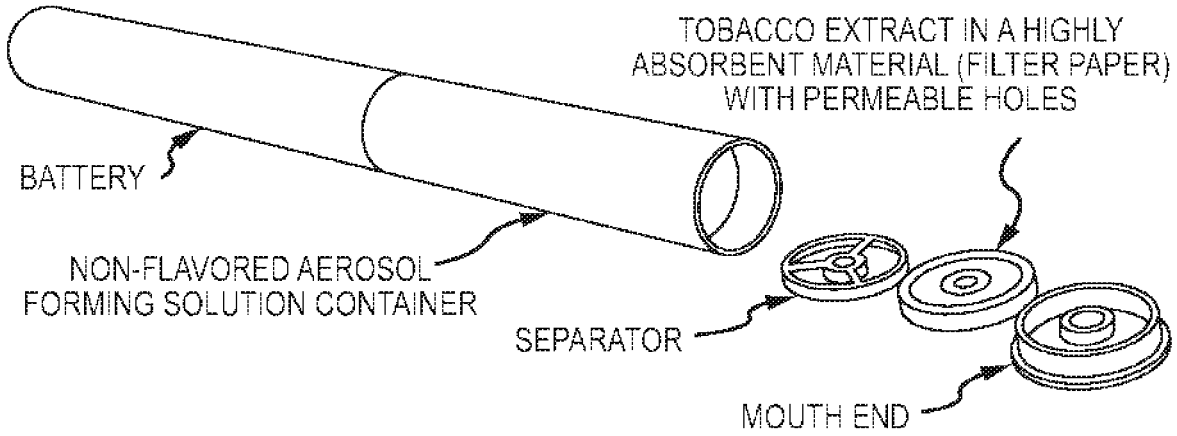
FIG. 3 is an exploded isometric view of an e-cigarette comprising a flavorant insert.

An embodiment of an apparatus of the present invention depicted below in FIG. 3 comprises an e-cigarette having a cartomizer loaded with a glycol/water solution in addition to a cellulose acetate insert coated with tobacco flavors located prior to the mouth end. The aerosol delivered under this construction tasted as 'tobacco flavored aerosol'. By way of further example, a vanilla flavored insert may be used to deliver a vanilla flavorant to aerosol delivery.

The sketches proved in the following figures illustrate numerous embodiments of the proposed inserts for the practice of the present invention. These embodiments are non-limiting, and it will be understood that the present invention may comprise combinations of one or more of these embodiments that might be integrated into an electronic cigarette or manufactured as modular or removable.

Figure 4:
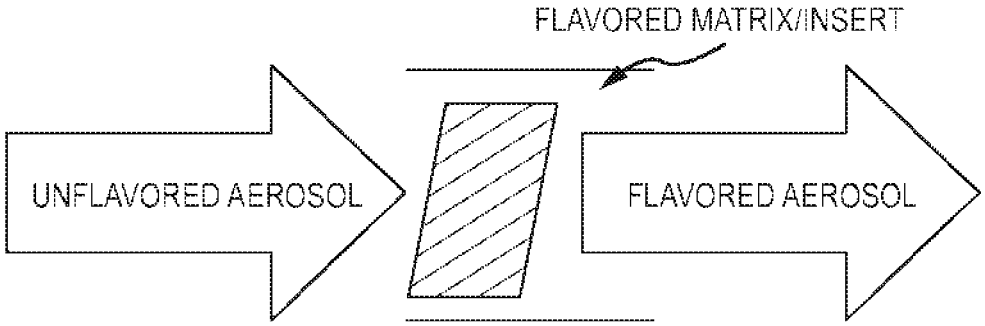
FIG. 4 is a flow diagram of one embodiment of an insert for an e-cigarette according to the disclosure.

Porous Matrix of Embedded Coated Fibers or Hollow Fibers Filled with Fragrance Formulations FIG. 4 illustrates an embodiment of the present invention comprising fragrance formulations in a porous matrix of embedded fibers. The fragrance may be coated on the fibers on contained within hollow fibers. According to this embodiment, the fragrance migrates into the aerosol stream to flavor the aerosol stream. It can be activated optionally electrically or by dissolving a fragrance carrier. A similar release mechanism is applicable to numerous of the other embodiments described below.

Single/Multiple Layer Screen Insert where the Screen Carries Fragrances as Coated Fibers, Fragrances as Encapsulated Fibers, Etc.

Figure 5:
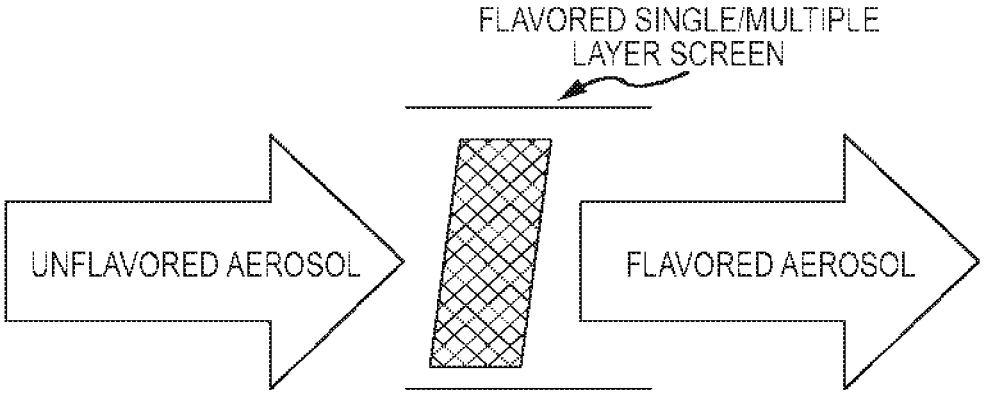
FIGS. 5-18 are flow diagrams of various embodiments of inserts for an e-cigarette according to the disclosure.

FIG. 5 illustrates an embodiment of the present invention comprising fragrances embedded in single or multiple layer screens for delivery to the unflavored aerosol vapor. According to this embodiment, for example, the release of encapsulated fragrances might be activated by water/glycol in an unflavored aerosol formulation.

Figure 6:
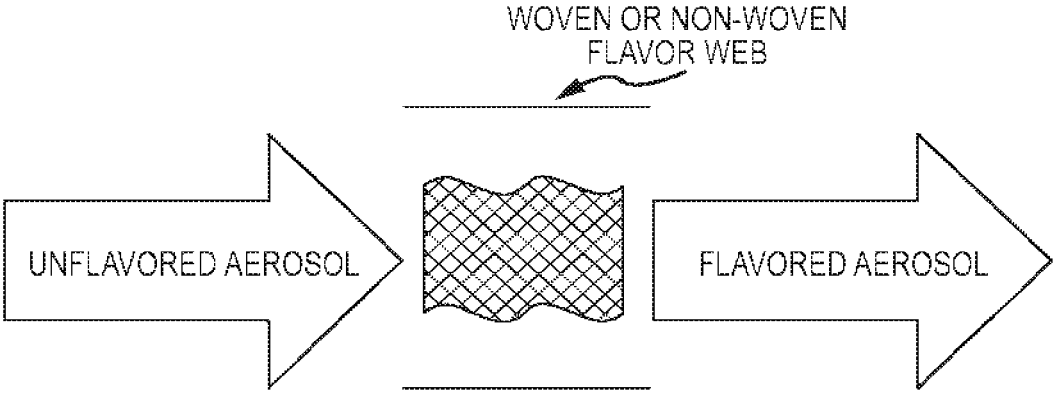

Woven or Non-Woven Web or Sheet Form with Erodible Material or any of the Previously Described Fragrance Carriers FIG. 6 illustrates an embodiment of the present invention comprising a web fabricated such that fragrances are released on interaction with the unflavored aerosol.

Diffusible and/or Erodible Disk(s)

Figure 7:
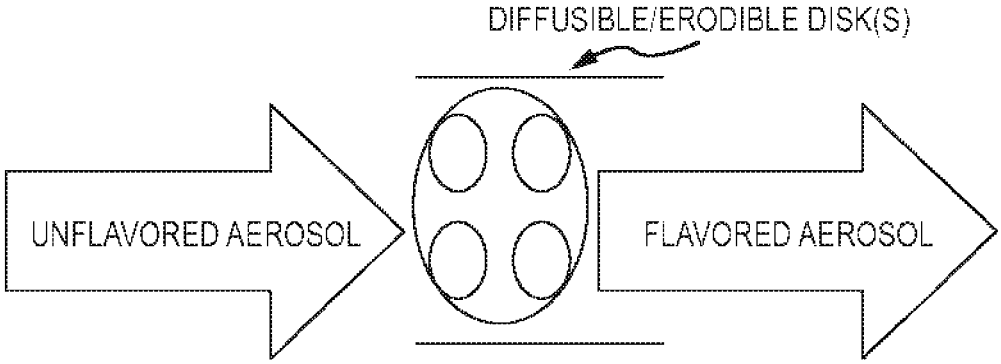

FIG. 7 illustrates an embodiment of the present invention comprising a diffusible or erodible disk containing a functionalized formulation. For example, the disk can be formulated with a fragrance in a hygroscopic matrix that erodes during inhalation.

Coil Wrapped Insert with a Coated High Area or Webbed Structure

Figure 8:
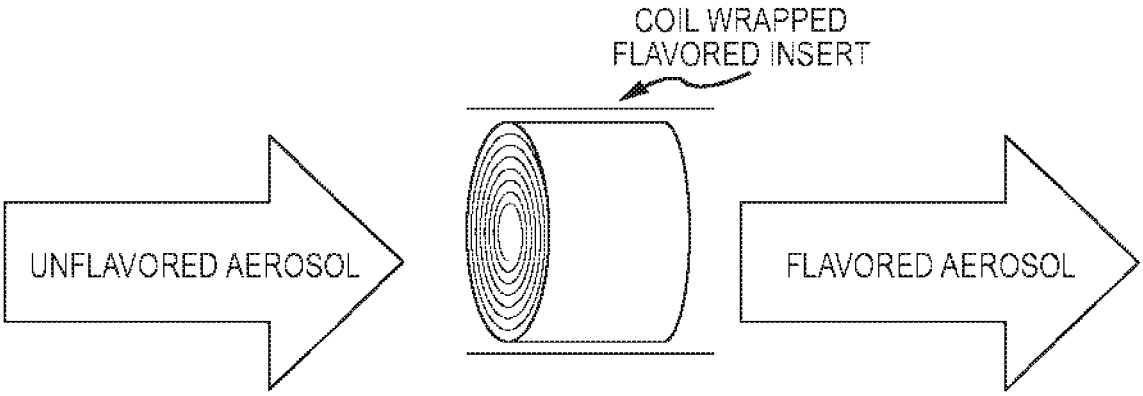

FIG. 8 illustrates an embodiment of the present invention comprising a coil wrapped insert having a coated area or webbed structure. The purpose of this design is to maximize the effective interaction between the unflavored aerosol and the flavoring insert. This design is also applicable to several of the embodiments disclosed herein.

Porous Membrane or Open Cell Foam/Sponge

Figure 9:
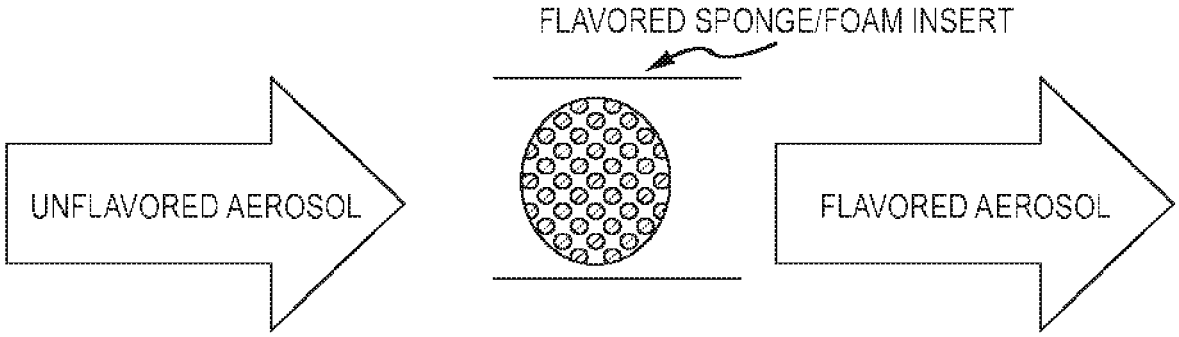

FIG. 9 illustrates an embodiment of the present invention comprising the use of a porous membrane or open cell foam/sponge structure The porous membrane can be made of cellulose or any other highly absorbing material applicable for fragrance/nicotine carrying. The e-cigarette shown in FIG. 3 with a tobacco flavor embedded material placed toward the mouth end is an embodiment of this design.

Plaited Flavor Coated Insert

Figure 10:
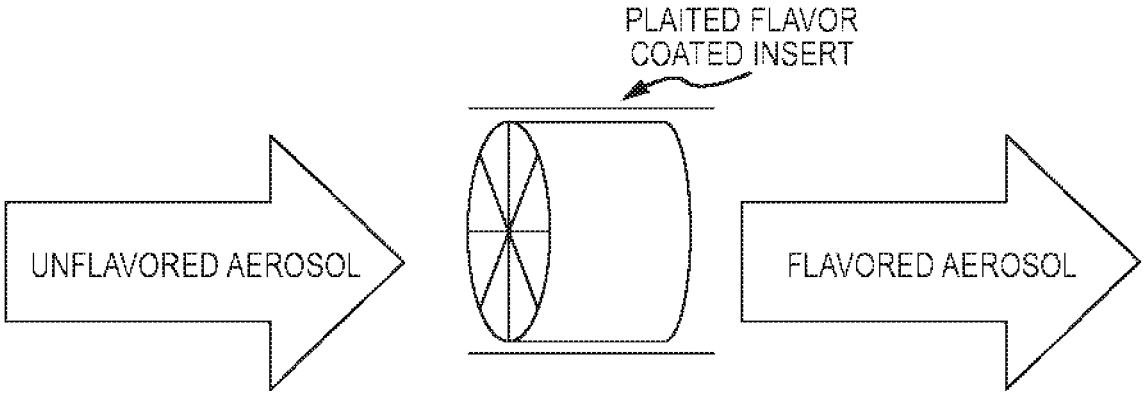

FIG. 10 illustrates an embodiment of the present invention comprising a plaited flavor coated insert. In addition of maximizing the effective interaction area for the un-flavored aerosol and the flavoring insert, this plaited design benefits from venturi acceleration to drive fragrance into the aerosol stream.

3-Dimensional Flavor Coated Insert

Figure 11:
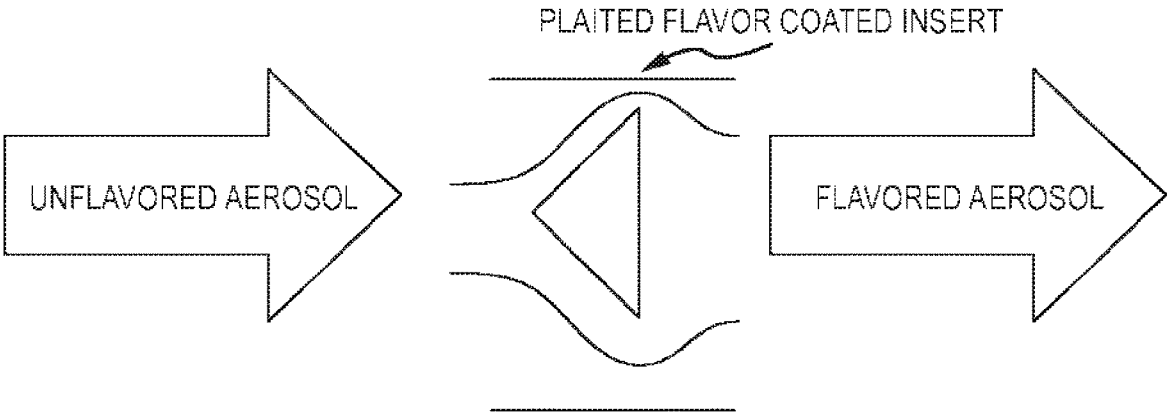

FIG. 11 illustrates an embodiment of the present invention comprising a configured flavor coated insert. In addition to the ease of construction of a solid insert, the insert can be fabricated from an erodible fragrance/nicotine matrix. One or multiple flow path can be used to control the flow dynamic and maximize the impacting energy of the unflavored aerosol on the flavoring insert.

Tube Bundles

Figure 12:
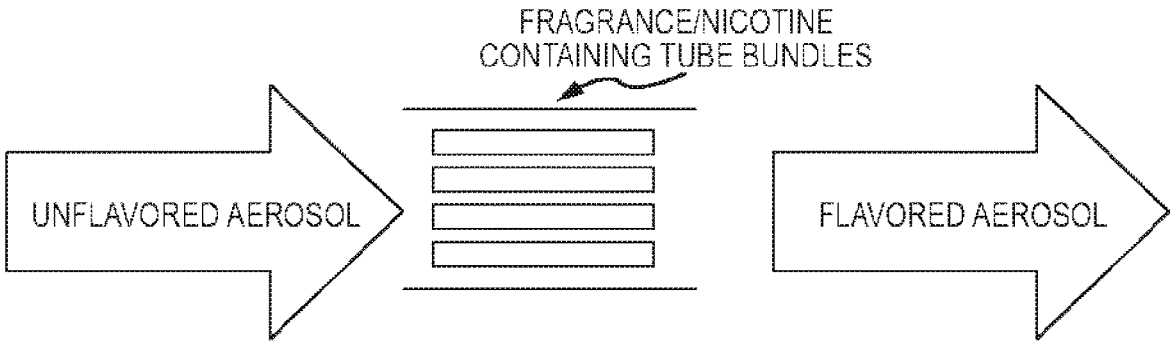

FIG. 12 illustrates an embodiment of the present invention comprising bundled tubes containing fragrances/nicotine that is releasable on differential pressure, temperature or electrical activation. Inhalation can also be a fragrance releasing force.

Fragrance/Nicotine Coated Channel in a Honeycomb Insert

Figure 13:
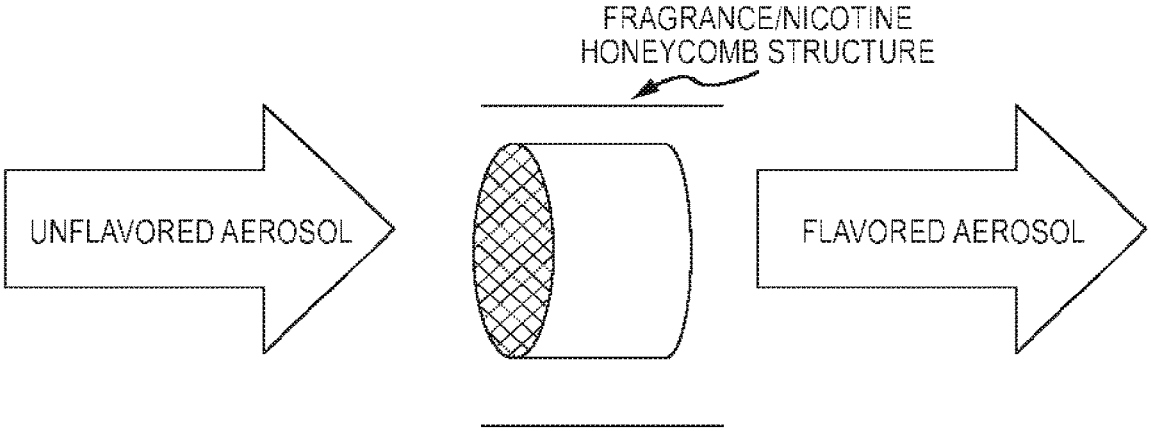

FIG. 13 illustrates an embodiment of the present invention comprising a honeycomb cell structure with fragrance/nicotine pods. Control of release can be obtained by having different releasing rates distributed among the honeycomb cells. This concept of controlling the fragrance releasing rate by changing the rate of activation across the flavoring insert is applicable to other embodiments of the present invention.

Fragrance Release by Inhalation—I

Figure 14:
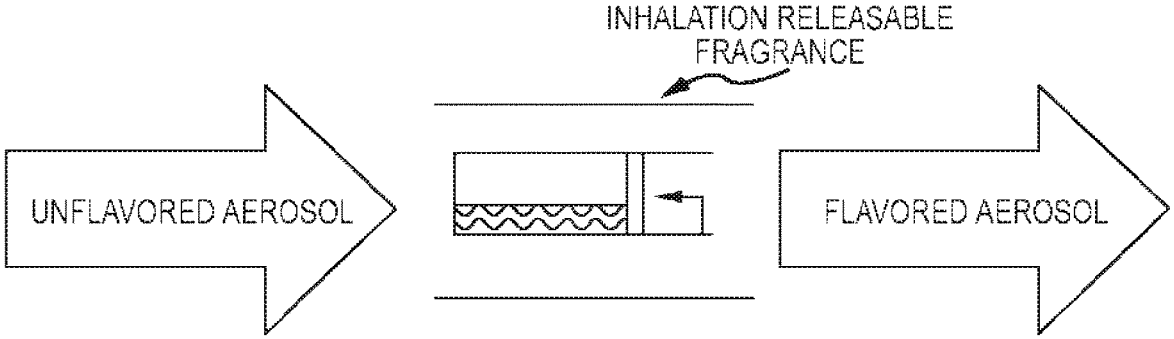

FIG. 14 illustrates an embodiment of the present invention comprising a capsule containing fragrance/nicotine which releases its load under inhalation pressure. This approach can be used to change the fragrance as an OFF/ON flavor option. Although FIG. 14 shows the flavoring of an unflavored aerosol stream, it is also applicable for changing the flavor of a flavored aerosol. This insert can be used sequentially. These concepts are also applicable below to the embodiments directed to fragrance release by inhalation or by being physically crushed.

Fragrance Release by Inhalation or Physically Crushed—II

Figure 15:
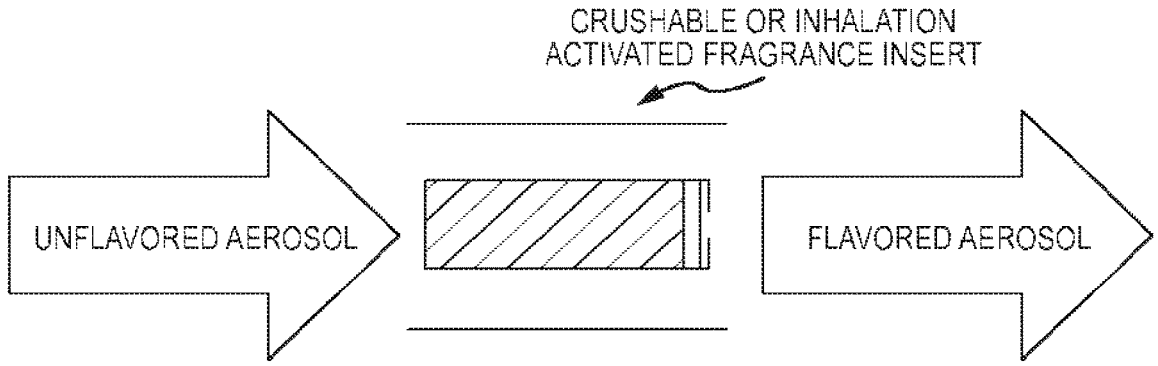

FIG. 15 illustrates an embodiment of the present invention comprising a fragrance insert that can be broken under inhalation pressure or by being physically crushed to release fragrance into the aerosol stream.

Fragrance Releasing Non-Web/Web Pouch

Figure 16:
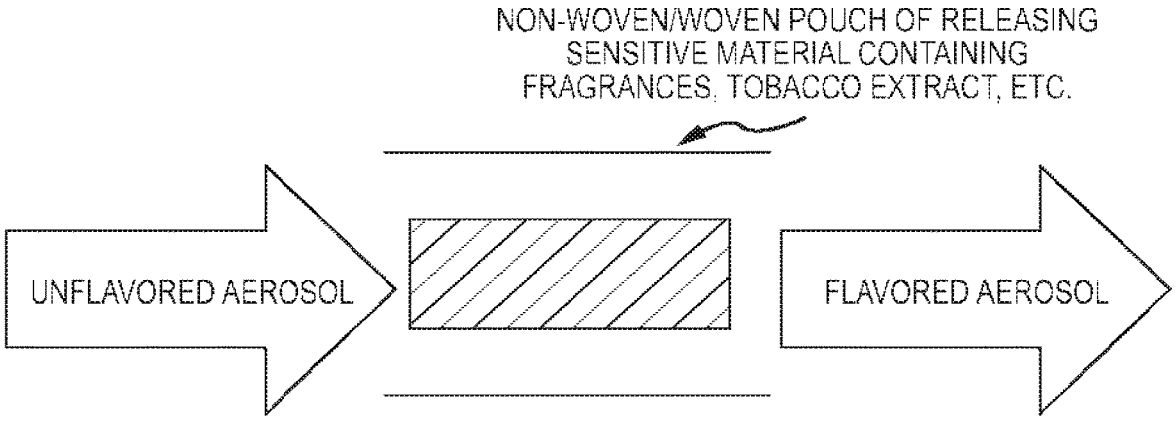

FIG. 16 illustrates an embodiment of the present invention comprising a pouch having a non-woven web of non-woven sensitive material normally having interstices capable of passing smoke upon activation. The web is compressed and bonded, while compressed, to hold the fibers in compressed condition filling the interstices to prevent passage of its load outwardly thereof. The payload can be fragrance(s), tobacco flavor, nicotine delivery enhancing chemical material(s)s, or other material(s) desired for modification of the unflavored aerosol. The pouch releases its load on puncturing. The web can react or dissolve with one or more chemical components in the unflavored aerosol to be activated. Therefore, the pouch formulation provides the benefit of improved shelf life by being protected from interaction with the environment and with each other prior to usage.

Fragrance Releasing Pouch

Figure 17:
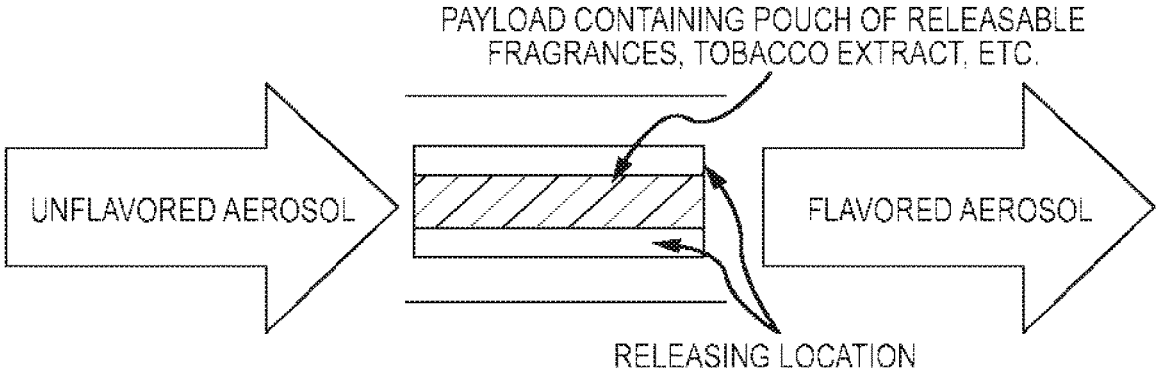
Figure 18:
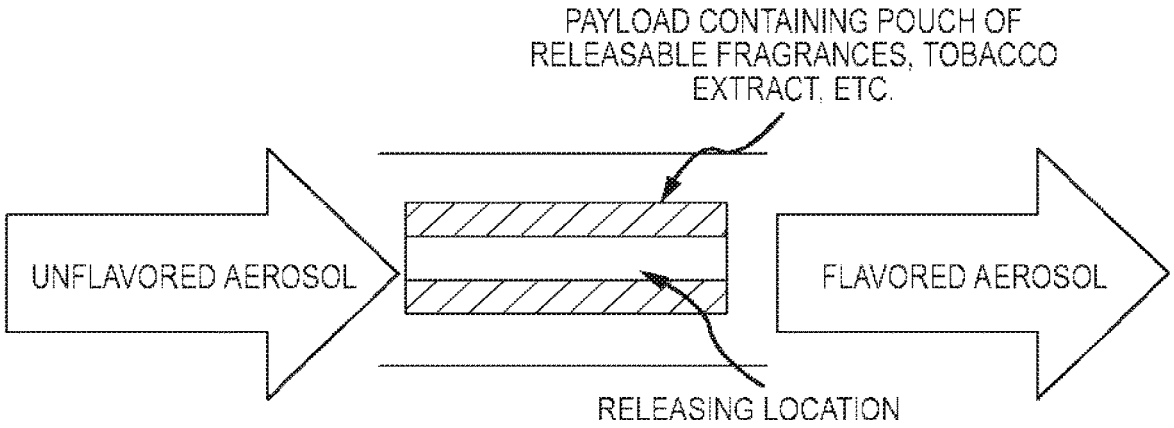

FIGS. 17 and 18 illustrate embodiments of the present invention comprising a pouch containing a payload. The load can be fragrance(s), tobacco flavor(s), nicotine(s), nicotine delivery enhancing chemical materials, or other material(s) desired for the modification of the aerosol organoleptic properties. This pouch releases its load on mechanical, thermal activation or similar mixing mechanism such as puncturing, crushing, opening a valve, etc. Because the pouch formulation is within a sealed container, the users have an ON/OFF option of using it to modify the aerosol organoleptic experience. This invention is inclusive of the use of multiple pouches or chambers placed in a carrousel arrangement in alignment with the aerosol stream such that users can select a particular flavor to be delivered during usage of the e-cigarette. In addition, the formulations benefit of improved shelf life by being protected from interaction with the environment and with each other prior to usage.

Figure 19:
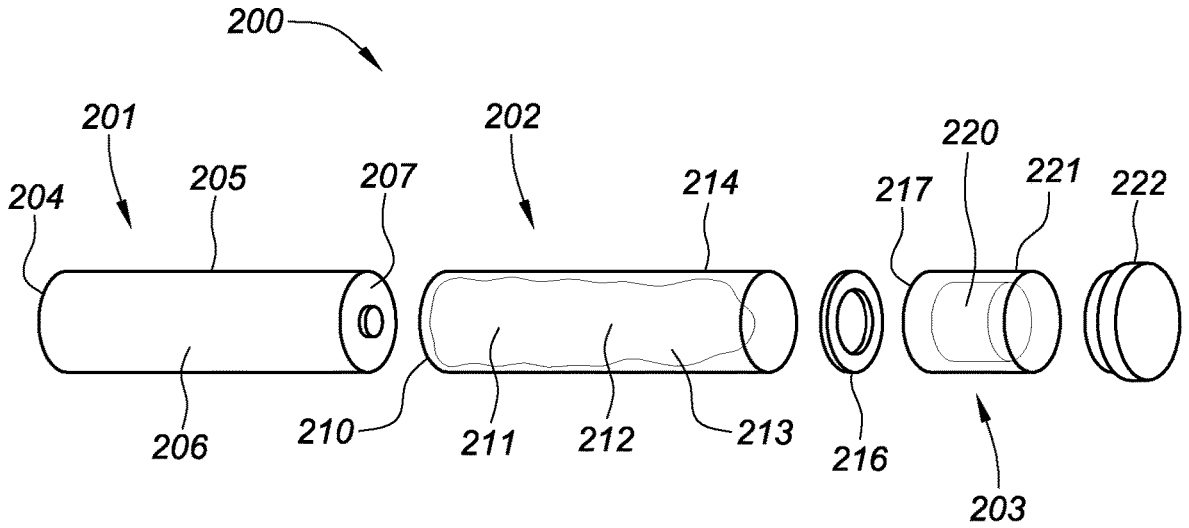
FIG. 19 is an exploded isometric view of an embodiment of an electronic cigarette.

FIG. 19 illustrates another embodiment according to the disclosure. FIG. 19 illustrates an electronic cigarette 200 comprising a battery section 201, an aerosol section 202, and a flavorant section 203. The electronic cigarette 200 can be configured to produce an aerosol on demand when air is drawn through the electronic cigarette 200. In other embodiments the electronic cigarette 200 can produce aerosol when a user performs an action. In yet other embodiments, no heater is required to form an aerosol. In the illustrated embodiment, a user can draw on a proximal end of the electronic cigarette, which can draw air through an interior portion of the electronic cigarette and out the proximal end. A more detailed description of an electronic cigarette can be found in commonly assigned U.S. application Ser. No. 13/099,266 filed 2 May 2011, the entire disclosure of which is hereby incorporated by reference as though fully set forth herein. The battery section 207 can comprise a cap 204, a first housing 205, a battery, and a battery section connector 207. The cap 204 can be configured to fit within a distal end of the first housing 205 and in at least one embodiment can comprise a plastic material that can be partially transparent. The first housing 205 can comprise a metal alloy, a plastic, or the like. The battery 206 can also be within and surrounded by the first housing 205. The battery section connector 207 can be coupled to the first housing 205 and can be configured to connect to the aerosol section 202.

The aerosol section 202 can comprise a second housing, a heater 211, an aerosol forming compound 213, an airflow path 212, an aerosol section distal connector 210, and an aerosol section proximal connector 215. The second housing 214 can comprise a metal alloy, a plastic, or the like. In one embodiment, the aerosol forming compound 213, the heater 211, and the airflow path 212 can be surrounded by and within an interior of the second housing 214. The aerosol section distal connector can be sized and configured to connect to the battery connector 207. In one embodiment one of the connectors can form a screw thread and the other connector can form a screw receptacle. In another embodiment one of the connectors can form a snap-fit connector and the other connector can form a snap-fit receptacle. In another embodiment one of the connectors can comprise at least one projection that is configured to fit within at least one matching space or receptacle in the other connector. In another embodiment the battery connector 207 and the aerosol section distal connector can form a friction fit.

The heater 211 can comprise a metal coil in liquid contact with the aerosol forming compound. In one embodiment the heater 211 can be mostly surrounded by the airflow path 212 and can be wound around a wick (not shown) that extends into the aerosol forming compound 213 and transports the aerosol forming compound 213 to the heater 211. In another embodiment, the heater 211 can comprise a metallic mesh that can extend from the airflow path 212 into the aerosol forming compound and that is sized and configured to transport the aerosol forming compound 213 across the heater 211. In yet another embodiment, the heater 211 can comprise a ceramic material. The ceramic material can extend from the airflow path 212 into the aerosol forming compound 213 and can be configured to transport the aerosol forming compound to the portion of the heater 211 within the airflow path 212. In one embodiment, the ceramic material can be porous. In one embodiment, the battery 206 in the battery section 201 can be electrically connected to the heater 211 in the aerosol section 202. The electrical connection between the battery 206 and the heater 211 can comprise at least one wire connecting the battery to the heater 211. In another embodiment, the electrical connection between the battery 206 and the heater 211 can comprise electrical traces disposed within or on the battery section 201 and the aerosol forming section 213. In yet another embodiment, the electrical connection between the battery 206 and the heater 211 can comprise a combination of electrical wires and electrical traces.

The airflow path 212 can be configured to draw air from outside the electronic cigarette 200 at a place distal to the heater 211 and to direct the air drawn into the electronic cigarette 200 across the heater and towards the flavorant section 203. In one embodiment, the airflow path 212 can comprise a tubular, non-porous, insoluble material that extends the length of the aerosol section 202. In an embodiment where the airflow path 212 is nonporous and insoluble, the airflow path 212 can be used keep the aerosol forming compound from the interior of the airflow path 212. The aerosol section proximal connector 215 can be configured to connect to the flavorant section 203.

The flavorant section can comprise a third housing 221, a flavorant 220, a flavorant section connector 217, and a mouth piece 222. The third housing 221 can surround the flavorant 220 and can be coupled to the flavorant section connector 217. The flavorant section connector 217 can be sized and configured to connect to the aerosol section proximal connector 215. In one embodiment one of the connectors can form a screw thread and the other connector can form a screw receptacle. In another embodiment one of the connectors can form a snap-fit connector and the other connector can form a snap-fit receptacle. In another embodiment one of the connectors can comprise at least one projection that is configured to fit within at least one matching space or receptacle in the other connector. In another embodiment the flavorant section connector 217 and the aerosol section proximal connector can form a friction fit.

The flavorant 220 can comprise materials as will be described later in this disclosure. The flavorant 220 can be configured to transfer a flavor or other substance to an aerosol that passes through the flavorant section 203. In one embodiment, the flavorant 220 can comprise a flavor and nicotine. In other embodiments the flavorant can only comprise a flavor. In yet another embodiment, the flavorant can comprise only nicotine. The mouth piece 222 can be configured to fit within a distal end of the first housing 205 and in at least one embodiment can comprise a plastic material In one embodiment, the aerosol section proximal connector can further be configured to receive a separator 216. The separator 216 can be sized and configured to fit within the aerosol section proximal connector 215 of the aerosol section 202 and can separate the aerosol forming compound 213 from a flavorant 220 of the flavorant section 203. In another embodiment, the separator 216 can be sized and configured to fit within the flavorant section connector 217 of the flavorant section 203 and can separate the aerosol forming compound 213 from a flavorant 220 of the flavorant section 203.

Figure 20:
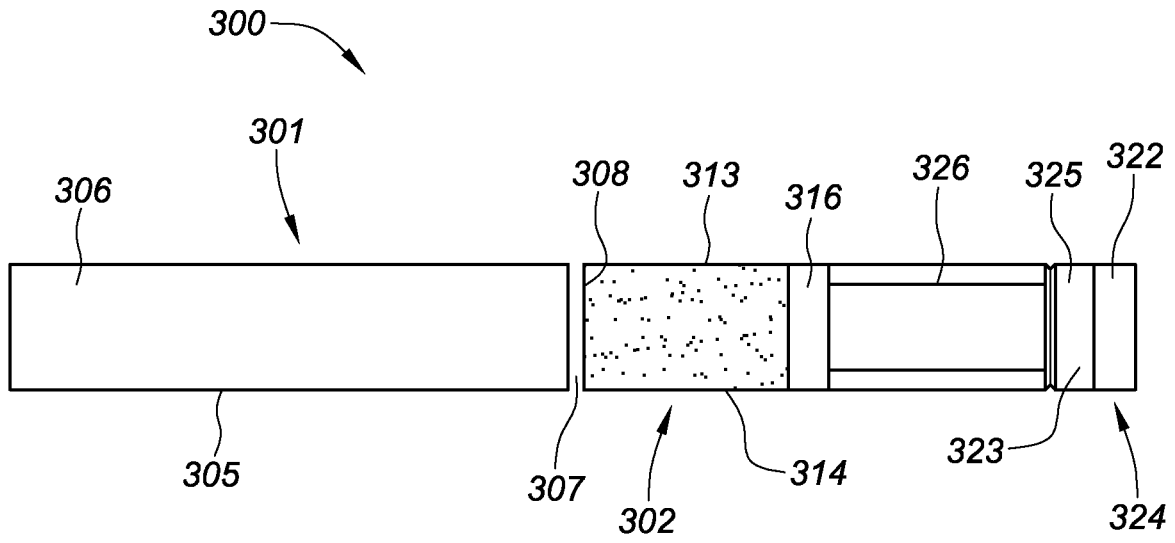
FIG. 20 is a diagrammatic view of an embodiment of an electronic cigarette according to the disclosure.

FIG. 20 illustrates another embodiment of the disclosure. FIG. 20 depicts an electronic cigarette 300 comprising a first section 301, a second section 302, and a mouth end 324. The first section 301 can comprise a first housing 305, a battery, and a first connector 307. The second section 302 can comprise a second housing 314, a second connector 308, an aerosol forming chamber 313, a first separator 316, and an insert 326. The aerosol forming chamber 313 can be within and surrounded by the second housing 314. The aerosol forming chamber 313 can be adjacent to the first separator 316. The first separator 316 can be configured to separate the aerosol forming chamber 313 from the rest of the second section 302. The second section 302 comprise a void or space in which an insert 326 can be placed. The insert 326 can comprise a flavor or other compound that can move into an aerosol or other vapor that passes through the insert 326. The mouth end 324 can comprise an end plug 325, a second separator 323, and a mouth piece 322. In one embodiment, the end plug can be a projection extending from a distal portion of the mouth end 324. The void or space in the second section 302 can also be sized and configured to receive a portion of the mouth end 324 to secure the mouth end 324 to the electronic cigarette 300. The end plug 325 can be sized and configured to fit within the second section 302 through a friction fit or other appropriate structure as known to one of ordinary skill in the art. The second separator 323 can be configured to separate the insert 326 from the mouth piece 322 and can also be configured to control the aerosol that is delivered to a user using the electronic cigarette 300.

In one embodiment, the electronic cigarette 300 of FIG. 20 can use a rechargeable battery that is configured to couple to a disposable second section. The second section can be purchased containing an unflavored aerosol forming compound and further comprising a void in which a desired insert can later be placed by the user. In some embodiments the unflavored aerosol can comprise a solution containing nicotine. The user can then place a desired removable insert into the second section, attached the mount piece to the second section and use the electronic cigarette. The removable insert can comprise at least one flavor, a desired level of nicotine, or both. If the user desires a different flavor or nicotine level they can remove the mouth piece from the electronic cigarette, remove the insert, and place a new insert within the second section. Once the user has depleted the aerosol forming substance in the second section, the second section can be thrown away or recycled, and a new second section can be attached to the rechargeable battery.

Figure 21:
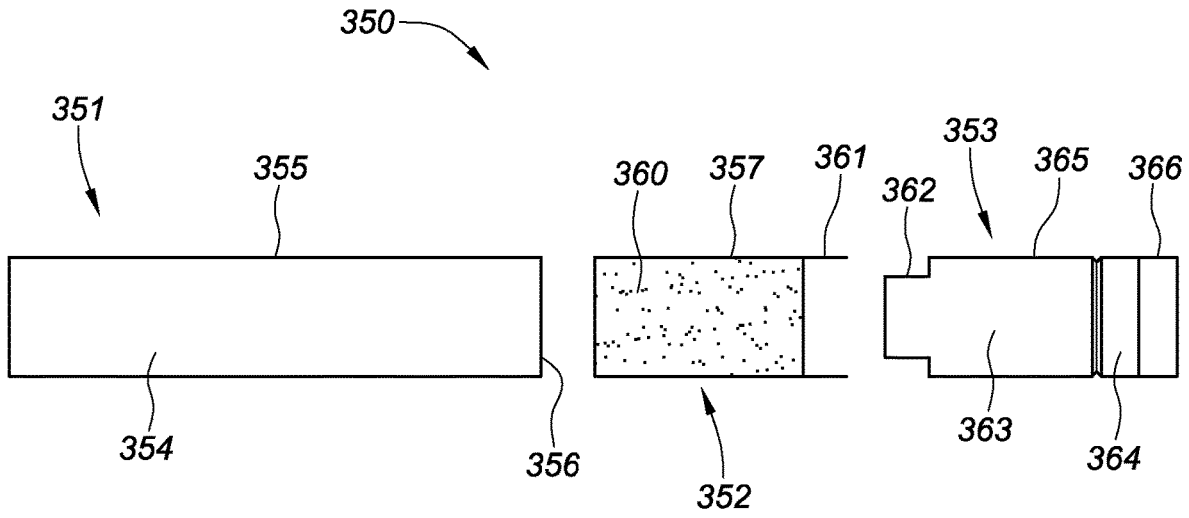
FIG. 21 is an exploded diagrammatic view of an embodiment of an electronic cigarette according to the disclosure.

FIG. 21 illustrates another example of an electronic cigarette 350 according to the disclosure. FIG. 21 depicts an electronic cigarette 350 comprising a battery section 351, an aerosol section 352, and an insert section 353. The battery section 351 can comprise a first housing 355, a battery, and a first connector 356. The aerosol section 352 can comprise a second housing 357, an aerosol forming chamber 360, and a separator and pod bay 361. The aerosol forming chamber 360 can be within and surrounded by the second housing 357. The separator and pod bay 361 can be sized and configured to couple to the insert section 353. The insert section can comprise a third housing 365, a connector 362, a flavorant 363, a second separator 364, and a mouth end 366. The flavorant 363 can comprise at least one flavor, a desired level of nicotine, or both. The second separator 364 can be configured to separate the flavorant 363 from the mouth end 366. The second separator can be further configured to control delivery of an aerosol to the mouth end 366 of the electronic cigarette 350. The connector 362 can be sized and configured to fit within the separator and pod bay 361 of the aerosol section 352. In other embodiments, the connector 362 can be sized and configured to surround the separator and pod bay of the aerosol section.

FIGS. 22A-22D depict various views of several embodiments of an insert section according to the disclosure. The embodiment of the insert section 400 depicted in FIGS. 22A and 22B can comprise a separator 401, a flavor reservoir 402, and a mouth end 403. The flavor reservoir 402 can comprise a flavorant or other substance that can be transferred to a passing aerosol. The flavor reservoir 402 can be configured to connect to or abut the mouth end 403. The mouth end 403 can comprise a through-hole that can allow for air to pass through the mouth end 403 and to a user. The separator 401 can be coupled to the flavor reservoir 402. In one embodiment the separator 401 can be configured to releasably couple to the flavor reservoir 402 and can further be configured to fit within a cavity or receptacle of an aerosol section or other receiver. In another embodiment, the separator 401, the flavor reservoir 402, and the mouth end 403 can be coupled together during manufacture such that they are unable to be used if taken apart by a user or other individual.

Figure 22A:
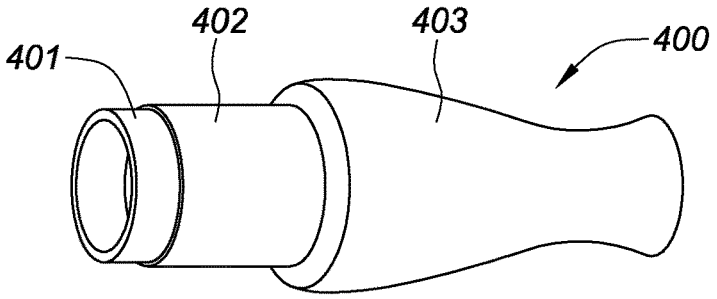
FIGS. 22A-22D are isometric and contour views of several embodiments of an insert section according to the disclosure.
Figure 22B:
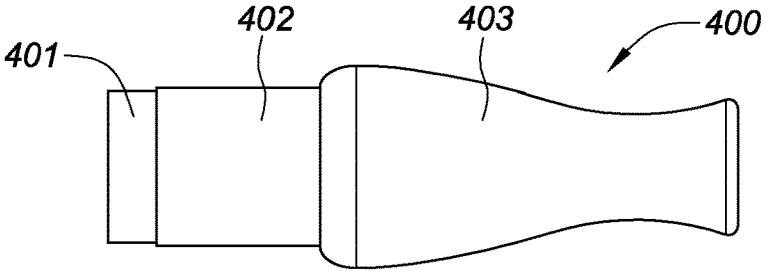
Figure 22C:
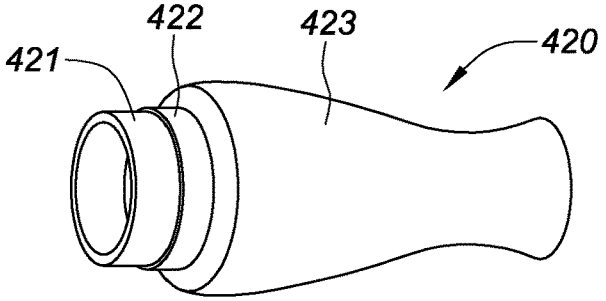
Figure 22D:
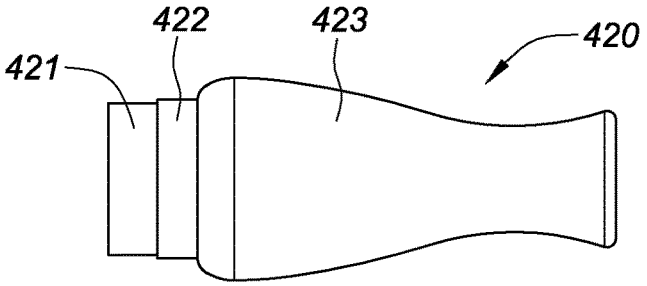

The embodiment of the insert section 420 depicted in FIGS. 22C and 22D can comprise a separator 421, a flavor reservoir 422, and a mouth end 423. The flavor reservoir 422 can comprise a flavorant or other substance that can be transferred to a passing aerosol. The flavor reservoir 422 can be configured to fit within a cavity of the mouth end 423. The mouth end 423 can comprise a through-hole that can allow for air to pass through the mouth end 423 and to a user. The separator 421 can be coupled to the flavor reservoir 422.

Figure 23A:
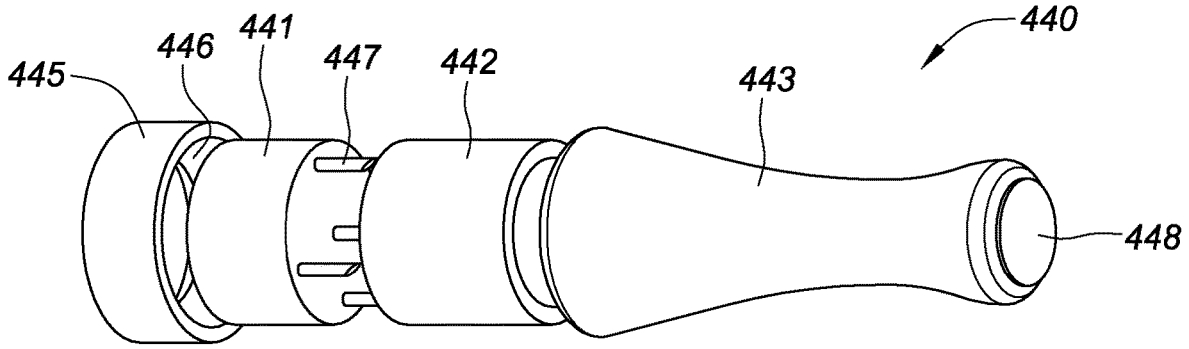
FIGS. 23A and 23B are isometric views of another embodiment of an insert section according to the disclosure.
Figure 23B:
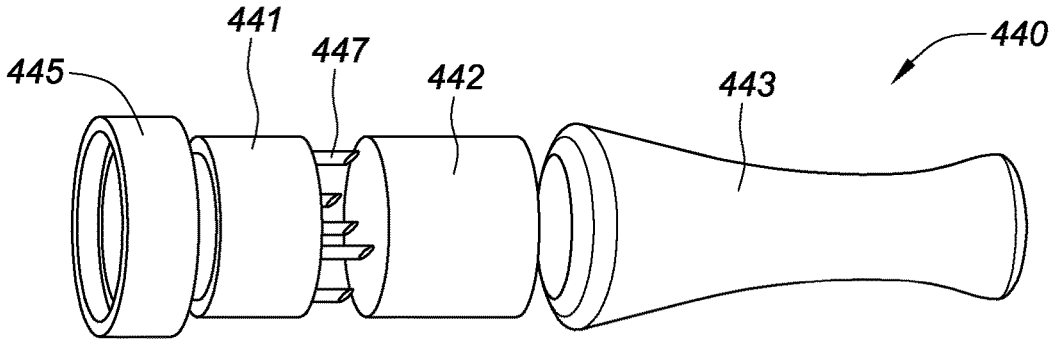
Figure 24A:
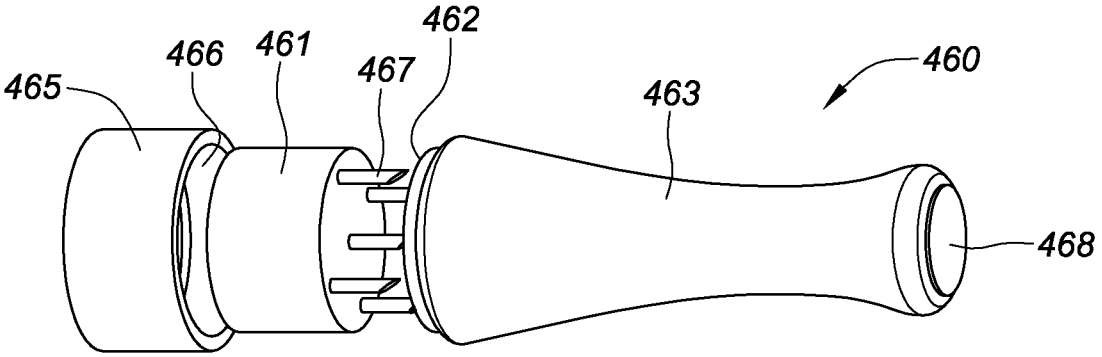
FIGS. 24A and 24B are isometric views of another embodiment of an insert section according to the disclosure.
Figure 24B:
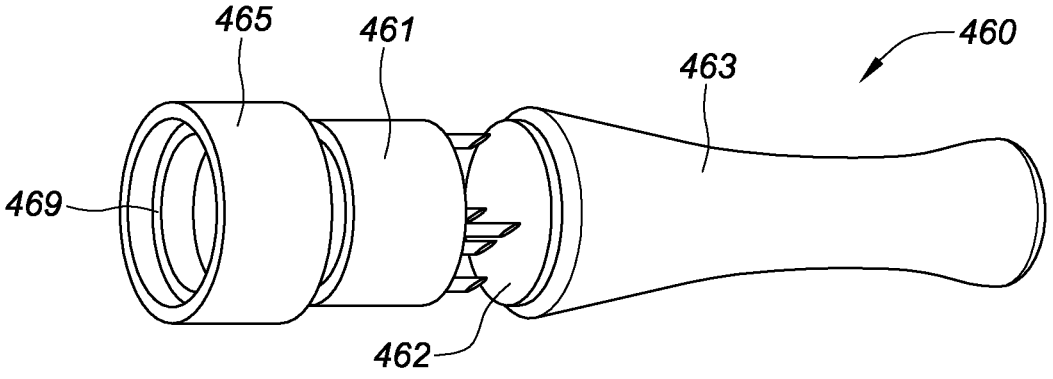

FIGS. 23A and 23B illustrates several isometric views of another embodiment of an insert section 440 according to the disclosure. The embodiment of the insert section 440 depicted in FIGS. 23A and 23B can comprise a pod bay 445, a separator 441, a flavor reservoir 442, a mouth end 443, and a through-hole 448. The pod bay 445 can further comprise a cavity 446. The cavity 446 can be sized and configured to securely receive the separator 441. The separator 441 can comprise at least one puncture device 447. The at least one puncture device 447 can be a hollow pointed tube. The at least one puncture device 447 can be made of varying materials depending on the desired application. In one embodiment, the at least one puncture device 447 can be made of metal. In another embodiment, the at least one puncture device 447 can be made of a plastic. The at least one puncture device 447 can also be made of other materials in other embodiments. In one embodiment, the at least one puncture device can be configured to puncture a seal on the flavor reservoir 442 or the puncture device can be configured in 443 to puncture 442. The at least one puncture device 447 can then direct an aerosol to desired portions or areas of the flavor reservoir 442. The flavor reservoir 442 can comprise a flavorant or other substance that can be transferred to a passing aerosol. In one embodiment, the flavor reservoir 442 can be configured to fit within an interior cavity of the mouth end 443. In another embodiment, the flavor reservoir 442 can be figured to abut the mouth end 443 and a separate housing or surround can be used to enclose the flavor reservoir 442. The flavor reservoir 442 can be coupled to the mouth piece 443 by a friction fit, a projection, or other methods known by one of ordinary skill in the art as well as constructed as puncturing cover FIGS. 24A and 24B show several isometric views of another embodiment of an insert section 460 according to the disclosure. The embodiment of the insert section 460 depicted in FIGS. 24A and 24B can comprise a pod bay 465, a separator 461, a flavor reservoir 462, a mouth end 463, and a through-hole 468. The pod bay 465 can further comprise a first cavity 466 and a second cavity 469. The first cavity can be sized and configured to join with an aerosol section or other section of an electronic cigarette. The second cavity 469 can be sized and configured to securely receive the separator 461. The separator 461 can comprise at least one puncture device 467. In one embodiment, the at least one puncture device can be configured to puncture a seal on the flavor reservoir 462. The at least one puncture device 467 can then direct an aerosol to desired portions or areas of the flavor reservoir 462. The flavor reservoir 462 can comprise a flavorant or other substance that can be transferred to a passing aerosol. In the illustrated embodiment, the flavor reservoir 462 can be contained within the mouth end 463. In one embodiment, the flavor reservoir 462 can be integral with the mouth end 463.

Figure 25A:
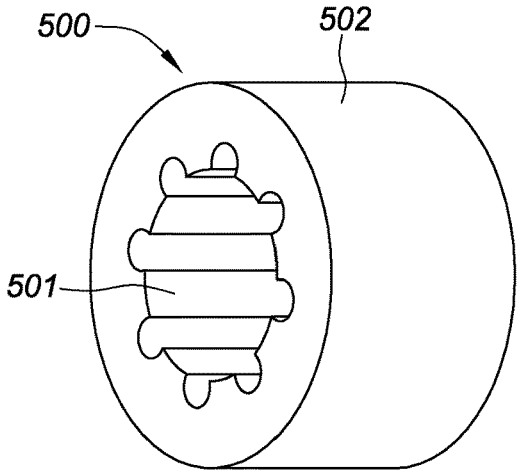
FIGS. 25A-25F are front and back isometric views of three embodiments of a separator.
Figure 25B:
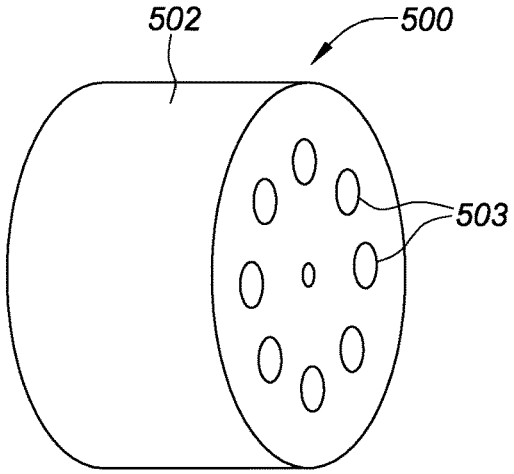

FIGS. 25A-25F show several different embodiments of a separator according to the disclosure. FIG. 25A shows a back view and FIG. 25B shows a front view of one embodiment of a separator 500. The separator 500 can comprise an aerosol entry 501, at least one aerosol exit 503, and an outer wall 502. An aerosol can enter the separator 500 through the aerosol entry 501 and can then be split into a plurality of streams through the at least one aerosol exit 503. The streams of aerosol leaving the separator 500 can be determined by the number, diameter, and location of the at least one aerosol exit 503. After passing through the at least one aerosol exit 503, the aerosol stream can intermingle with a flavor or other material contained in the flavor reservoir as described throughout this disclosure. The outer wall 502 of the separator 500 can be sized and configured to fit within a housing of an electronic cigarette. The outer wall 502 can be sized such that the separator 500 is secured within the electronic cigarette and can also comprise shapes to better distribute aerosol as it leaves the separator 500.

Figure 25C:
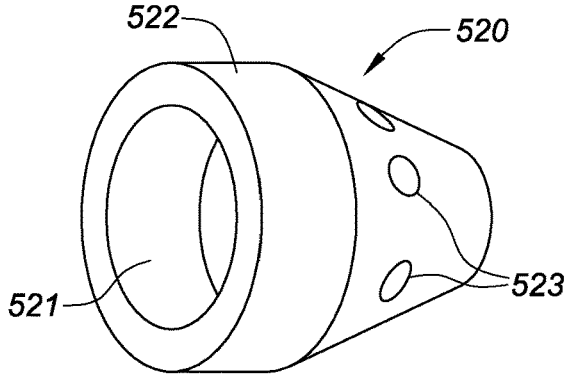
Figure 25D:
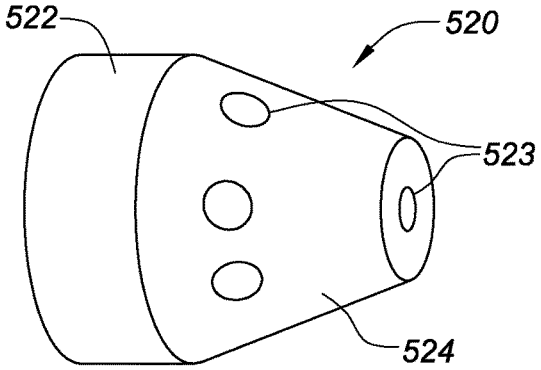

FIG. 25C shows a back view and FIG. 25D shows a front view of another embodiment of a separator 520. The separator 520 can comprise an aerosol entry 521, at least one aerosol exit 523, and an outer wall 522. An aerosol can enter the separator 520 through the aerosol entry 521 and can then be split into a plurality of streams through the at least one aerosol exit 523. The outer wall 522 of the separator 520 can be sized and configured to fit within a housing of an electronic cigarette. In the current embodiment, the outer wall 522 can further comprise a conical section 524 that can be shaped to deliver aerosol to different longitudinal portions of a flavor reservoir.

Figure 25E:
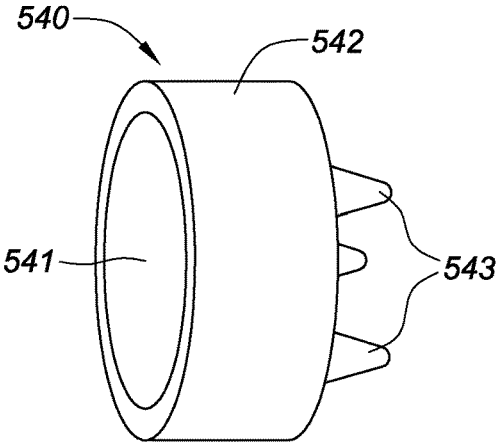
Figure 25F:
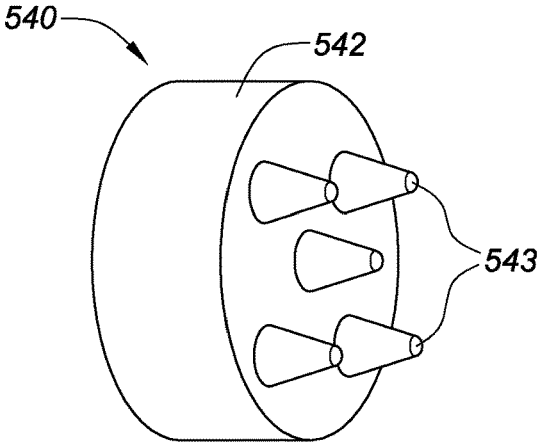

FIG. 25E shows a back view and FIG. 25F shows a front view of another embodiment of a separator 540. The separator 540 can comprise an aerosol entry 541, at least one aerosol exit 543, and an outer wall 542. An aerosol can enter the separator 540 through the aerosol entry 541 and can then be split into a plurality of streams through the at least one aerosol exit 543. In the illustrated embodiment, the at least one aerosol exit 543 can comprise a plurality of hollow projections configured to extend into the flavor reservoir. In at least one embodiment, the at least one aerosol exit can be configured to puncture a seal on the flavor reservoir. The outer wall 542 of the separator 540 can be sized and configured to fit within a housing of an electronic cigarette.

Figure 26A:
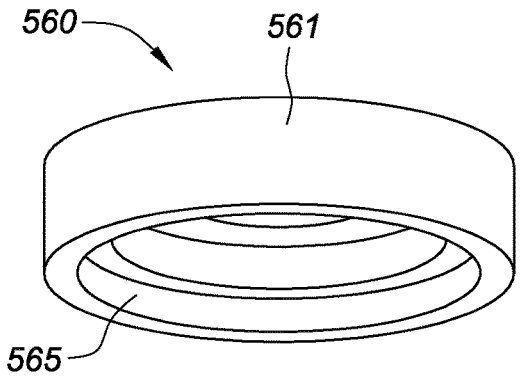
FIGS. 26A-26D are front and back isometric views of a pod bay and a pod bay with a separator according to the disclosure.
Figure 26B:
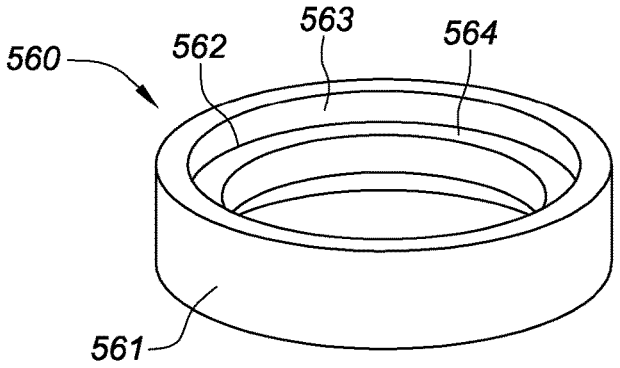
Figure 26C:
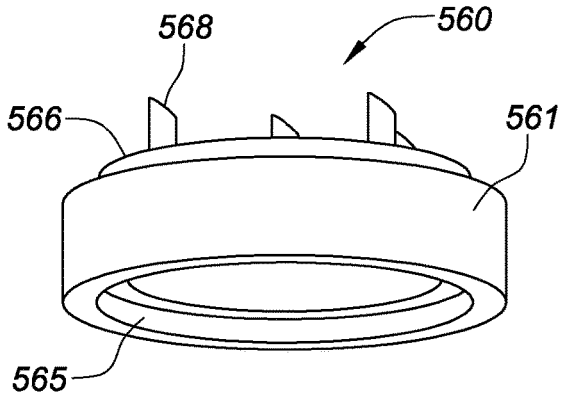
Figure 26D:
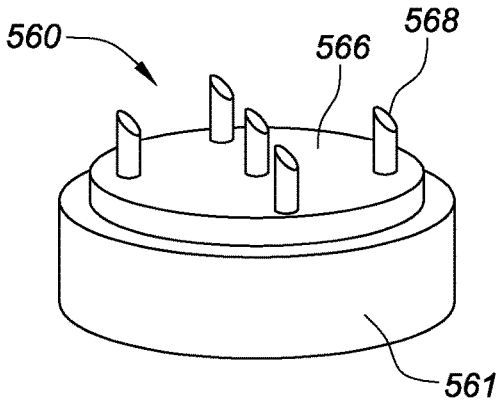

FIGS. 26A-26D illustrate a front and back view of a pod bay 560. FIG. 26A shows a back view of a pod bay 560 and FIG. 26B shows a front view of a pod bay 560. The pod bay 560 comprises a first cavity 562, a second cavity 565, and a pod wall 561. The first cavity 562 can comprise a cavity wall 563 and a cavity lip 564. The cavity wall 563 and the cavity lip 564 can be configured to securely hold a separator or other device within the electronic cigarette. In one embodiment, the cavity wall 563 and the cavity lip 564 can be sized such that a separator is coupled to the pod bay 560 through a friction fit. In another embodiment, the cavity wall 563 and the cavity lip 564 can more loosely hold the separator. The second cavity 565 can be sized and configured to couple the back side of the pod bay 560 to another portion or section of an electronic cigarette. The pod wall 561 can be shaped to fit within a housing or other enclosure of the electronic cigarette. FIG. 26C shows a back view and FIG. 26D shows a front view of a pod bay 560 with a separator 566. The pod bay 560 comprises a pod wall 561 and a second cavity 565. The separator 566 is abutting the cavity lip 564 shown in FIG. 26B. The separator 566 can comprise at least one puncture device 568. The at least one puncture device 568 can comprise a hollow tube.

Figure 27A:
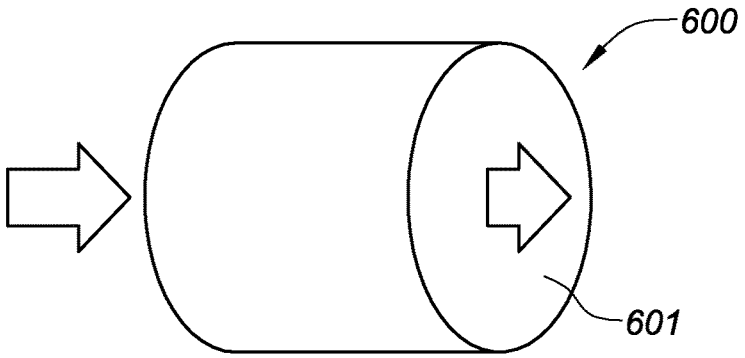
FIGS. 27A-27C are isometric views of three embodiments of a flavor reservoir.
Figure 27B:
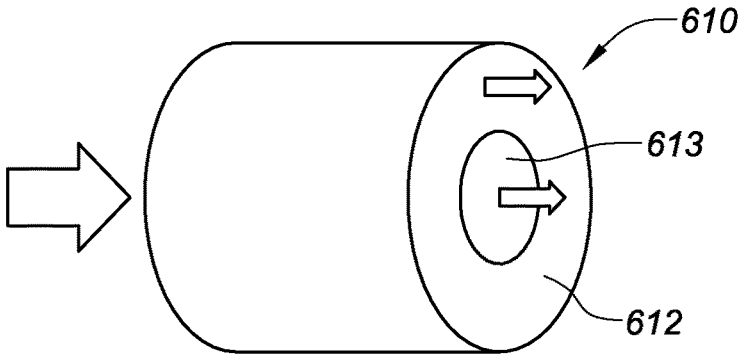
Figure 27C:
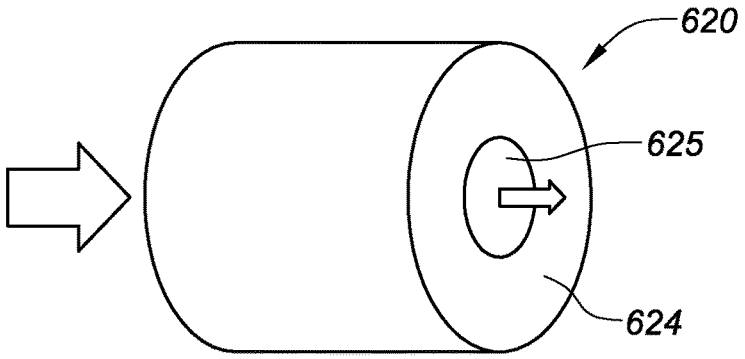

FIGS. 27A-27C depict three embodiments of a flavor reservoir 600 according to the disclosure. FIG. 27A depicts a flavor reservoir 600 comprising a homogeneous density matrix. An aerosol that enters the flavor reservoir 600 can comingle with the flavor or other substance located within the flavor reservoir 600. FIG. 27B depicts a flavor reservoir 610 comprising a low density matrix 613 and a high density matrix 612. The low density matrix 613 can comprise the center of the flavor reservoir 610 as shown in FIG. 27B. As the low density matrix 613 can hold more liquid, the higher concentration of flavor or other substance can migrate towards the outer layers. FIG. 27C depicts a flavor reservoir 620 comprising a low density matrix 624 and a high density matrix 625. The high density matrix 625 can comprise the center of the flavor reservoir 620 as shown in FIG. 27C. As the low density matrix 624 can hold more liquid, the higher concentration of flavor or other substance can migrate towards the inner layer or layers.

Figure 28A:
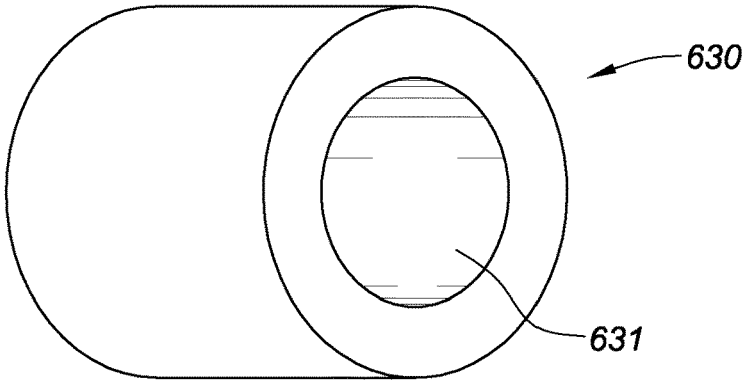
FIGS. 28A-28C are isometric views of embodiments of a flavor reservoir containing varying numbers of chambers.
Figure 28B:
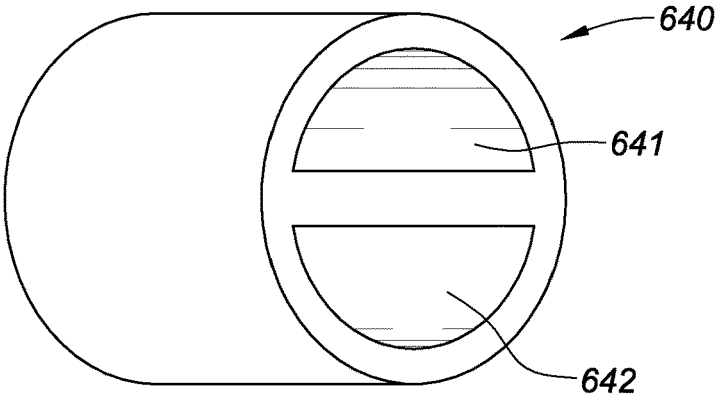
Figure 28C:
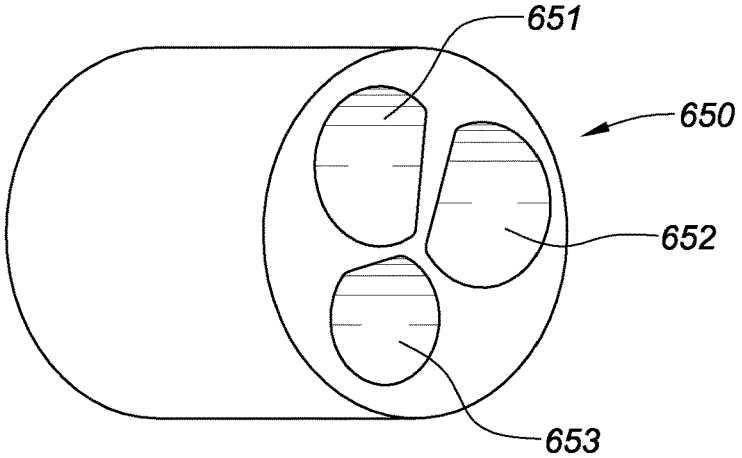

FIGS. 28A-28C depict embodiments of a flavor reservoir 630 with varying numbers of chambers. FIG. 28A illustrates a flavor reservoir 630 with a first chamber 631. The first chamber 631 can comprise a cylindrical space within the flavor reservoir 630. In other embodiments the first chamber 631 can comprise other shapes and sizes within the flavor reservoir. The first chamber 631 can further comprise an adsorbent matrix. FIG. 28B illustrates an embodiment of a flavor reservoir 640 with a first chamber 641 and a second chamber 642. In one embodiment, the first chamber 641 can comprise a first flavor or other substance, and the second chamber 642 can comprise a second flavor or other substance. In one embodiment, the first chamber 641 and the second chamber 642 can be the same size and shape. In a separate embodiment, the first chamber 641 can be a different size than the second chamber 642. The first chamber 641 and second chamber 642 can further comprise an adsorbent matrix FIG. 28C illustrates another embodiment of a flavor reservoir 650 with a first chamber 651, a second chamber 652, and a third chamber 653. In one embodiment, the first chamber 651 can comprise a first flavor or other substance, the second chamber 652 can comprise a second flavor or other substance, and the third chamber 653 can comprise a third flavor or other substance. In one embodiment, the first, second, and third chambers 651, 652, 653 can be the same size. In another embodiment, the first, second, and third chambers 651, 652, 653 can vary in size and shape.

Figure 29:
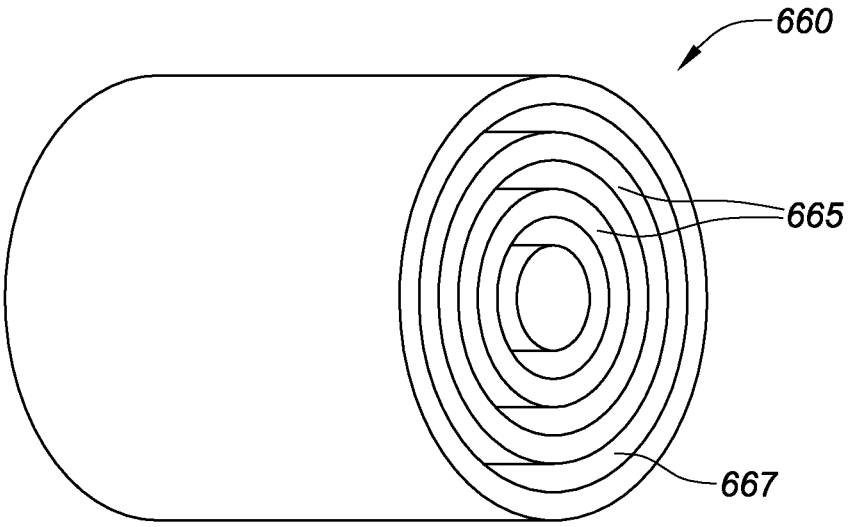
FIG. 29 is an isometric view of a flavor reservoir according to the disclosure.

FIG. 29 shows an embodiment of a flavor reservoir 660 according to an aspect of the disclosure. The flavor reservoir 660 comprises at least one recess 667 and at least one thermal fin 665. The at least one thermal fin 665 can be designed with temperature control functionality. The thermal fin 665 can allow for tailoring the taste profile and delivery rate of the flavorant or other substance under different product configurations. The at least one thermal fin 665 can comprise a metallized foil, fins, etc. as part of the flavor reservoir 660. The at least one thermal fin 665 can also comprise other thermally conductive materials. The at least one thermal fin 665 can allow for a passive temperature control of the flavor reservoir 660. In another embodiment, the flavor reservoir 660 can comprise an electrically active heater. The heater can cause a warming effect to control a temperature of the flavor reservoir 660.

Figure 30A:
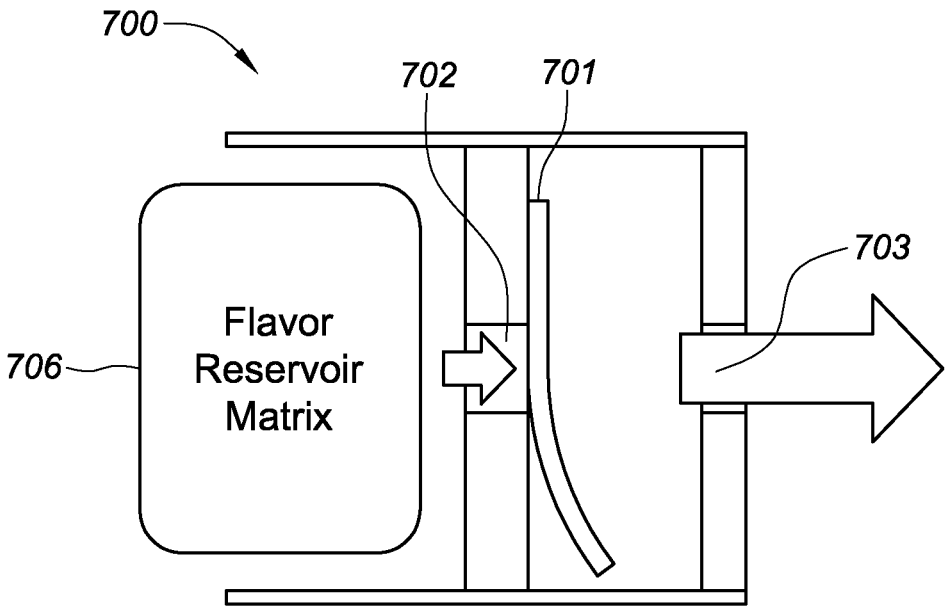
FIGS. 30A and 30B are diagrammatic views of an embodiment of a mouth end that comprises a flexible cover.
Figure 30B:
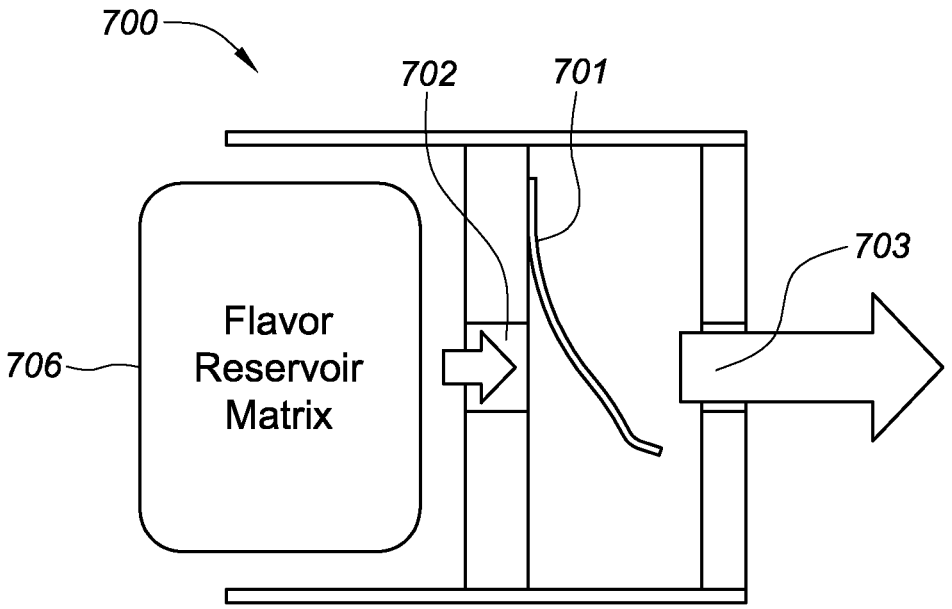

FIGS. 30A and 30B illustrate an embodiment of a mouth end 700 according to an aspect of the disclosure. The mouth end 700 can comprise an exit passage 702, a flexible cover 701, and a through-hole 703. The mouth end 700 can further be configured to abut a flavor reservoir 706. The flexible reservoir 706 can comprise an impermeable flexible membrane downstream from the flavor reservoir 706. The flexible cover 701 can cover the exit passage 702 and can be secured in one section such that a negative pressure or draw on an exterior portion of the mouth end 700 adjacent the through-hole 703 can cause an aerosol to move from the flavor reservoir 706, through the exit passage 702, and out the through-hole 703. The flexible cover 701 can be stiff enough such that it can cover or mostly cover the exit passage 702 while the negative pressure is not present, but flexible enough to allow a passage for an aerosol or air stream to move through the mouth end 700 when a negative pressure is created. In one embodiment, the negative pressure can be created by a user drawing on the end of the mouth end 700. The flexible cover 701 can be used to maintain freshness of the flavor reservoir 706 and quality of an aerosol delivered to an exterior portion of the mouth end 700. In another embodiment, the mouth end 700 can comprise a pressure activated valve. The pressure activated valve can comprise a moving ball at the exit of the flavor reservoir. The pressure activated valve can open during inhalation by a user and close when the mouth end 700 is not in use. The pressure activated valve can also be used to protect the freshness or flavor of the flavor reservoir 706.

Figure 31A:
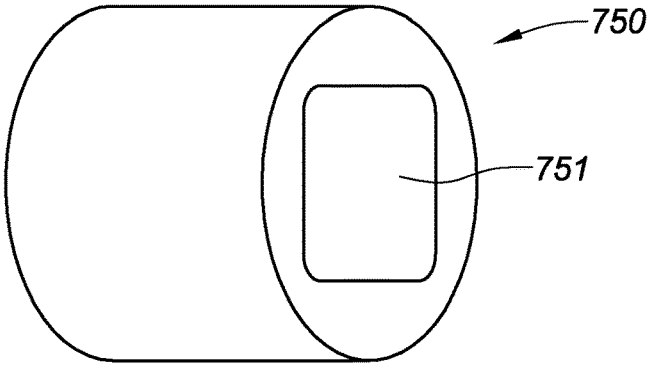
FIGS. 31A-31C are front and back isometric views of several embodiments of sealed flavor reservoirs.
Figure 31B:
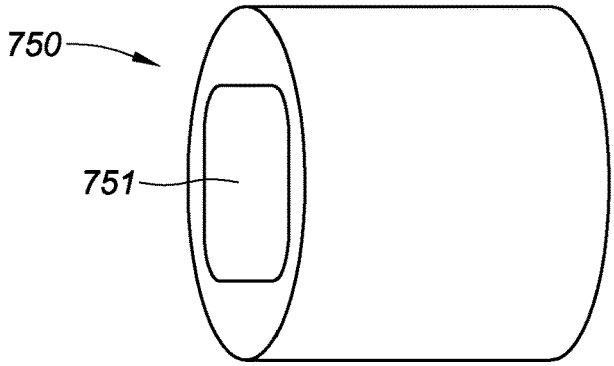
Figure 31C:
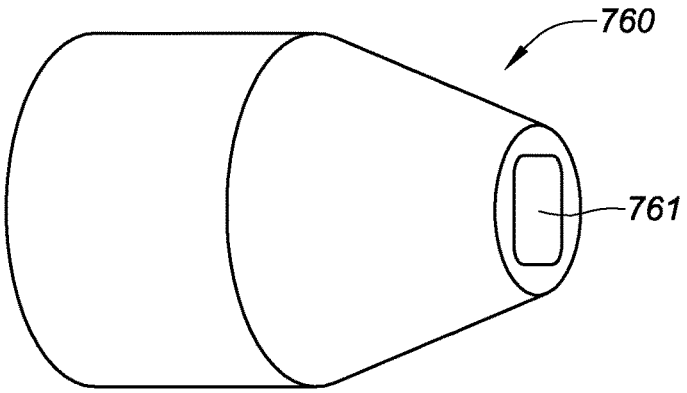
Figure 32A:
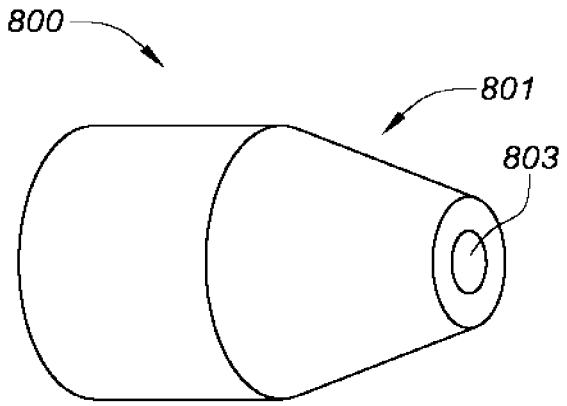
FIGS. 32A-32D are isometric views of embodiments of mouth ends according to an aspect of the disclosure.
Figure 32B:
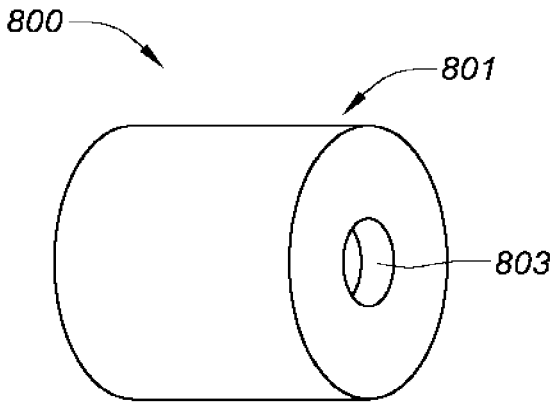
Figure 32C:
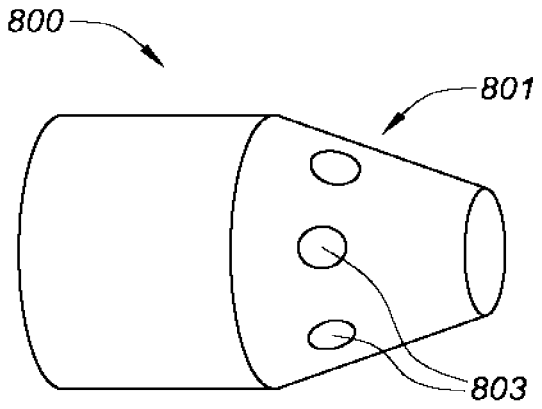
Figure 32D:
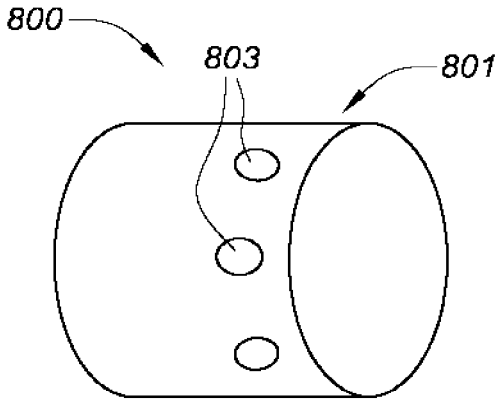

FIGS. 31A-31C depict several embodiments of a flavor reservoir with an impermeable seal. FIG. 31A depicts a front view and FIG. 31B depicts a back view of an embodiment of a flavor reservoir 750. The flavor reservoir 750 can comprise a first seal 751 and a second seal 752. The first and second seals 751, 752 can comprise aluminum foil, paper, plastic, etc. The first and second seal 751, 752 can be configured to limit the exposure of the internal portion of the flavor reservoir 750 to outside air or other substances. In one embodiment, the first and second seals 751, 752 can be removed by a user pulling on the seal. In another embodiment, one of the seals can be punctured before use. FIG. 31C depicts a front view of another embodiment of a flavor reservoir 760. The seal 761 can cover all of the passages on a section of the flavor reservoir 760 or only a portion of the passages present on a section of the flavor reservoir 760.

FIGS. 32A-32D depict embodiments of an exit portion 801 and at least one aerosol exits 803 of various mouth ends 800. The exit portion 801 of the mouth end 800 can be shaped in various ways. The exit portion 801 can be shaped for consumer taste or other reasons. The at least one aerosol exit 803 present in the mouth end 800 can comprise various configurations. The configurations can be used to deliver an aerosol to a user in a stream, a cloud, or other method. The various configurations can be used to tailor a vaping experience to a user.

Figure 33:
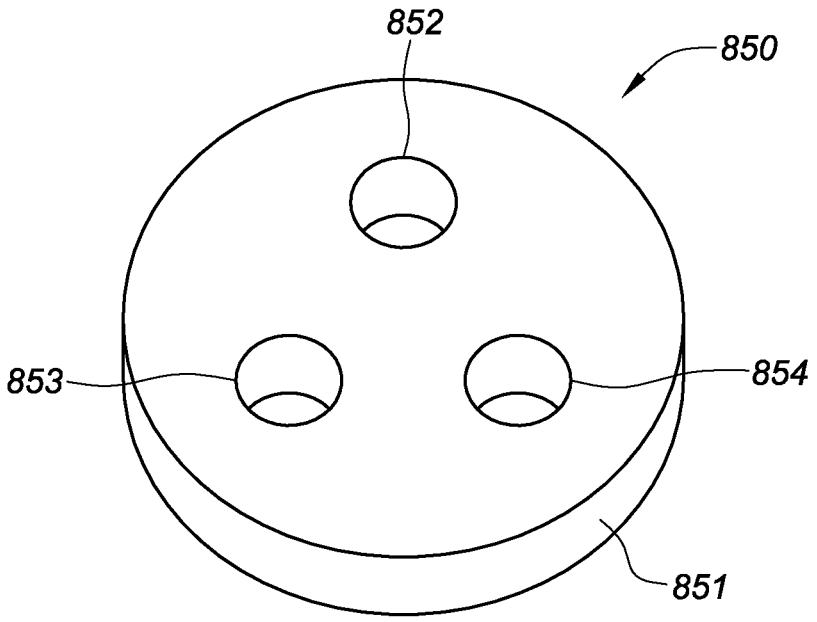
FIG. 33 is an isometric view of a separator comprising selectable exit ports.

FIG. 33 shows an embodiment of a separator according to the disclosure. The separator 850 can comprise an outer wall 851, a first exit port 852, a second exit port 853, and a third exit port 854. The exit ports can be configured to allow a user to select a particular flavor chamber to control aerosol delivery. In one embodiment, a user can use the outer wall 851 of the separator 850 to move twist the separator 850 and select a desired flavor in a flavor reservoir. In other embodiments, a user can twist the separator to line up one or more exit ports with a compartment in a flavor reservoir containing a specific level of nicotine or other substance.

Figure 34:
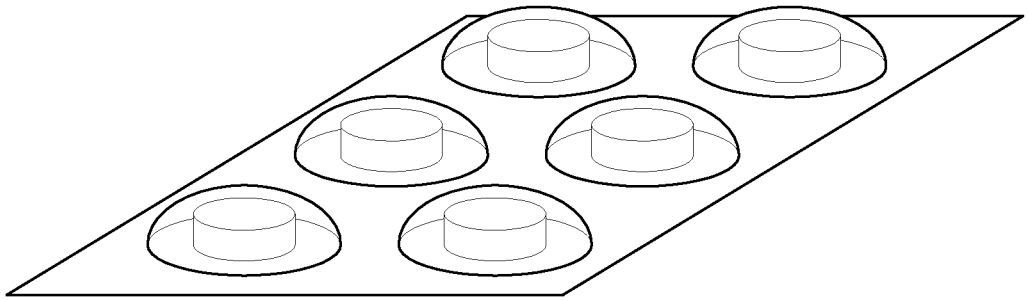
FIG. 34 is a sketch for a pressure releasable blister package containing flavor inserts.

Furthermore, the flavor containing inserts of this disclosure can be packaged as pressure releasable blisters, peelable ribbons or similar package strategies known in the packaging industry. One example of a package is shown in FIG. 34 for a pressure releasable blister package of a plurality of flavor containers.

An apparent improvement in nicotine delivery efficiency compared to a typical electronic cigarette not equipped with the invention described herein is shown in as Table IV. The data indicates a relationship between the physical nature of the absorbent material used in Chamber B and the concentration of nicotine in Chamber B containing the functionalized formulation. It is understood, but not limited to, that the physical nature of the absorbent martial, the nature of the formulation, including singular or a plurality of components, the interaction of the aerosol from Chamber A, design and arrangement of Chamber B, and combinations thereof, improve the effective release of organoleptic and/or function components from Chamber B. The samples cited in Table IV illustrate, but are not limited to, differing materials suitable for use in Chamber B. An improvement of, but not limited to, 3.5-4.1 fold increase in nicotine delivery is observed compared to a commercially available electronic cigarette not equipped with the invention described herein. Furthermore, the invention facilitates reduced nicotine content to achieve parity in performance to a commercially available electronic cigarette.

of functional ingredients thus allowing flexible formulation design and improvement in efficiency. It is understood that other embodiments based on the invention herein can take advantage of the improved delivery efficiency, such as higher or equal nicotine delivery at lower nicotine content compared to currently commercially available electronic cigarettes, variations of the physical arrangement of chamber B including plurality of chambers to achieve desirable organoleptic delivery and ease of manufacturing.

Figure 36A:
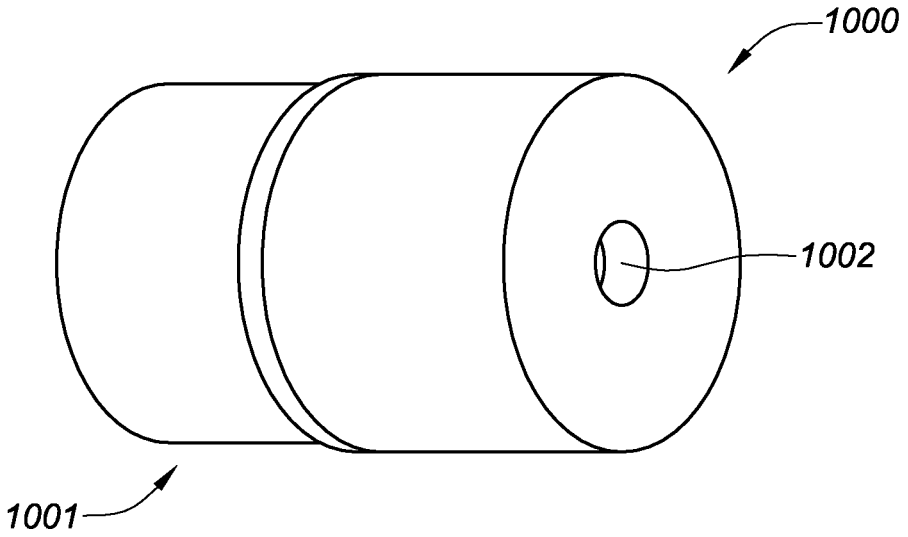
FIGS. 36A and 36B are isometric side views of several embodiments of the mouth end of an e-cigarette.
Figure 36B:
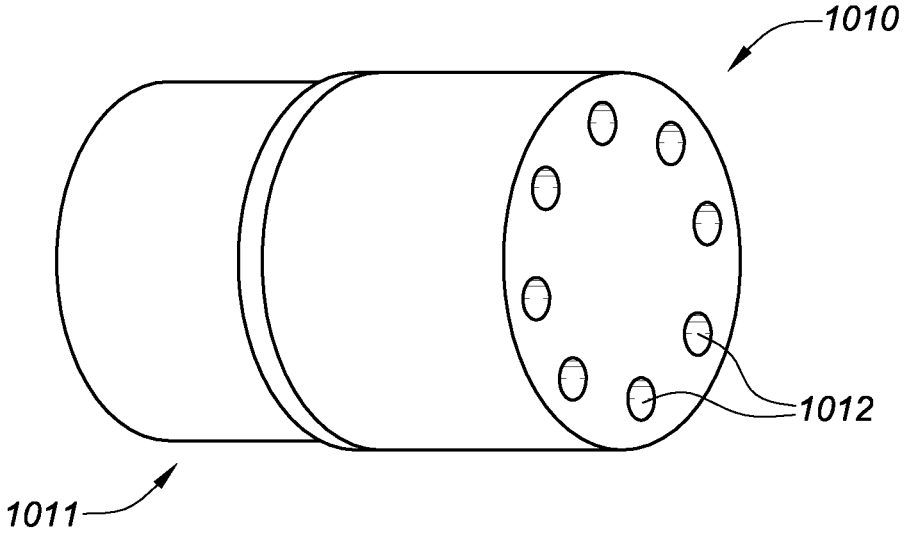

FIGS. 36A and 36B depict several embodiments of mouth ends according to the disclosure. FIG. 36A depicts a mouth end 1001 with a center through-hole 1002 through a proximal end 1000 of the mouth end 1001. FIG. 36B depicts a mouth end 1011 with a plurality of through-holes 1012 spread around the perimeter of a proximal end 1010 of the mouth end 1010.

Figure 37A:
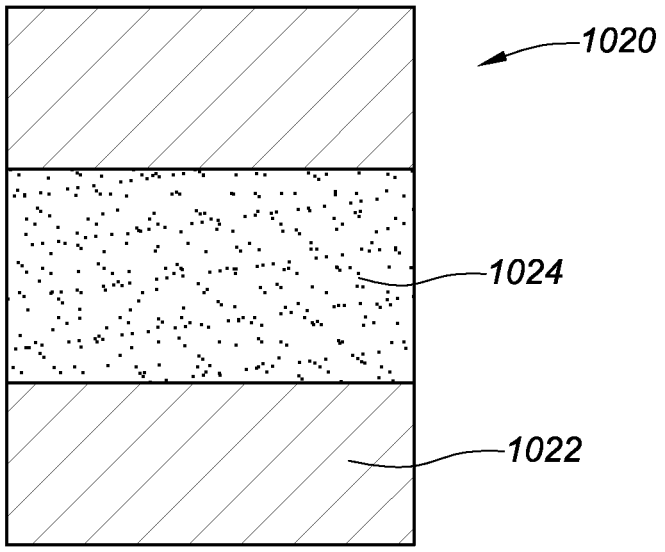
FIGS. 37A and 37B are cross-sectional views of another embodiment of the mouth end of an e-cigarette.
Figure 37B:
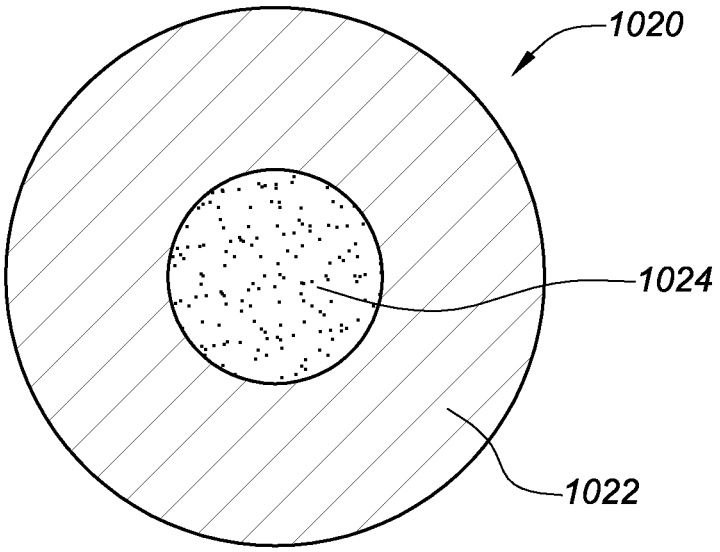

FIGS. 37A and 37B illustrates another example of a second chamber 1020. Second chamber 1020 comprises a coaxial design with a core portion 1024 and a shell portion 1022 surrounding the core portion 1024. The coaxial design can lead to a unique taste experience due to multimodal particle size and composition distribution among the aerosol. It can also allow a user to change the taste profile based on the placement of the flavoring i.e. the taste when the flavor is in the core portion 1024 compared to the taste when the flavor is in the shell portion 1022.

Figure 38:
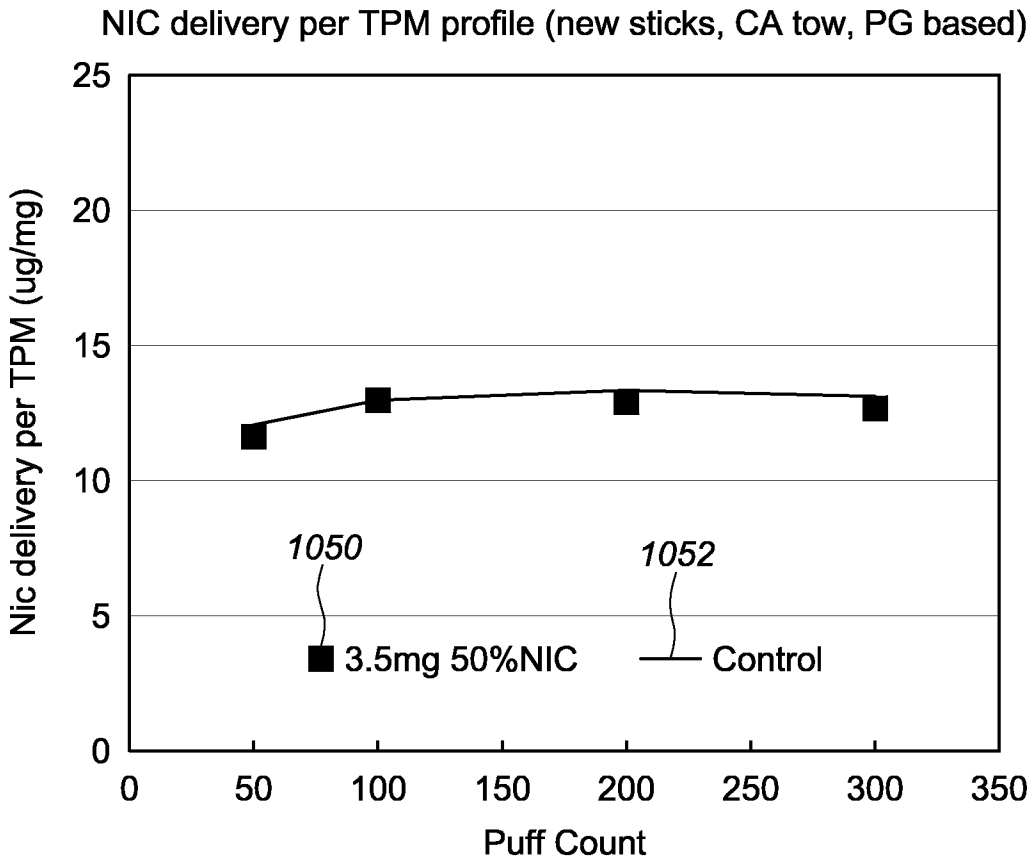
FIG. 38 is a graph showing the nicotine delivery per TPM for an e-cigarette according to the disclosure when compared to a traditional e-cigarette.

FIG. 38 is a graph that illustrates the nicotine delivery in a sequential design by comparing the nicotine delivery of an e-cigarette according to the disclosure 1050 with the nicotine delivery of a control e-cigarette 1052 containing 24 mg of nicotine. The sequential e-cigarette can deliver the same Nic/Tpm with a smaller nicotine load present in the e-cigarette.

Figure 39:
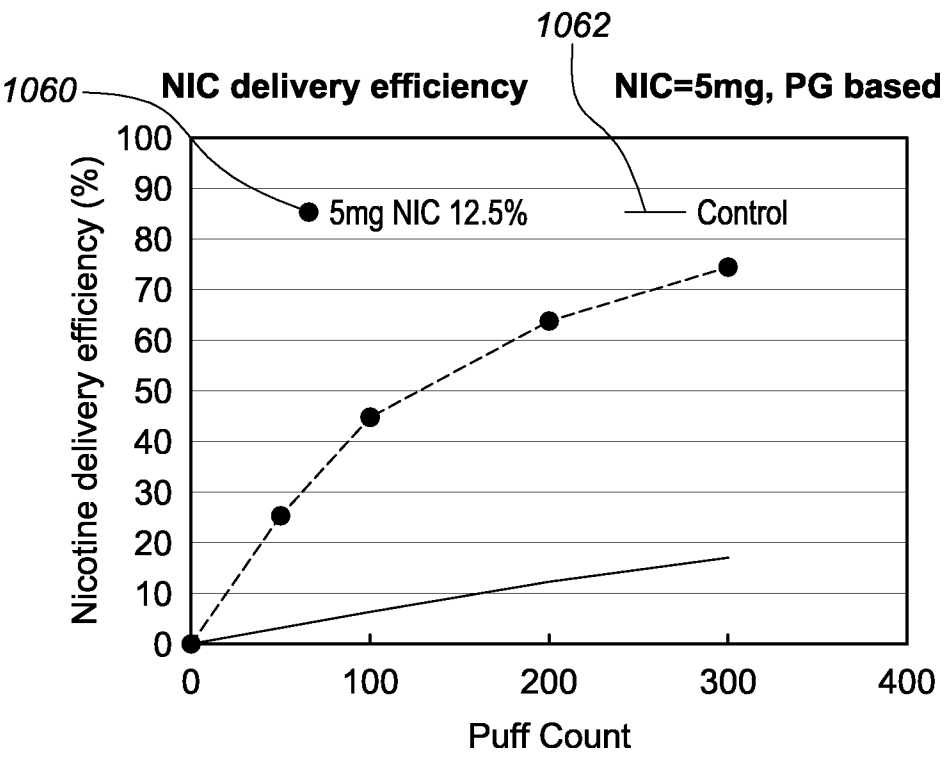
FIG. 39 is a graph showing the nicotine delivery efficiency of an e-cigarette according to the disclosure when compared to a traditional e-cigarette.

FIG. 39 is a graph that illustrates the delivery efficiency of a prototype e-cigarette 1060 according to the disclosure when compared to a control e-cigarette 1062. The prototype e-cigarette 1060 can deliver up to 75% of the nicotine within 300 puffs, while the control e-cigarette delivers under 20%.

Figure 40:
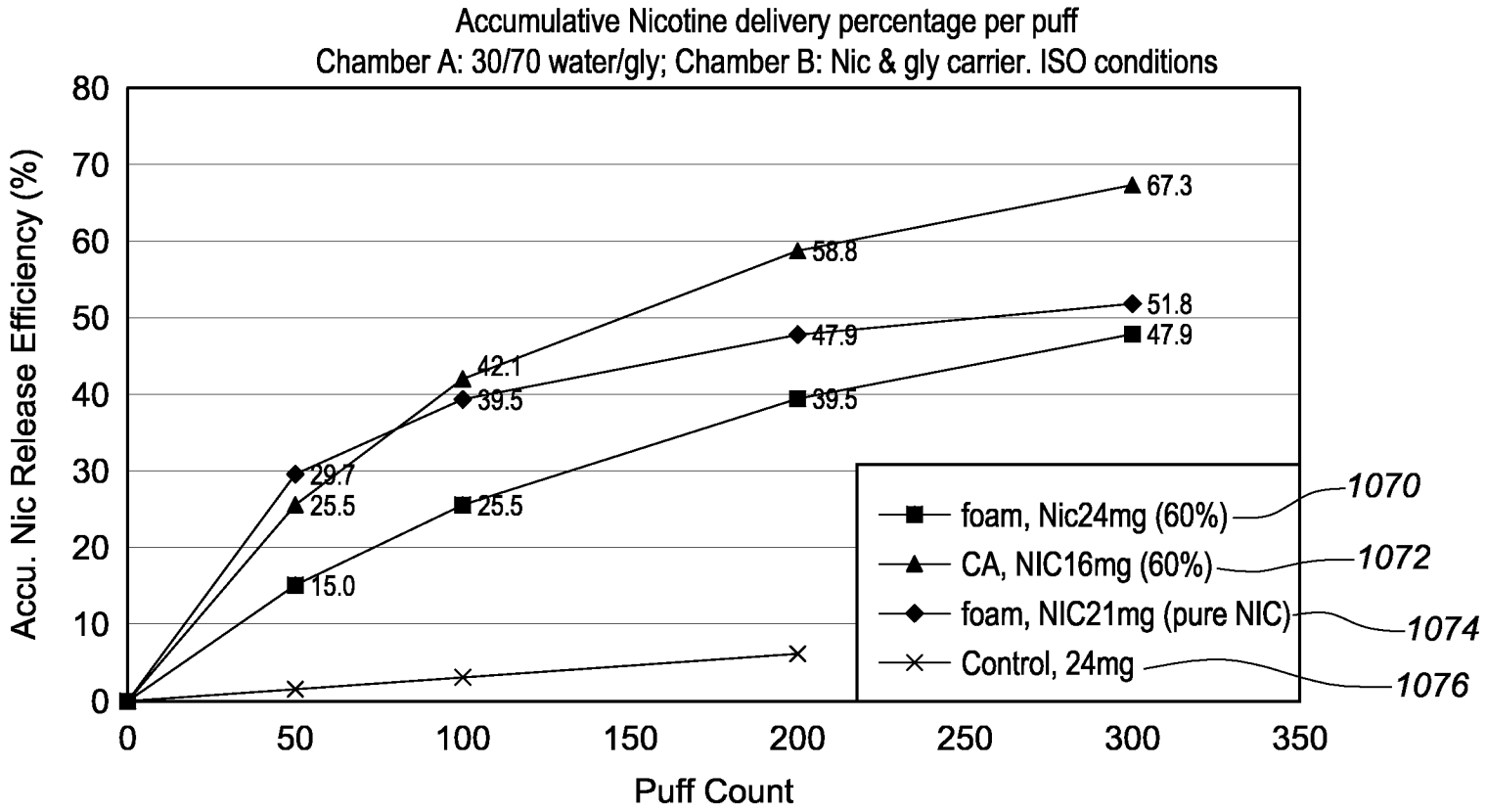
FIG. 40 is a graph showing the nicotine delivery percentage of several embodiments of e-cigarettes according to the disclosure when compared to a traditional e-cigarette.

FIG. 40 is a graph that illustrates the influence of the media used to hold a nicotine solution and the strength of that nicotine solution to the accumulative nicotine delivery efficiency. The graph illustrates the accumulative nicotine delivery percentage per puff. The first line 1070 comprises a foam insert with a 24 mg, 60% nicotine solution. The second line 1072 comprises a cellulose acetate insert with a 16 mg, 60% nicotine solution. The third line 1074 comprises a foam insert with a 21 mg nicotine solution. The fourth line 1076 comprises a control line using a 24 mg solution in a previously available e-cigarette.

TABLE IV

| | Formulation in Chamber A (% wt) | | | Formulation in chamber B (% wt) | | | | | |
|---|---|---|---|---|---|---|---|---|---|
| Samples | Glycerin, USP mg | D.I. water mg | Ethyl alcohol, USP mg | Nicotine, USP mg | Tobacco flavor Concentrate mg | Glycerin, USP mg | Total loading (mg) | Nic release per TPM (First 50 puff) (ug/mg) | Nicotine release (1-200 puff) (mg) |
| Foam 1 | 750 | 100 | 150 | 11.7 | 4.2 | 25.5 | 43 | 47.6 | 5.85 |
| CA tow 1 | 75 | 10 | 15 | 18.1 | 6.5 | 39.3 | 66 | 45.0 | 6.70 |
| Control | N/A | N/A | N/A | 24 | N/A | N/A | N/A | 16.2 | 1.65 |

Figure 35:
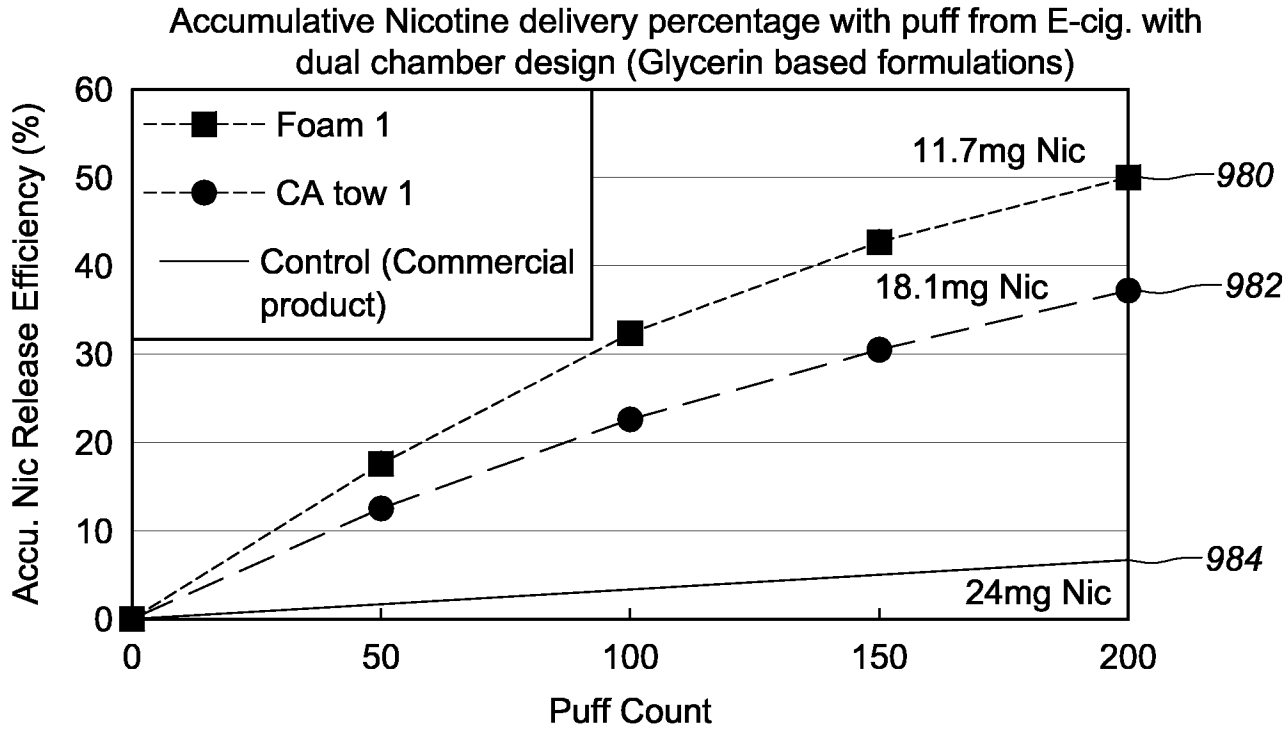
FIG. 35 is a graph showing the accumulative nicotine delivery percentage for a variety of e-cigarettes.
Figure 41:
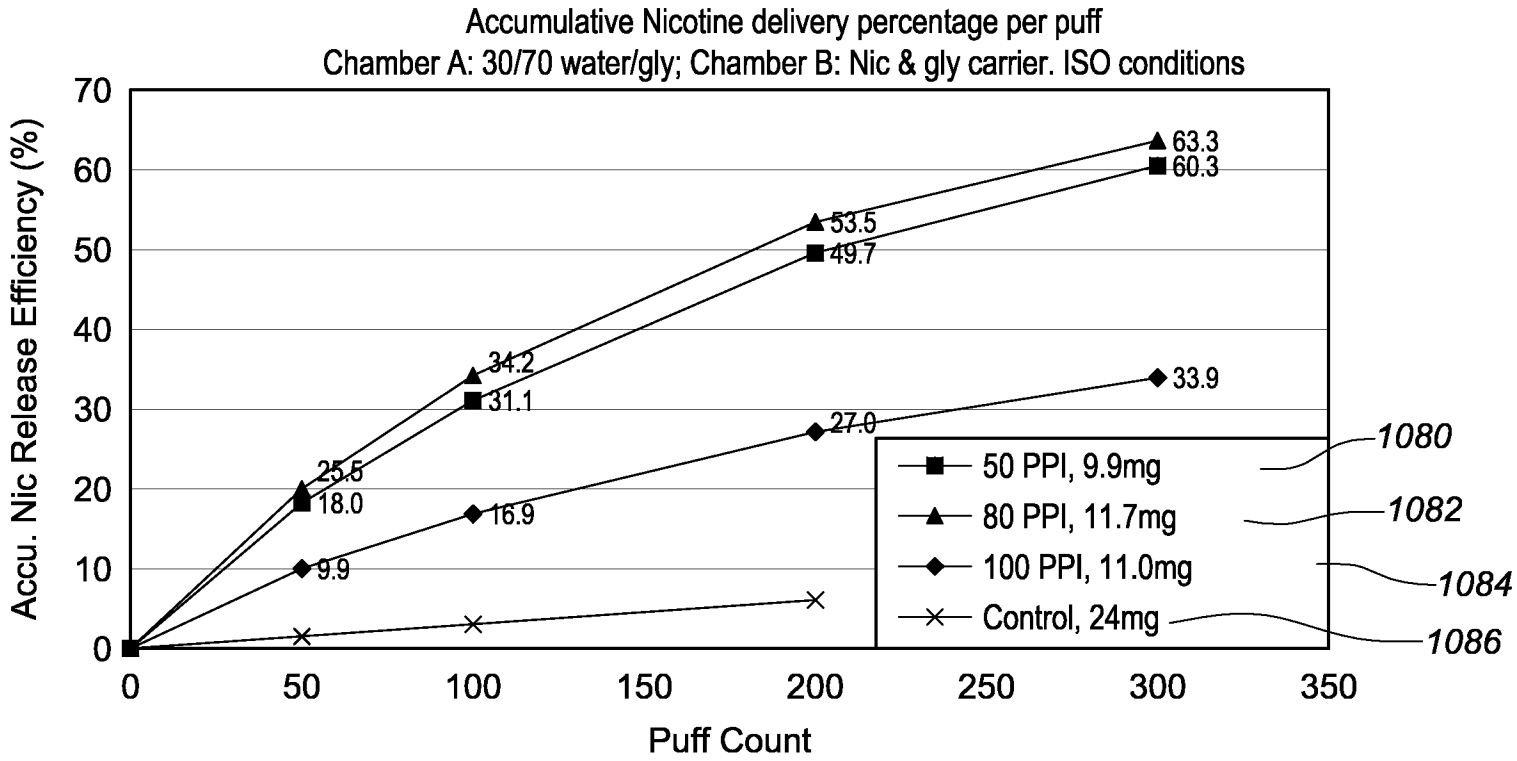
FIG. 41 is a graph showing the nicotine delivery percentage of several embodiments of e-cigarettes with varying pores per inch according to the disclosure when compared to a traditional e-cigarette.

FIG. 35 illustrates the comparative nicotine delivery from embodiments described above in Table IV with a commercially available electronic cigarette on a per puff basis. The graph illustrates the release efficiency from a puff count of zero to two hundred. The graph includes an accumulative nicotine delivery percentage for three different formulations including a control embodiment 984, a cellulose acetate embodiment 982, and a foam embodiment 980. The graph demonstrates the utility of the invention to improve delivery As illustrated in FIG. 41, a higher degree of consistency of nicotine delivery can be accomplished with materials with a high pore density. The first line 1080 comprises 50 pore per inch with 9.9 mg of nicotine. The second line 1082 comprises 80 pores per inch with 11.7 mg of nicotine. The third line 1084 comprises 100 pores per inch with 11.0 mg of nicotine. The fourth line 1086 comprises a control with 24 mg of nicotine in a previously available e-cigarette.

Figure 42:
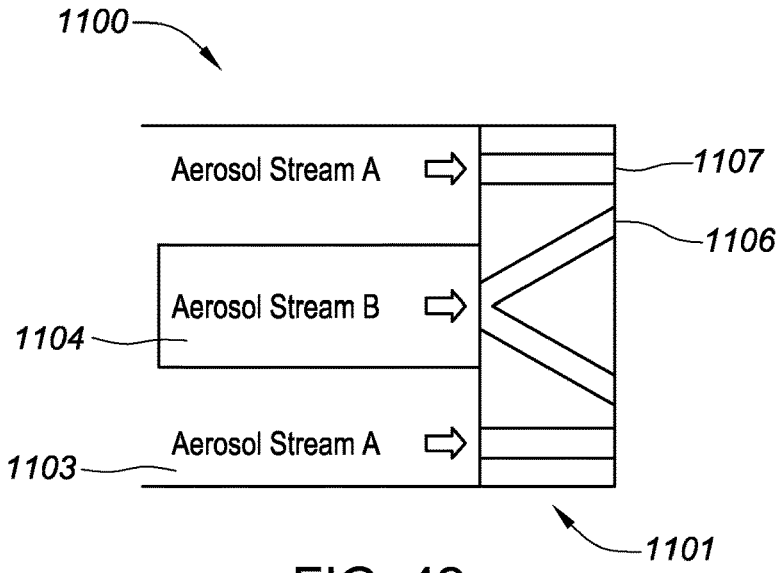
FIG. 42 is a cross-sectional view of an embodiment of an e-cigarette with two aerosol streams and a mouth end with a plurality of outlets.
Figure 43A:
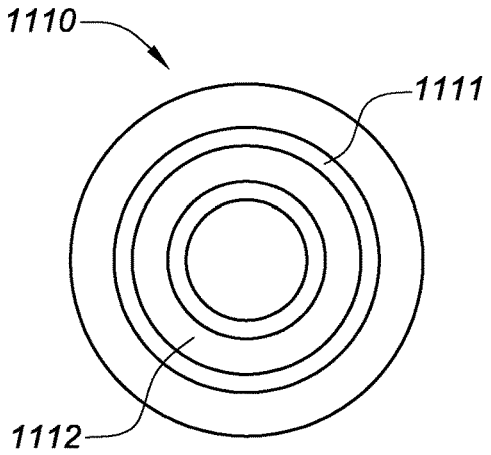
FIGS. 43A-43E are various designs of mouth ends according to the disclosure.
Figure 43B:
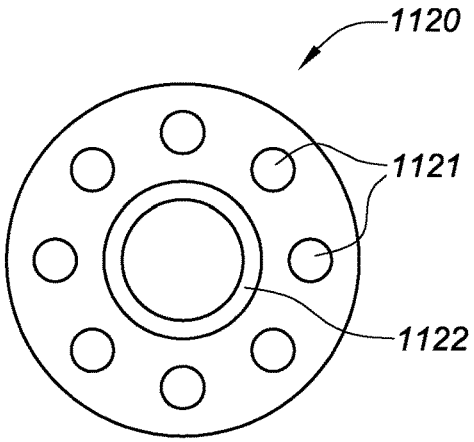
Figure 43C:
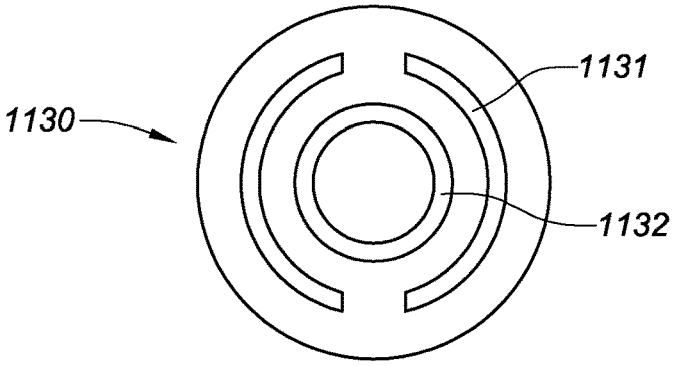
Figure 43D:
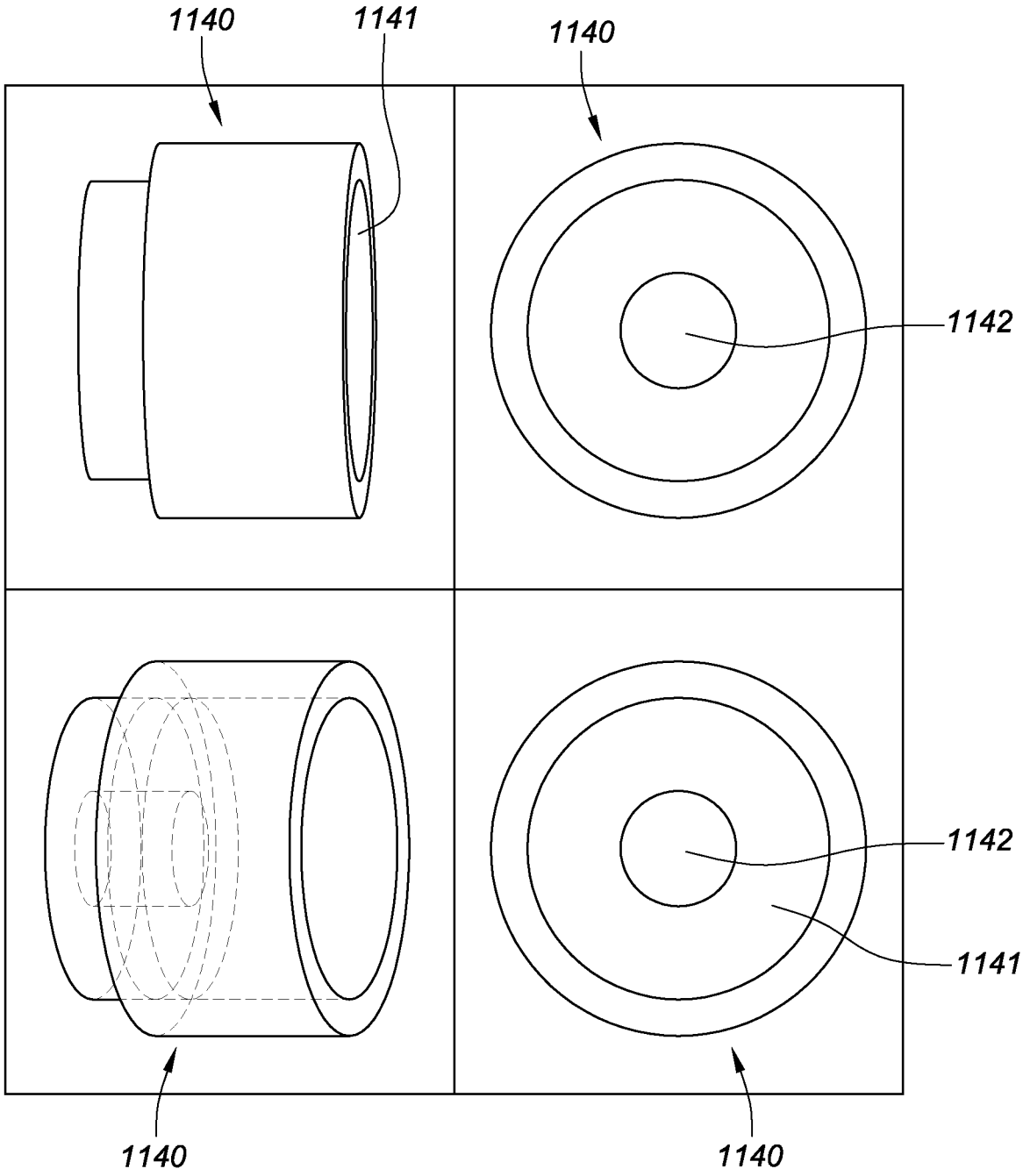
Figure 43E:
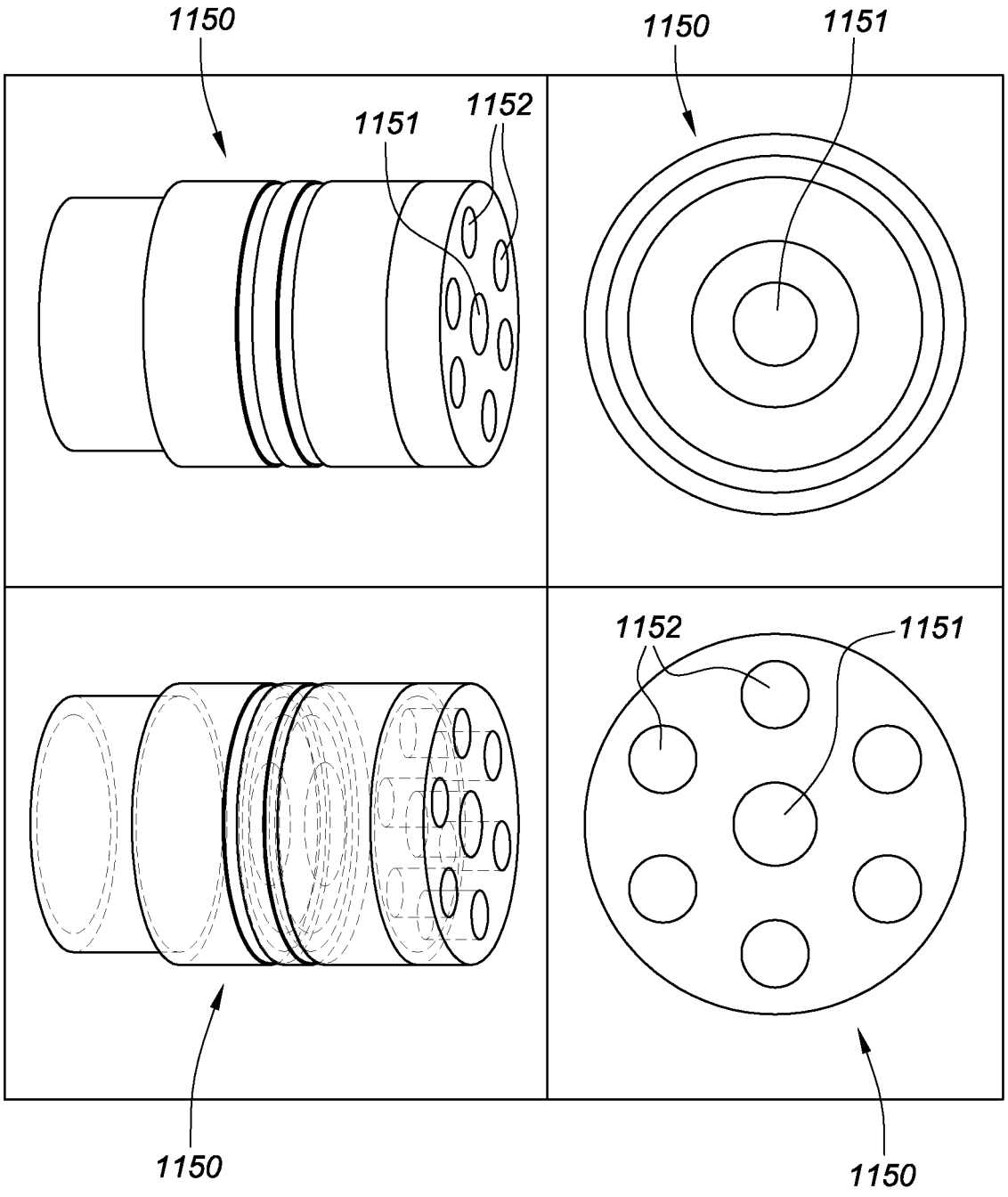

FIG. 42 shows one embodiment of an e-cigarette 1100 with a coaxial mouth end 1101. The e-cigarette 1100 comprises a first aerosol stream 1103, a second aerosol stream 1104, and a mouth end 1101. The mouth end 1101 can comprise a first set of aerosol outlets 1106 and a second set of aerosol outlets 1107. As discussed previously, the aerosol stream can exit the mouth end. In the illustrated embodiment, the first aerosol stream 1103 can exit the second set of aerosol outlets 1107 and the second aerosol stream 1104 can exit the first set of aerosol outlets 1106. In other embodiments the first aerosol stream 1103 and the second aerosol stream 1104 can exit both the first set of aerosol outlets 1107 and the second set of aerosol outlets 1107. FIGS. 43A-43E illustrate some of the possible architecture used for the mouth end. FIG. 43A shows a first annular ring 1111 and a second annular ring 1112. FIG. 43B shows an annular ring 1122 surrounded by a plurality of through-holes 1121. FIG. 43C illustrates an annular ring 1132 and at least one slatted portion 1131. Other designs can also be used in a device of this type, both those shown throughout this disclosure and those incorporating various designs disclosed herein. FIG. 43D depicts four views of a mouth end 1140. The mouth end 1140 comprises a cavity 1141 with a center through-hole 1142 extending therethrough. FIG. 43E depicts four views of a mouth end 1150. The mouth end 1150 comprises a center through-hole 1151 and a plurality of through-holes 1152 surrounding the center through-hole 1151.

Figure 44:
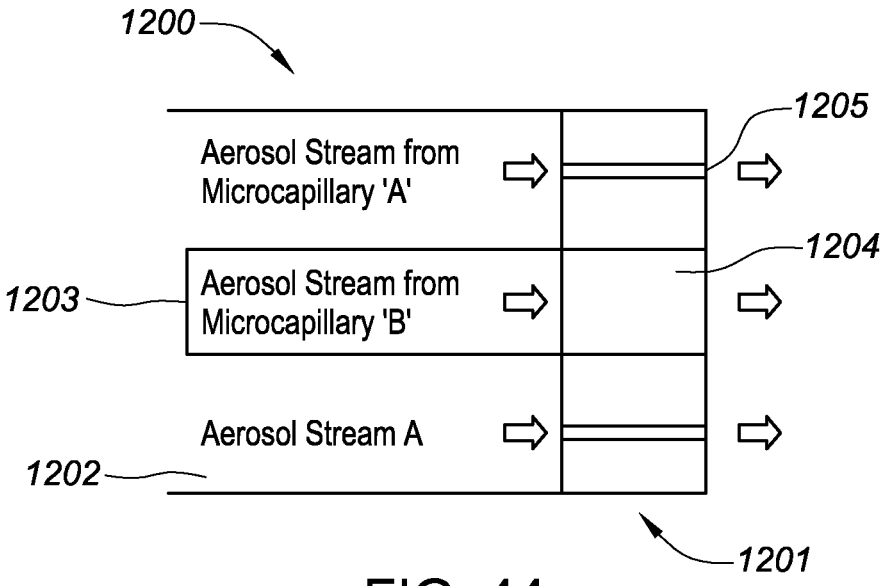
FIG. 44 is a cross-sectional view of another embodiment of an e-cigarette with two aerosol streams and a mouth end with a plurality of outlets.
Figure 45A:
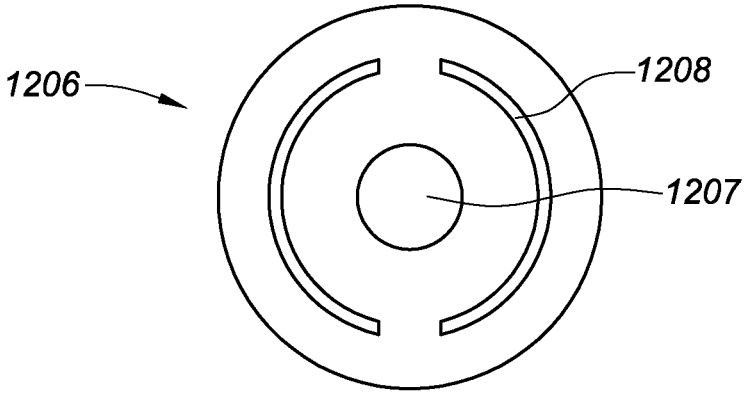
FIGS. 45A-45D are various designs of mouth ends according to the disclosure.
Figure 45B:
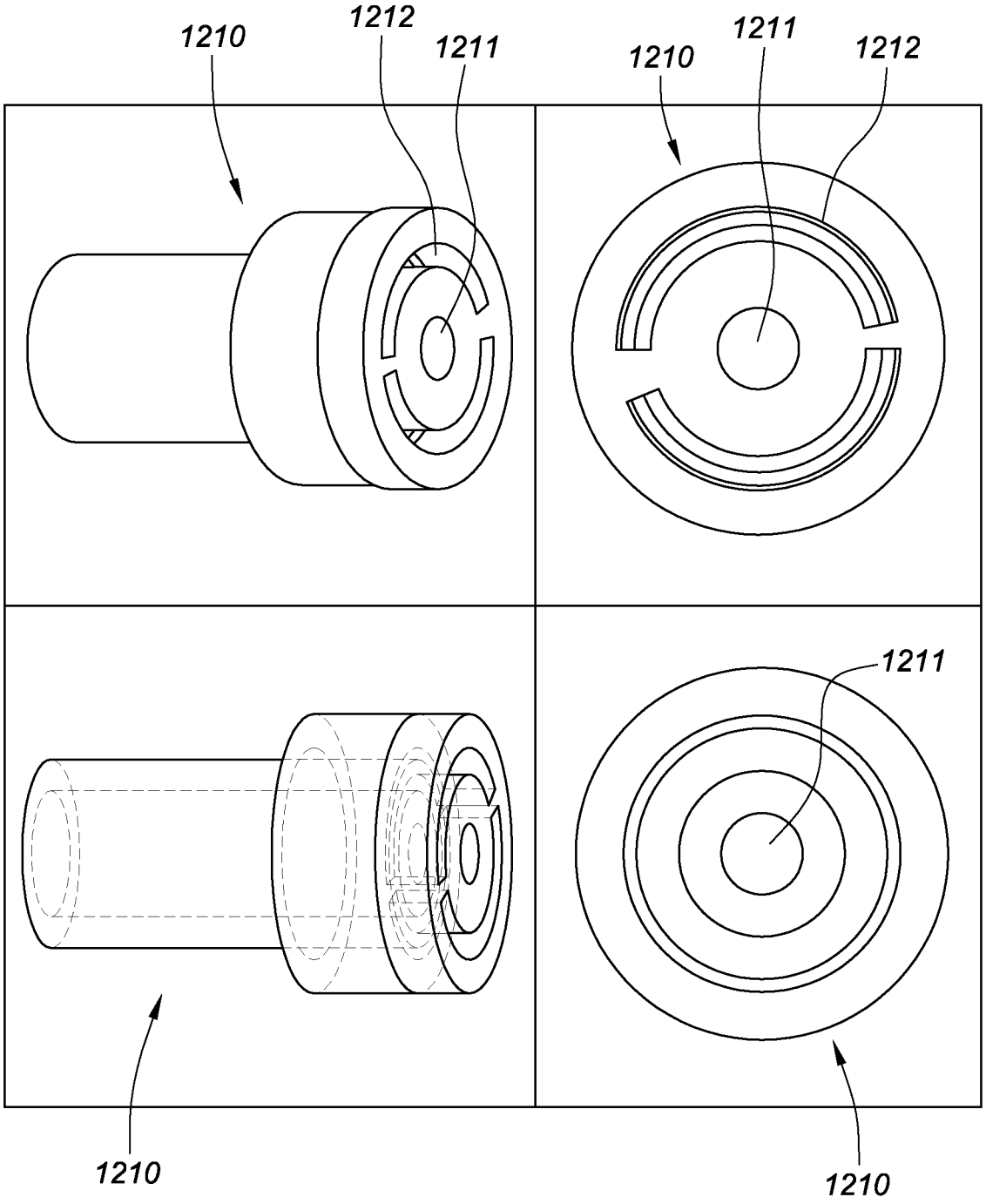
Figure 45C:
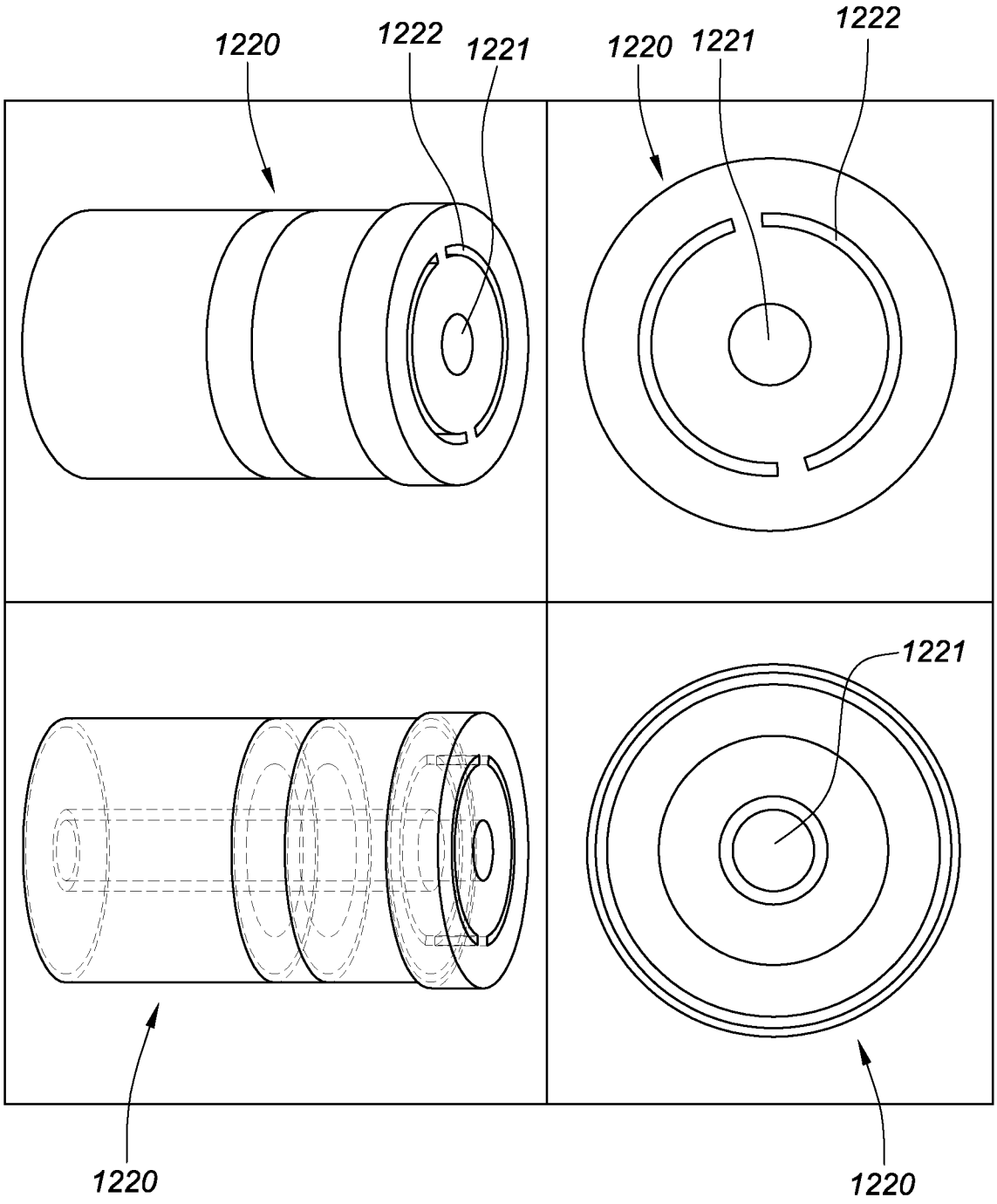
Figure 45D:
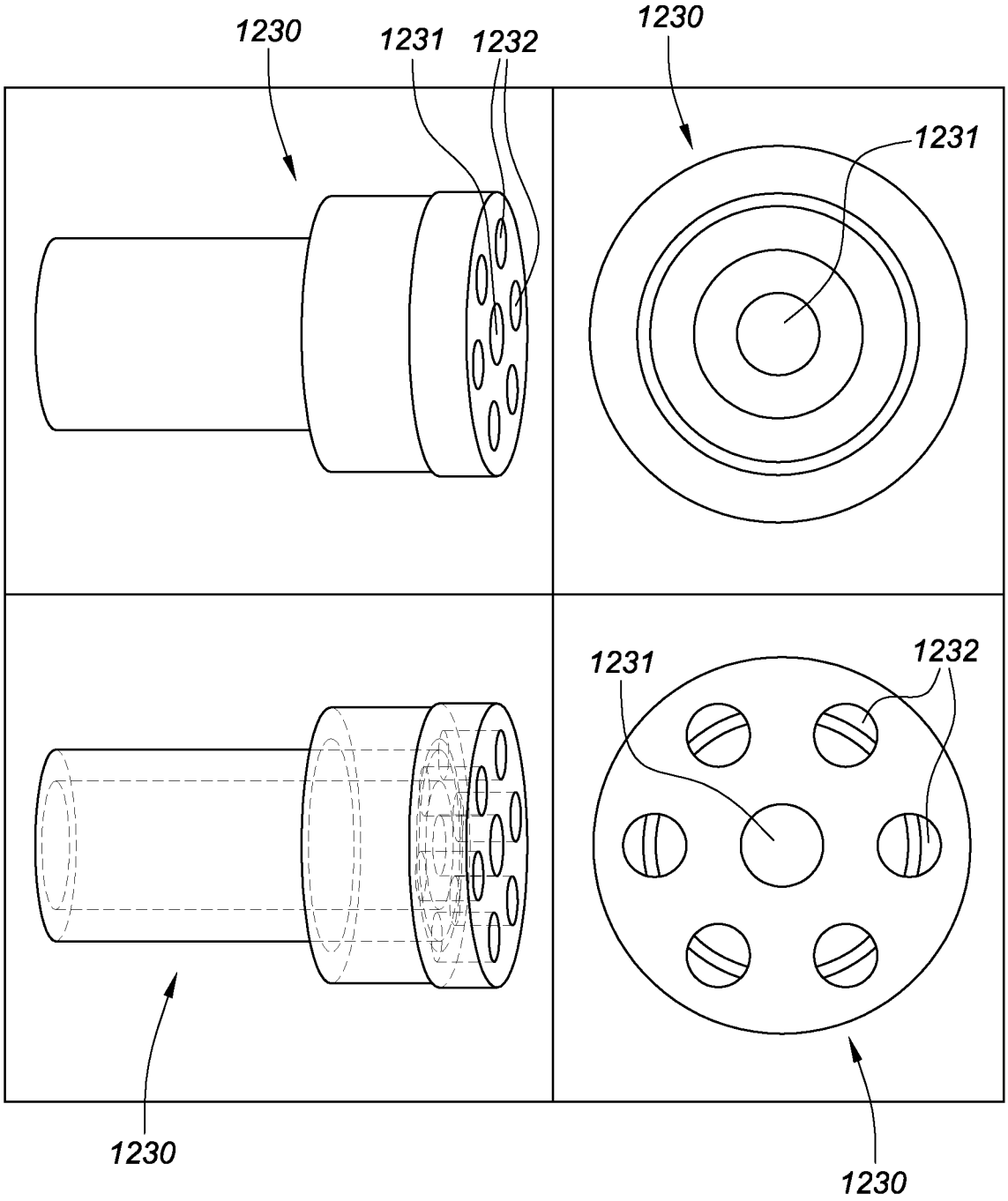

FIG. 44 shows another embodiment of an e-cigarette 1200 with a coaxial mouth end 1201. The e-cigarette 1200 comprises a first aerosol stream 1202, a second aerosol stream 1203, and a mouth end 1201. The mouth end 1201 can comprise a first aerosol outlet 1205 and a second aerosol outlet 1204. As discussed previously, the aerosol stream can exit the mouth end. In the illustrated embodiment, the first aerosol stream 1202 can exit the second set of aerosol outlets 1205 and the second aerosol stream 1203 can exit the first set of aerosol outlets 1204. In other embodiments the first aerosol stream 1202 and the second aerosol stream 1203 can exit both the first set of aerosol outlets 1205 and the second set of aerosol outlets 1204. FIGS. 45A-45D illustrate some of the possible architecture used for the mouth end. FIG. 45A shows a mouth end 1206 with a through hole 1204 and at least one slatted portion 1208. FIG. 45B shows several views of another embodiment of the mouth end 1210 The mouth end 1210 can comprise a through-hole 1211 and at least one slatted portion 1212. FIG. 45C shows several views of another embodiment of the mouth end 1220. The mouth end 1220 can comprise a through-hole 1221 and at least one slatted portion 1222. FIG. 45D shows several views of another embodiment of the mouth end 1230. The mouth end 1230 can comprise a center through-hole 1231 and a plurality of through-holes 1232 surrounding the center through-hole 1231.

Figure 46A:
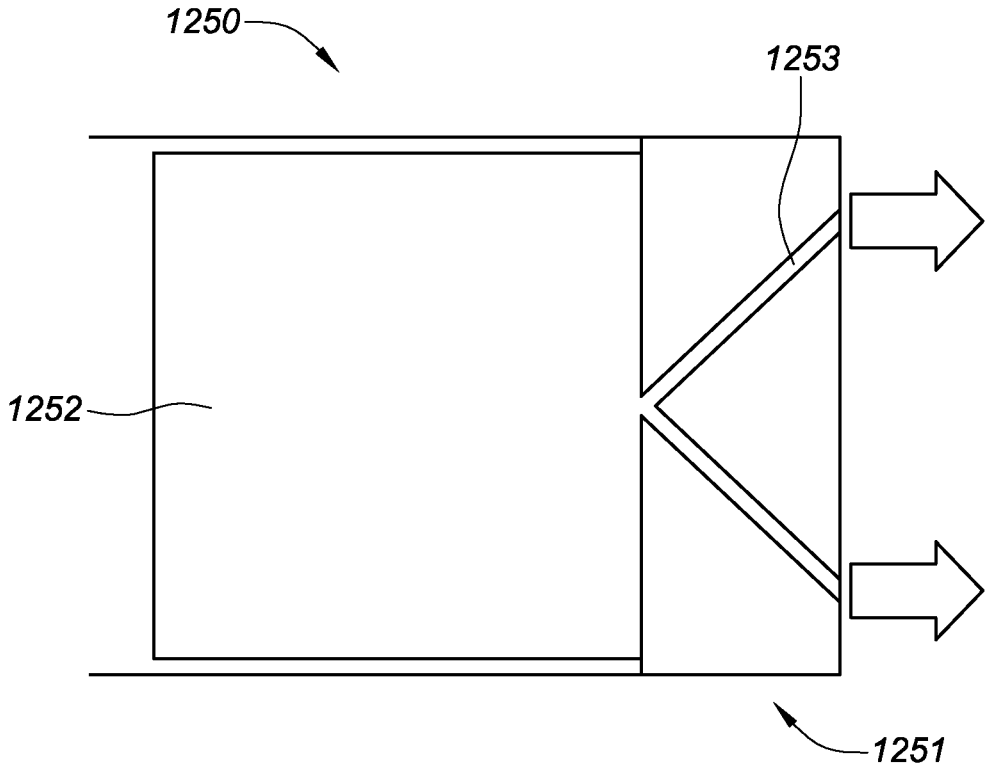
FIGS. 46A and 46B are a cross-sectional side view and an end view of an embodiment of an e-cigarette according to the disclosure.
Figure 46B:
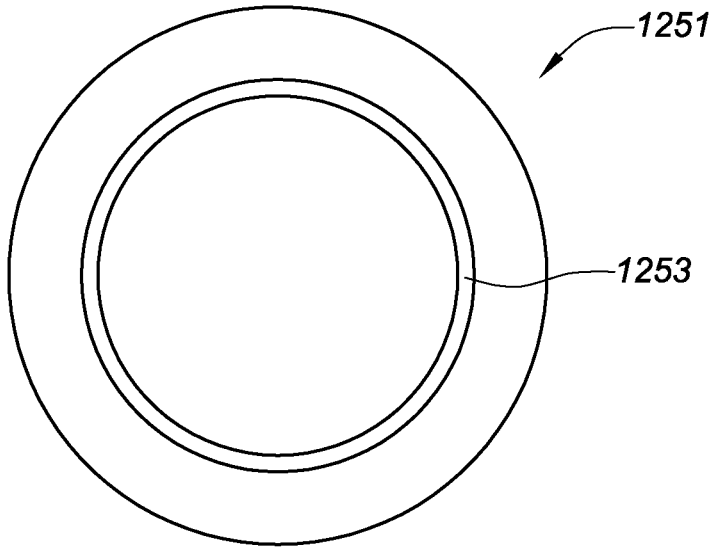

FIGS. 46A and 46B show a side view and an end view of another embodiment of an e-cigarette 1250. The e-cigarette 1250 comprises an aerosol stream 1252 and a mouth end 1251. The mouth end 1251 can comprise at least one aerosol outlet 1253. FIG. 46B shows the at least one aerosol outlet 1253 can comprise an annular ring.

Figure 47A:
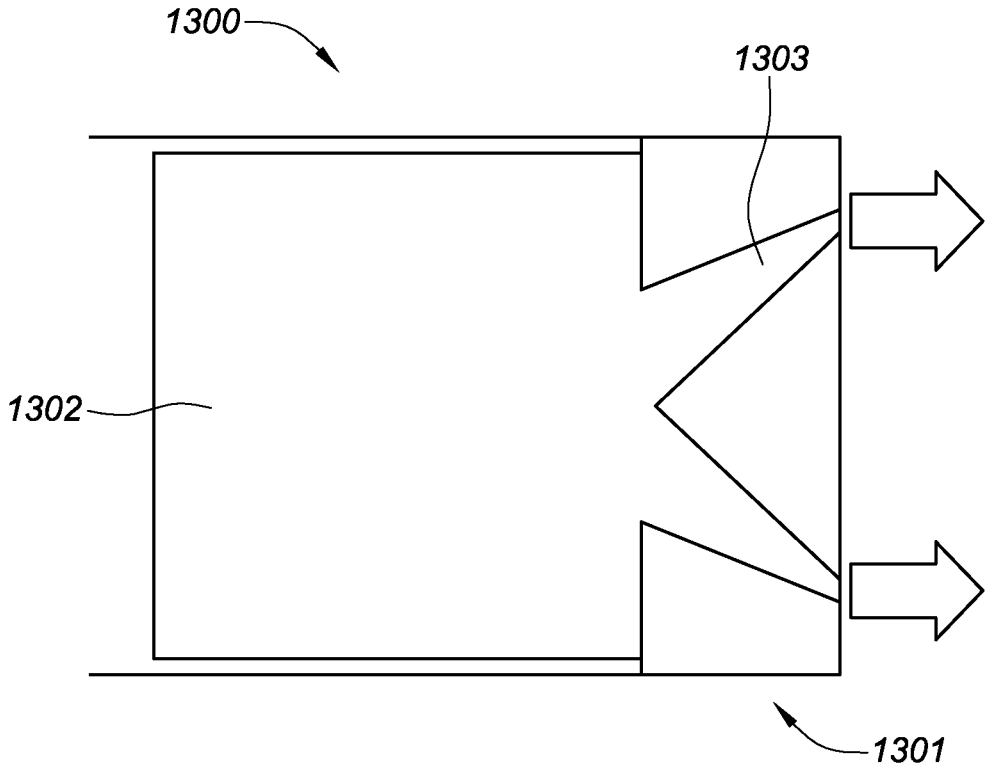
FIGS. 47A and 47B are a cross-sectional side view and an end view of another embodiment of an e-cigarette according to the disclosure.
Figure 47B:
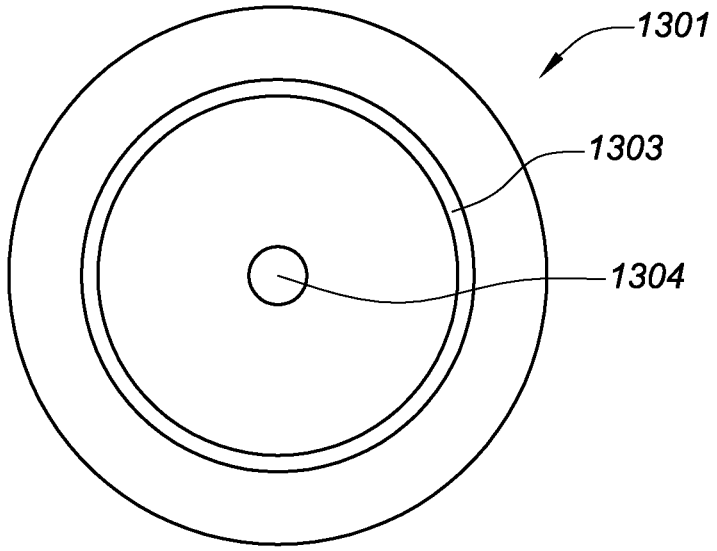

FIGS. 47A and 47B show a side view and an end view of yet another embodiment of an e-cigarette 1300. The e-cigarette 1300 comprises an aerosol stream 1302 and a mouth end 1301. The mouth end 1310 can comprise at least one aerosol outlet 1303. FIG. 47B shows the at least one aerosol outlet 1303 can comprise an annular ring. It further shows an exit port 1304 extending through the mouth end 1301 of the e-cigarette 1300 and configured to have an aerosol pass there through.

Figure 48A:
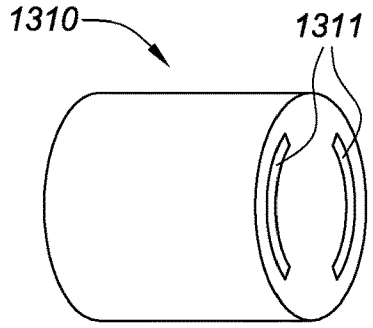
FIGS. 48A-48N are various designs of mouth ends according to the disclosure.
Figure 48B:
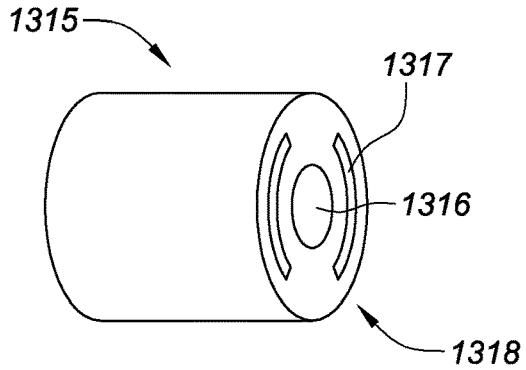
Figure 48C:
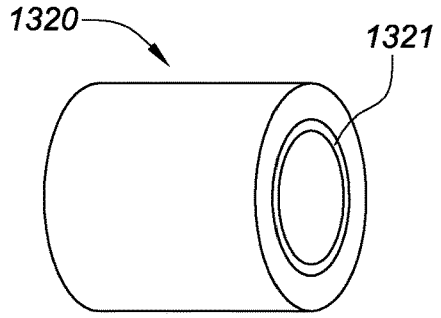
Figure 48D:
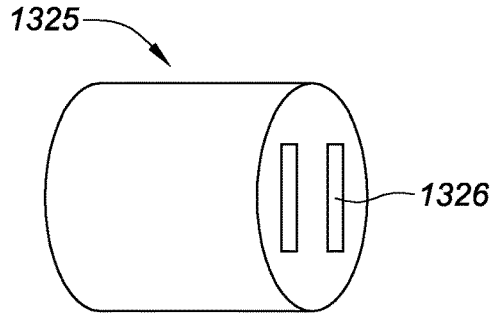
Figure 48E:
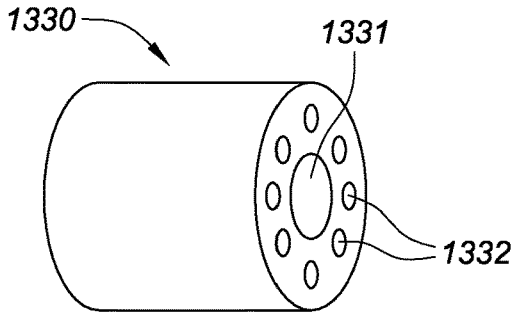
Figure 48F:
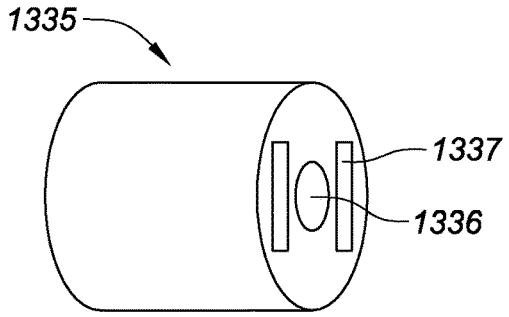
Figure 48G:
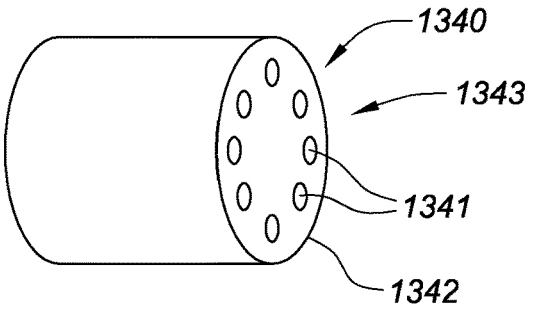
Figure 48H:
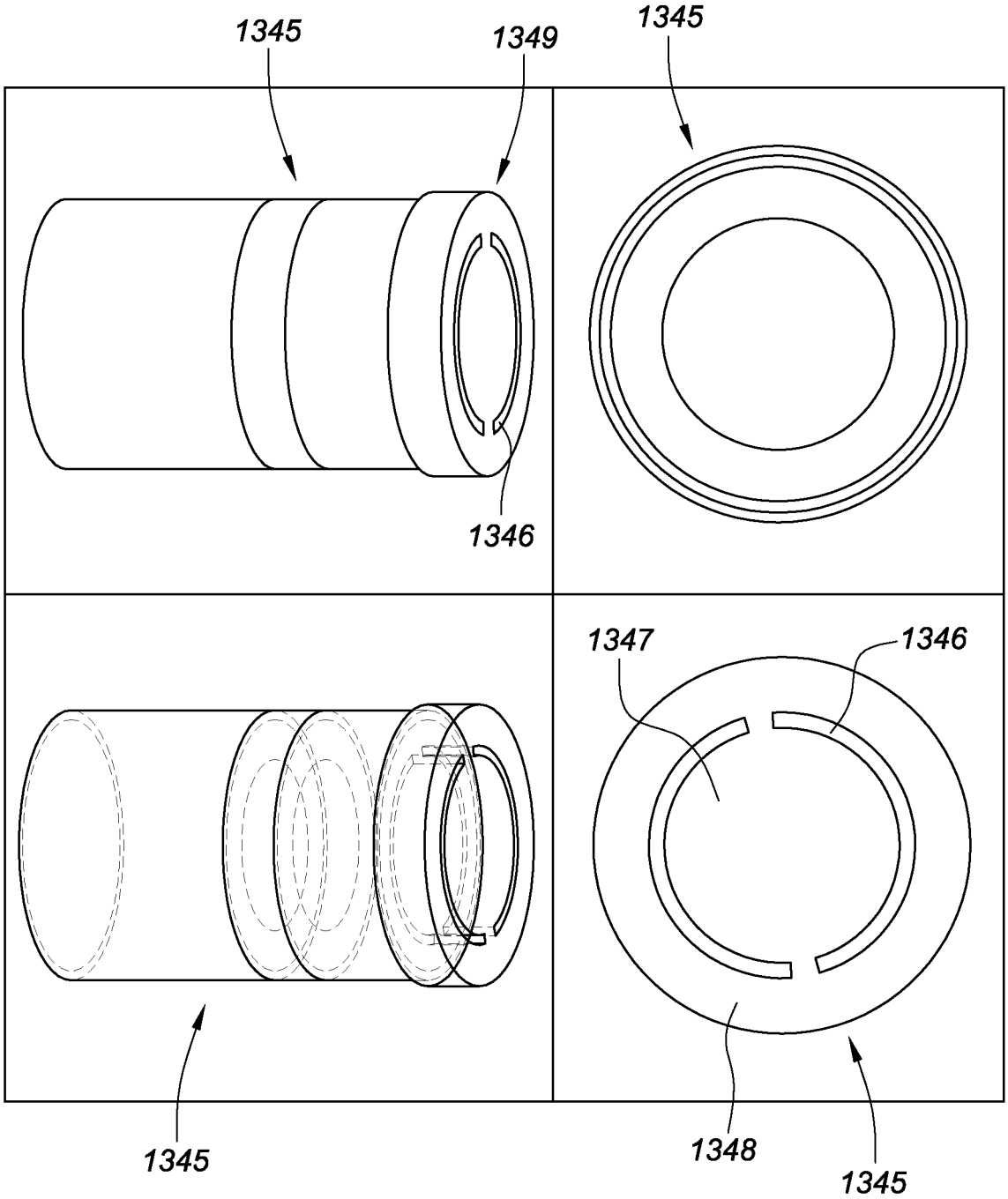
Figure 48I:
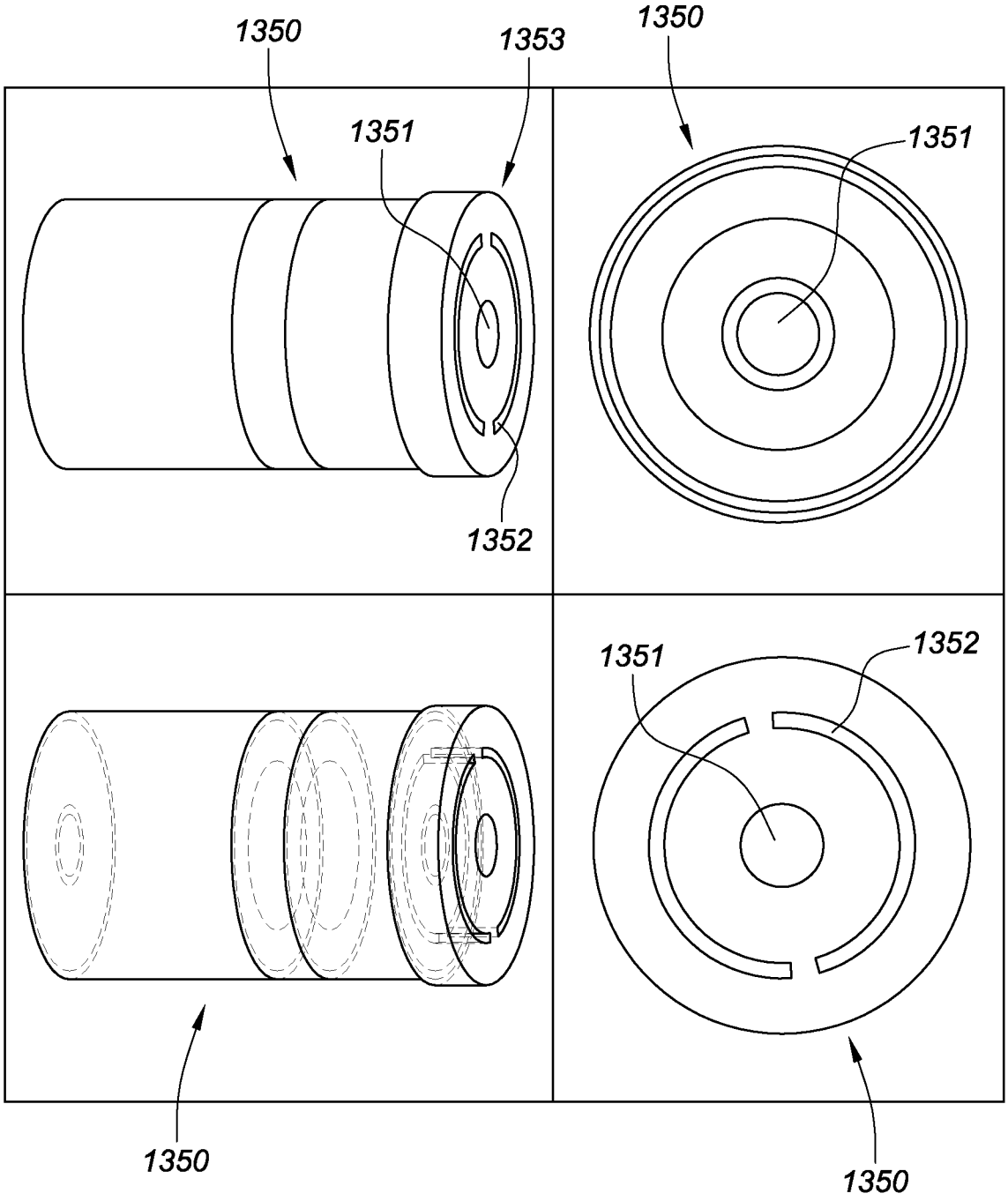
Figure 48J:
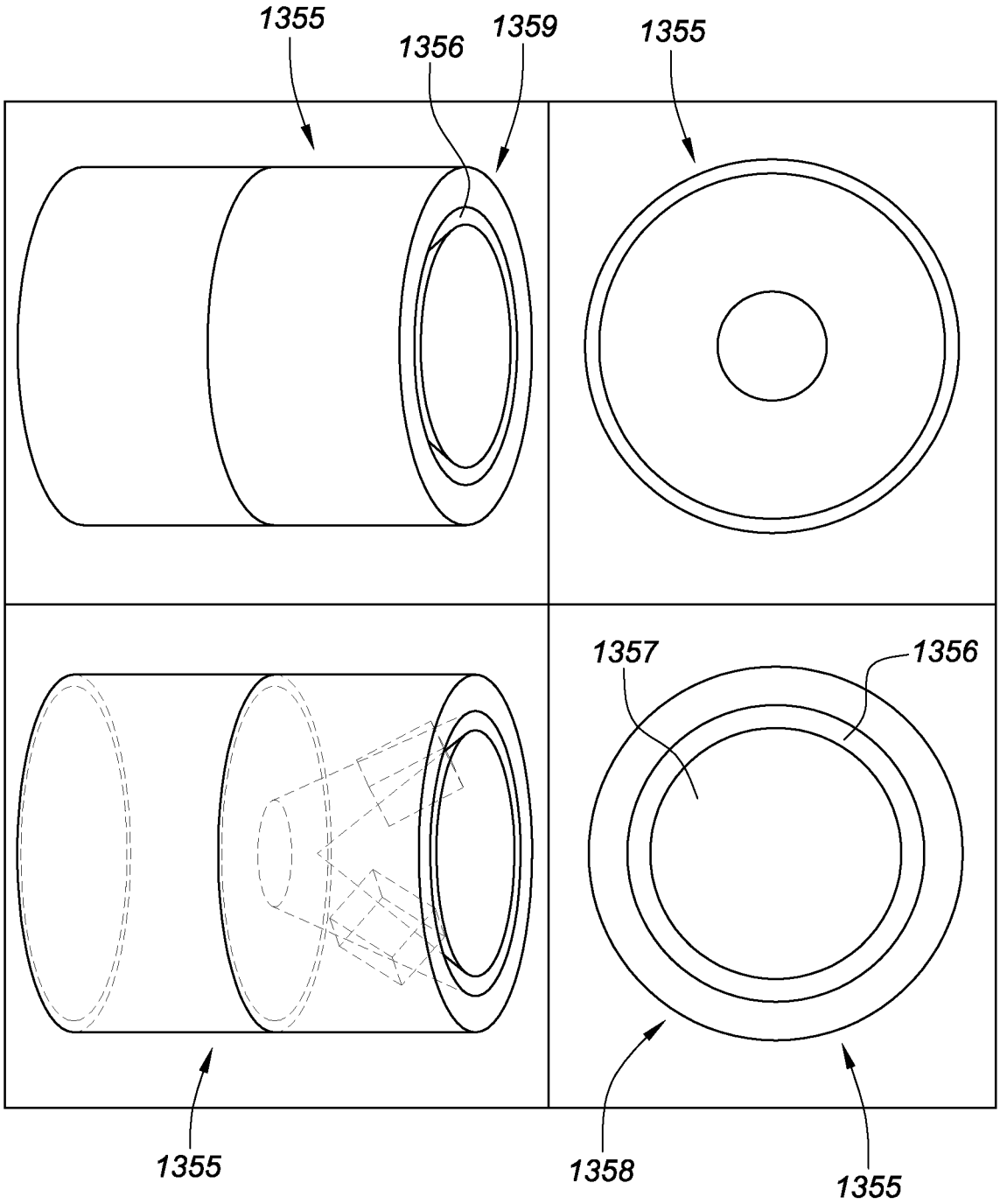
Figure 48K:
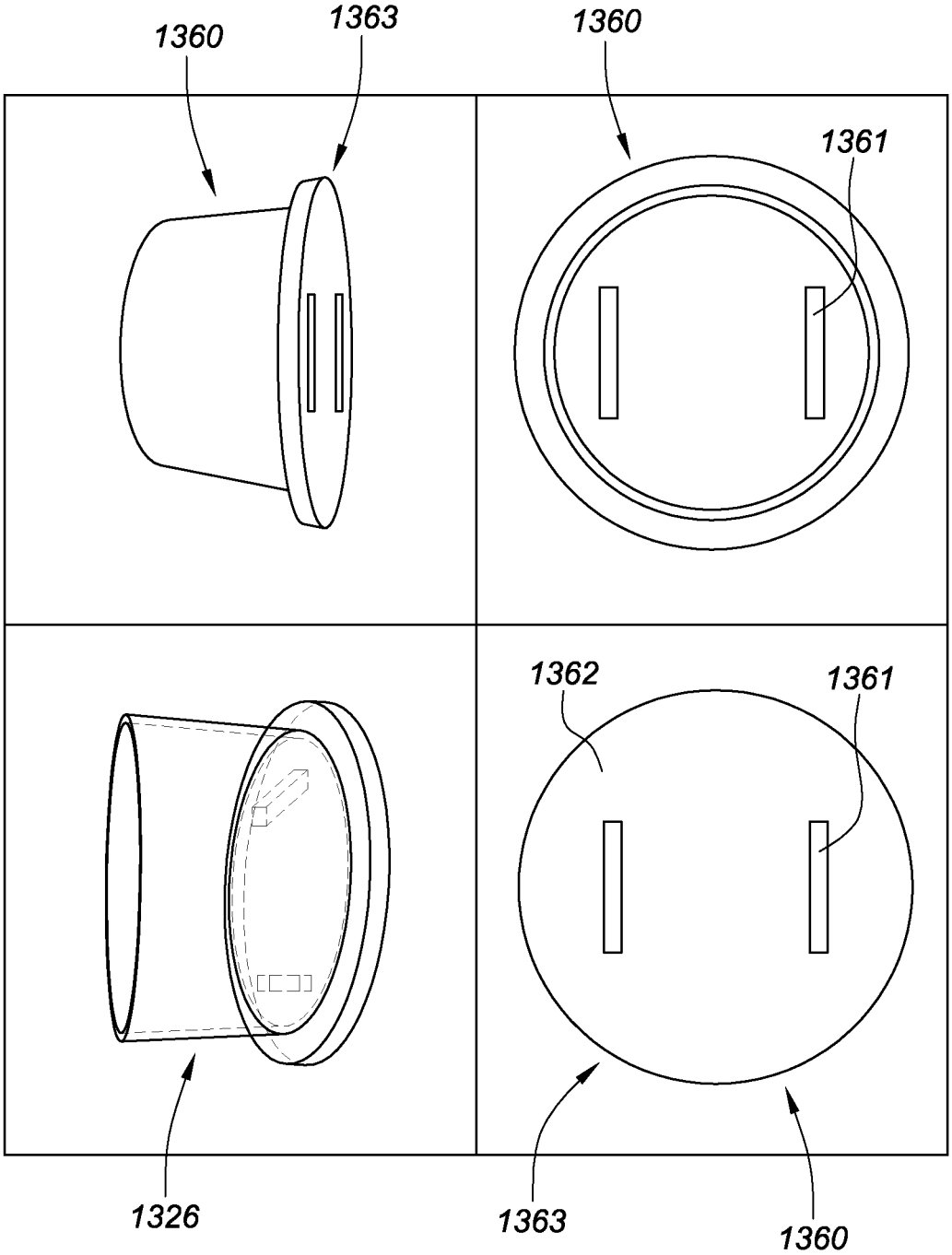
Figure 48L:
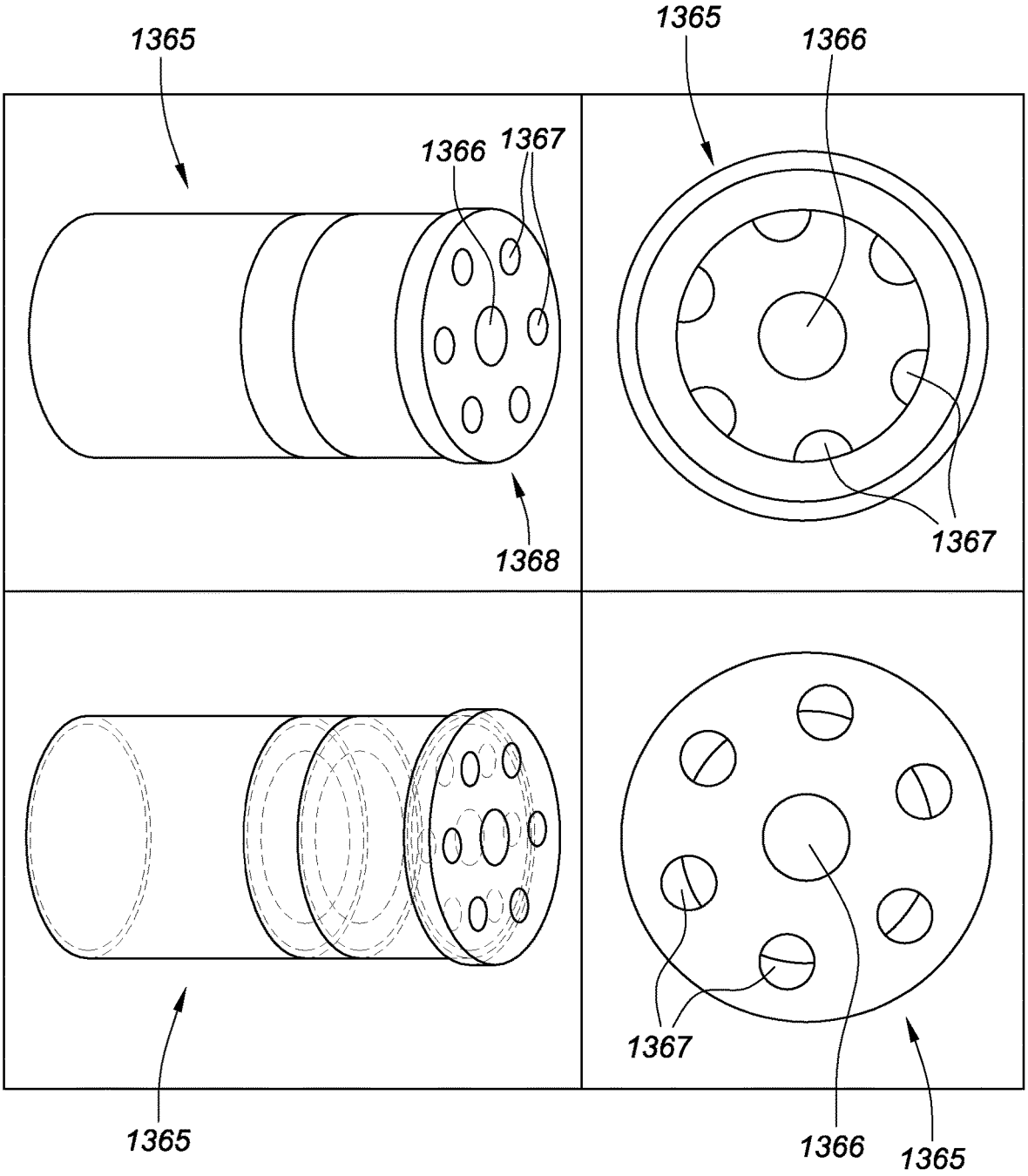
Figure 48M:
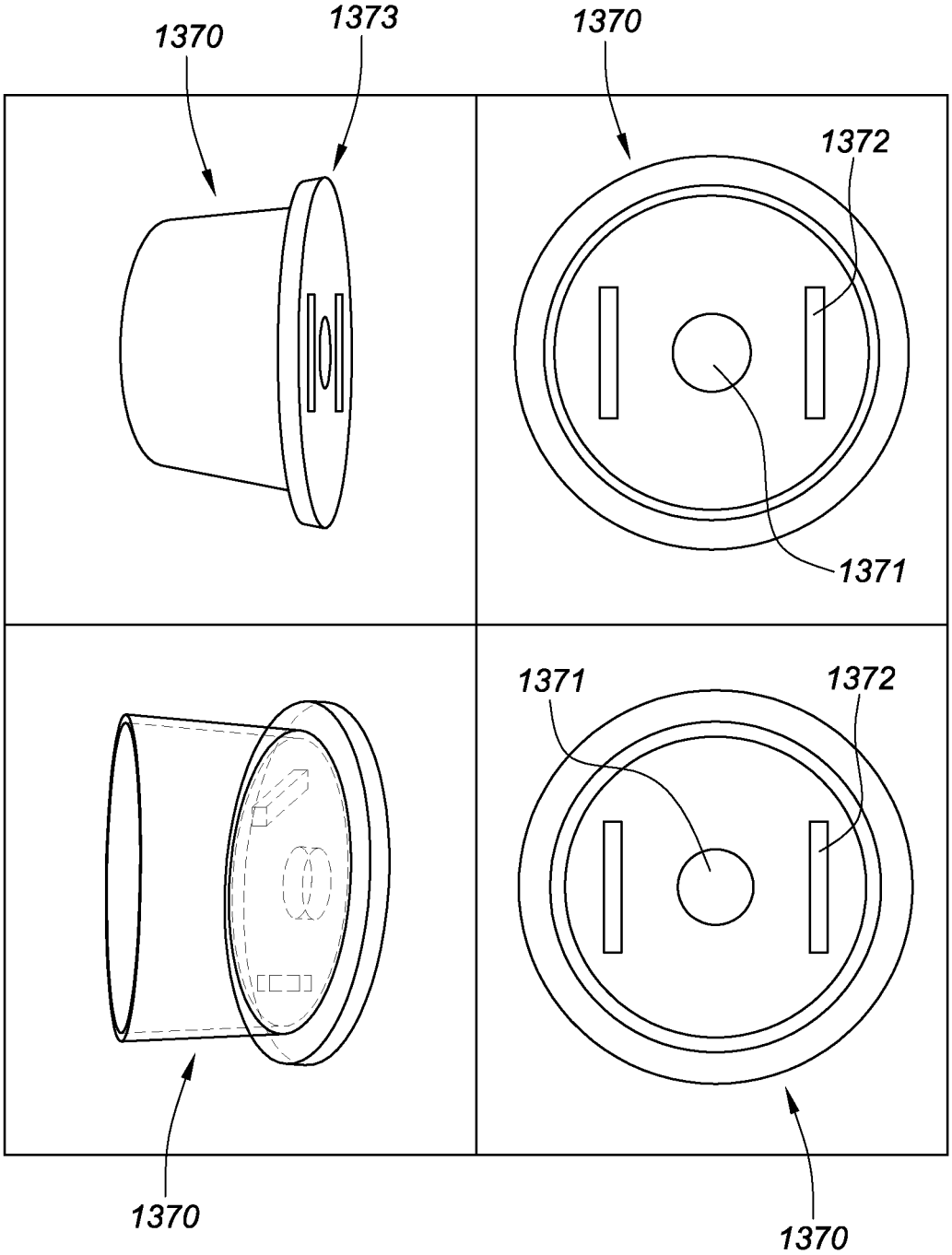
Figure 48N:
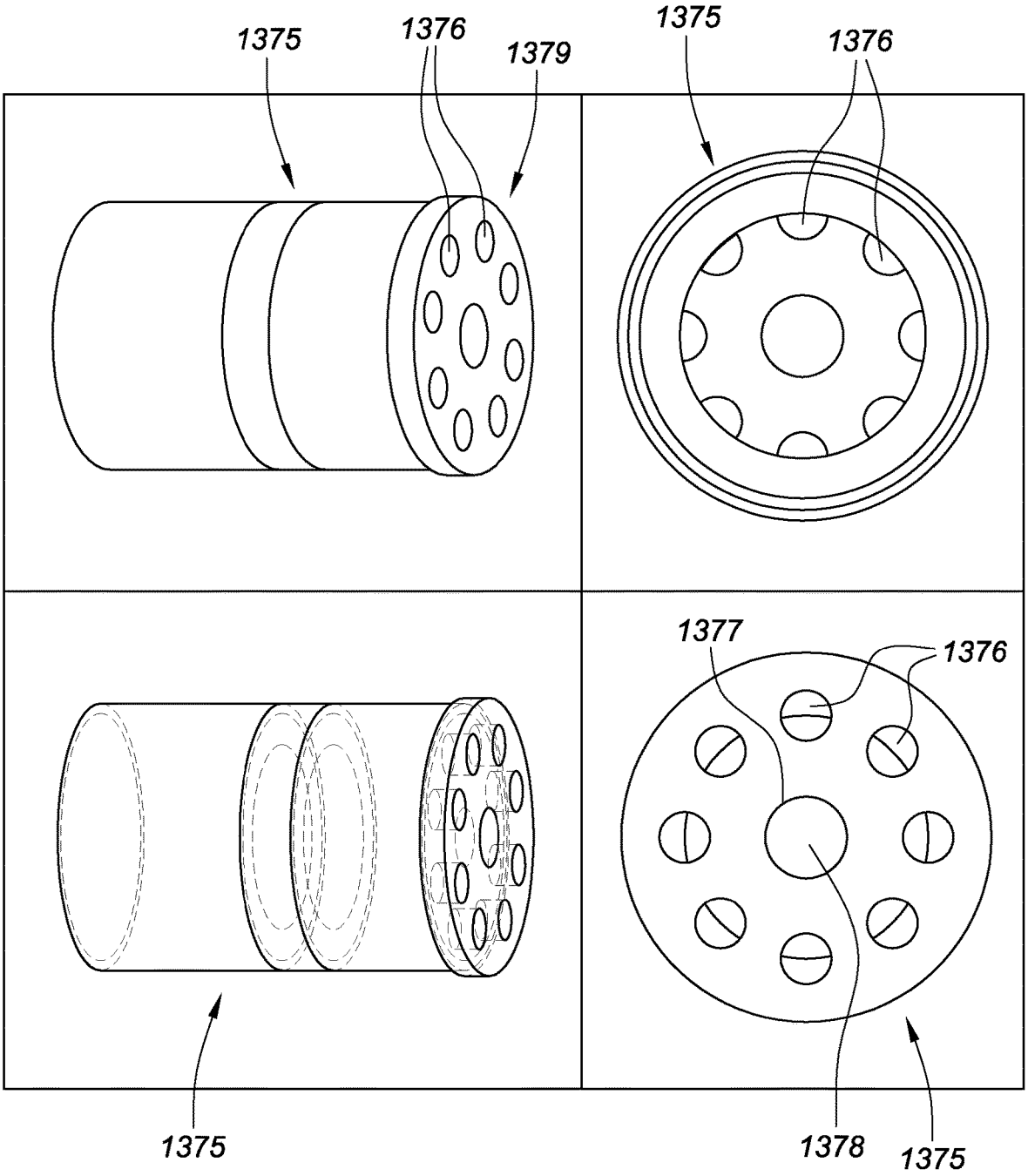

FIGS. 48A-48N show various other embodiments of the architecture capable of being used on various mouth ends. FIG. 48A depicts a mouth end 1310 comprising two opposing slatted portions 1311. FIG. 48B depicts a mouth end 1315 comprising two opposing slatted portions 1317 surrounding a through-hole 1316 in the center of a proximal face 1318 of the mouth end 1315. FIG. 48C depicts a mouth end 1320 comprising an annular ring 1321. FIG. 48D depicts a mouth end 1325 comprising a pair of slots 1326 FIG. 48E depicts a mouth end 1330 comprising a center through-hole 1331 and a plurality of through-holes 1332 surrounding the center through-hole 1331. FIG. 48F depicts a mouth end 1335 comprising a pair of slots 1337 on opposing sides of a center through-hole 1336. FIG. 48G depicts a mouth end 1340 comprising a plurality of through-holes 1341 spaced adjacent an outer edge 1342 of a proximal face 1343 of the mouth end 1340. FIG. 48H depicts four views of a mouth end 1345. A proximal face 1349 of the mouth end 1345 can comprise two slatted portions 1346 circling a solid middle portion 1347 and surrounded by a solid outer portion 1348. FIG. 48I depicts four views of a mouth end 1350. A proximal face 1353 of the mouth end 1350 can comprise two slatted portions 1352 circling a center through-hole 1351. FIG. 48J depicts four views of a mouth end 1355. A proximal face 1359 of the mouth end 1355 can comprise an annular ring 1356 circling a solid middle portion 1357. An outer edge 1358 of the proximal face can surround the annular ring 1356. FIG. 48K depicts four views of a mouth end 1360. A proximal face 1363 of the mouth end 1360 can comprise a pair of rectangular openings 1361 offset across a solid middle portion 1362 of the proximal face 1363. FIG. 48L depicts four views of a mouth end 1365. A proximal face 1368 of the mouth end 1365 can comprise a plurality of through-holes 1367 circling a center through-hole 1366. FIG. 48M depicts four views of a mouth end 1370. A proximal face 1373 of the mouth end 1370 can comprise a pair of rectangular openings 1372 offset across a center through-hole 1371. FIG. 48N depicts four views of a mouth end 1375. A proximal face 1379 of the mouth end 1375 can comprise a plurality of through-holes 1376 circling a plug 1378 placed within a center through-hole 1377.

Figure 49:
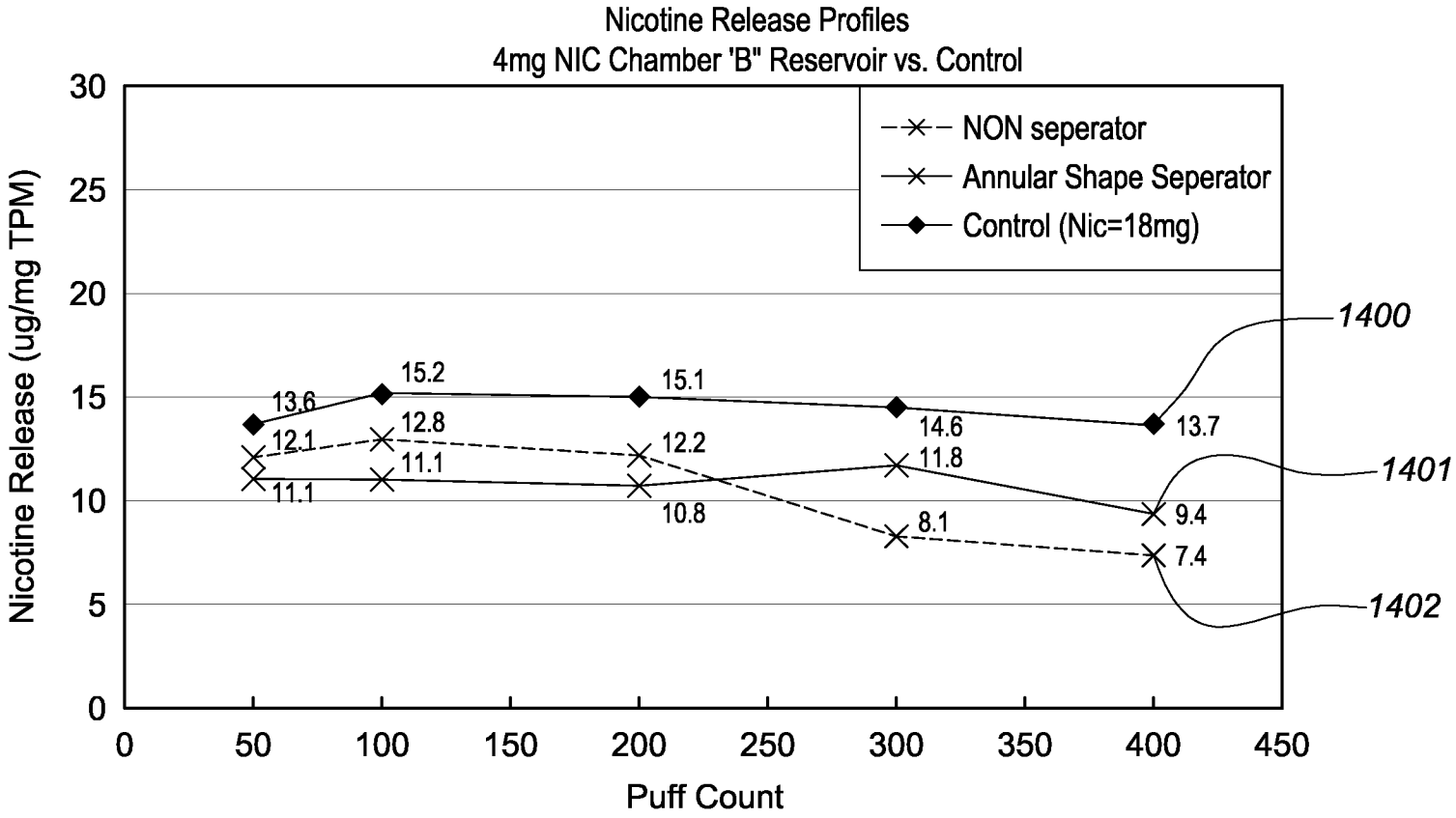
FIG. 49 is a graph showing the impact on the nicotine release profiles by varying the separator on embodiments of an e-cigarette and their comparison to a control.

As seen in FIG. 38, the nicotine release of the control (ug/mg) throughout the duration of the puff count shown is mostly flat. It can be desirable for an embodiment of an e-cigarette according to the disclosure to also have a mostly flat profile for nicotine release per puff with respect to TPM. As shown in FIG. 49, varying the design and configuration of the separator of the e-cigarette can alter the nicotine release profile of an e-cigarette. FIG. 49 illustrates the nicotine release profile for a control e-cigarette 1400, an e-cigarette with a separator with an annular shape 1401, and an e-cigarette with no separator 1402. As seen in FIG. 49 the nicotine release profiles of the control 1400 and annular shape separator 1401 are flatter than the embodiment with no separator 1402. The control profile varies from 13.6 to 15.2 and the annular shape profile varies from 9.4 to 11.8. Various other designs can also be used to control the nicotine release profile of the e-cigarette. Several embodiments of contemplated separator designs are illustrated in FIGS. 50A-50G.

FIGS. 50A-50G show various other embodiments of the designs used on different embodiments of separators. FIG.

Figure 50A:
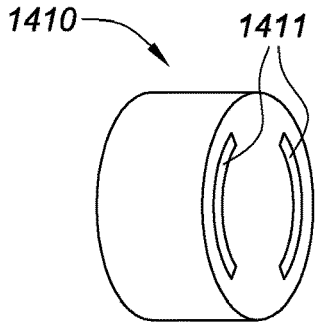
FIGS. 50A-50G are various embodiments of separators according to the disclosure.
Figure 50B:
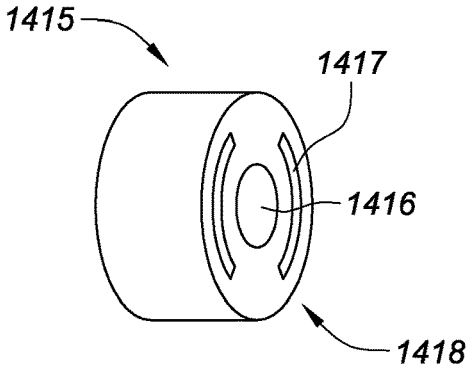
Figure 50C:
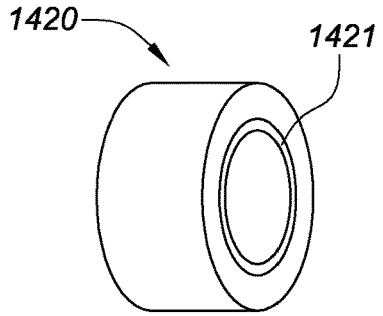
Figure 50D:
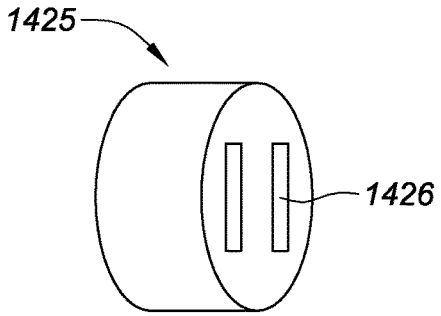
Figure 50E:
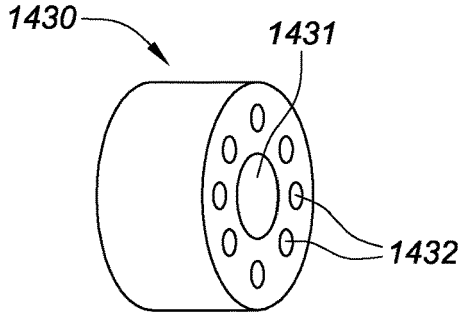
Figure 50F:
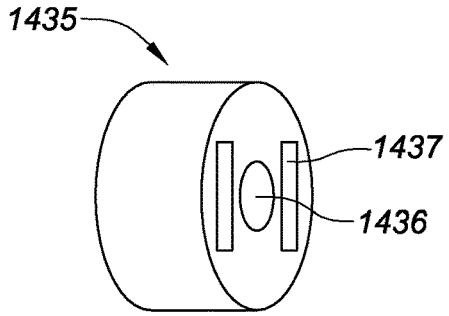
Figure 50G:
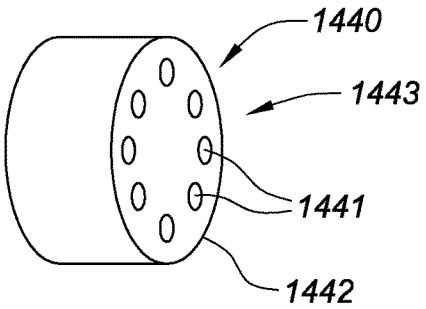

50A depicts a separator 1410 comprising two opposing slatted portions 1411. The separator 1410 used in the e-cigarette with an annular shape as illustrated in FIG. 36 is similar to that illustrated in FIG. 50A. FIG. 50B depicts a separator 1415 comprising two opposing slatted portions 1417 surrounding a through-hole 1416 in the center of a proximal face 1418 of the mouth end 1415. FIG. 50C depicts a separator 1420 comprising an annular ring 1421 FIG. 50D depicts a separator 1425 comprising a pair of slots 1426. FIG. 50E depicts a separator 1430 comprising a center through-hole 1431 and a plurality of through-holes 1432 surrounding the center through-hole 1431. FIG. 50F depicts a separator 1435 comprising a pair of slots 1437 on opposing sides of a center through-hole 1436. FIG. 50G depicts a separator 1440 comprising a plurality of through-holes 1441 spaced adjacent an outer edge 1442 of the proximal face 1443 of the mouth end 1440.

Although several embodiments have been described above with a certain degree of particularity, those skilled in the art could make numerous alterations to the disclosed embodiments without departing from the spirit of the present disclosure. It is intended that all matter contained in the above description or shown in the accompanying drawings shall be interpreted as illustrative only and not limiting. Changes in detail or structure may be made without departing from the present teachings. The foregoing description and following claims are intended to cover all such modifications and variations. Further, although only certain embodiments of this invention have been described above with a certain degree of particularity, those skilled in the art could make numerous alterations to the disclosed embodiments without departing from the scope of this invention.

Various embodiments are described herein of various apparatuses, systems, and methods. Numerous specific details are set forth to provide a thorough understanding of the overall structure, function, manufacture, and use of the embodiments as described in the specification and illustrated in the accompanying drawings. It will be understood by those skilled in the art, however, that the embodiments may be practiced without such specific details. In other instances, well-known operations, components, and elements have not been described in detail so as not to obscure the embodiments described in the specification. Those of ordinary skill in the art will understand that the embodiments described and illustrated herein are non-limiting examples, and thus it can be appreciated that the specific structural and functional details disclosed herein may be representative and do not necessarily limit the scope of the embodiments, the scope of which is defined solely by the appended claims.

Furthermore, the flavor containing inserts of this invention can be packaged as pressure releasable blisters, peelable ribbons or similar package strategies known in the packaging industry. An example is shown in FIG. 34 for a pressure releasable blister package of a plurality of flavor containers Reference throughout the specification to "various embodiments," "some embodiments," "one embodiment," "an embodiment," or the like, means that a particular feature, structure, or characteristic described in connection with the embodiment is included in at least one embodiment. Thus, appearances of the phrases "in various embodiments," "in some embodiments," "in one embodiment," "in an embodiment," or the like, in places throughout the specification are not necessarily all referring to the same embodiment. Furthermore, the particular features, structures, or characteristics may be combined in any suitable manner in one or more embodiments. Thus, the particular features, structures, or characteristics illustrated or described in connection with one embodiment may be combined, in whole or in part, with the features structures, or characteristics of one or more other embodiments without limitation.

It will be appreciated that the terms "proximal" and "distal" may be used throughout the specification with reference to a clinician manipulating one end of an instrument used to treat a patient. The term "proximal" refers to the portion of the instrument closest to the clinician and the term "distal" refers to the portion located furthest from the clinician. It will be further appreciated that for conciseness and clarity, spatial terms such as "vertical," "horizontal," "up," and "down" may be used herein with respect to the illustrated embodiments. However, surgical instruments may be used in many orientations and positions, and these terms are not intended to be limiting and absolute.

Any patent, publication, or other disclosure material, in whole or in part, that is said to be incorporated by reference herein is incorporated herein only to the extent that the incorporated materials does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

What is claimed is:

1. An apparatus for generating a functionalized aerosol, the apparatus comprising:

a battery section comprising a first housing, a battery disposed within the first housing, and a first connector coupled to the first housing;

an aerosol section comprising a second housing, an aerosol forming chamber disposed within the second housing, a liquid container fluidly coupled to the aerosol forming chamber, and a pod bay; and an insert section comprising a third housing, an insert connector, an annular separator, a flavor reservoir, a heating element, and a mouth end, wherein the flavor reservoir comprises a nicotine substance, wherein the heating element comprises an electric nebulization and is configured to control a temperature of the flavor reservoir, and wherein the annular separator is configured to control a release of nicotine from the nicotine substance to an aerosol passing through the insert section, wherein the battery section is configured to couple to the aerosol section, wherein the aerosol section is configured to couple to the insert section, wherein the insert section is configured to be removably inserted into the aerosol section, and wherein the insert connector is configured to fit within the pod bay.

2. The apparatus for generating a functionalized aerosol according to claim 1, wherein the insert section further comprises a chamber configured to contain a flavoring.

3. The apparatus for generating a functionalized aerosol according to claim 2, wherein the chamber further comprises a coaxial design comprising a core portion and a shell portion.

4. The apparatus for generating a functionalized aerosol according to claim 3, wherein the shell portion surrounds an exterior portion of the core portion.

5. The apparatus for generating a functionalized aerosol according to claim 1, wherein the annular separator comprises at least one slatted portion.

6. The apparatus for generating a functionalized aerosol according to claim 5, wherein the annular separator further comprises at least one through-hole.

7. The apparatus for generating a functionalized aerosol according to claim 1, wherein the insert section further comprises a foam insert.

8. The apparatus for generating a functionalized aerosol according to claim 7, wherein the foam insert comprises a material with a high pore density.

9. The apparatus for generating a functionalized aerosol according to claim 8, wherein the high pore density comprises a pore density of between 50 and 100 pores per inch.

10. The apparatus for generating a functionalized aerosol according to claim 1, wherein the mouth end further comprises a through-hole.

11. The apparatus for generating a functionalized aerosol according to claim 1, wherein the mouth end further comprises a plurality of through-holes equally spaced around a perimeter of the mouth end.

12. An apparatus for generating a functionalized aerosol, the apparatus comprising:

a battery section comprising a first housing, a battery disposed within the first housing, and a first connector coupled to the first housing;

an aerosol section comprising a second housing, an aerosol forming chamber disposed within the second housing, a fluid container fluidly coupled to the aerosol forming chamber, and a pod bay; and an insert section comprising a third housing, an insert connector, a chamber, an annular separator, a flavor reservoir, a heating element, and a coaxial mouth end, wherein the flavor reservoir comprises a nicotine substance, wherein the heating element comprises an electric nebulization and is configured to control a temperature of the flavor reservoir, and wherein the annular separator is configured to control a release of nicotine from the nicotine substance to an aerosol passing through the insert section, wherein the battery section is configured to couple to the aerosol section, wherein the aerosol section is configured to couple to the insert section, wherein the insert section is configured to be removably inserted into the aerosol section, and wherein the insert connector is configured to fit within the pod bay.

13. The apparatus for generating a functionalized aerosol according to claim 12, wherein the chamber comprises a coaxial design comprising a core portion and a shell portion configured to receive an aerosol stream from the aerosol section and wherein the chamber is configured to separate the aerosol stream into a first aerosol stream and a second aerosol stream within the insert section.

14. The apparatus for generating a functionalized aerosol according to claim 13, wherein the coaxial mouth end comprises a first aerosol outlet configured pass the first aerosol stream to an exterior portion of the insert section.

15. The apparatus for generating a functionalized aerosol according to claim 14, wherein the coaxial mouth end comprises a second aerosol outlet configured pass the second aerosol stream to the exterior portion of the insert section.

16. The apparatus for generating a functionalized aerosol according to claim 15, wherein the second aerosol outlet comprises at least one slatted portion.

17. The apparatus for generating a functionalized aerosol according to claim 12, wherein the chamber comprises a coaxial design comprising a foam insert configured to receive an aerosol stream from the aerosol section.

18. The apparatus for generating a functionalized aerosol according to claim 17, wherein the coaxial mouth end comprises an aerosol outlet configured pass the aerosol stream to an exterior portion of the insert section.

19. The apparatus for generating a functionalized aerosol according to claim 18, wherein the aerosol outlet comprises an annular ring.

20. The apparatus for generating a functionalized aerosol according to claim 18, wherein the aerosol outlet comprises at least one slatted portion.

* * * * *